US012791288B2

(12) United States Patent
Geissele et al.

(10) Patent No.: US 12,791,288 B2
(45) Date of Patent: Nov. 10, 2026

(54) MODULAR SCOPE MOUNTS AND ACCESSORY MOUNTS

(71) Applicant: WHG Properties, LLC, North Wales, PA (US)

(72) Inventors: William H. Geissele, Lower Gwynedd, PA (US); Frank E. Robinson, Schwenksville, PA (US)

(73) Assignee: WHG PROPERTIES, LLC, North Wales, PA (US)

( * ) Notice: Subject to any disclaimer, the term of this patent is extended or adjusted under 35 U.S.C. 154(b) by 0 days.

(21) Appl. No.: 18/905,254

(22) Filed: Oct. 3, 2024

(65) Prior Publication Data

US 2026/0098709 A1 Apr. 9, 2026

(51) Int. Cl.
*F41G 11/00* (2006.01)

(52) U.S. Cl.
CPC ..... *F41G 11/003* (2013.01)

(58) Field of Classification Search
CPC ..... F41G 11/003; F41G 11/00
See application file for complete search history.

(56) References Cited

U.S. PATENT DOCUMENTS 3,737,232 A * 6/1973 Milburn, Jr. ..... G02B 23/14 356/18
3,880,389 A * 4/1975 Burris ..... F41G 11/006 D22/109
3,992,783 A * 11/1976 Dunlap ..... F41G 11/003 42/124
4,841,659 A * 6/1989 Williams ..... F41G 1/10 D22/109
4,959,908 A * 10/1990 Weyrauch ..... F41G 11/003 42/127
5,003,697 A * 4/1991 Hampton ..... F41G 1/383 42/129
5,887,375 A * 3/1999 Watson ..... G03B 29/00 42/106
7,121,037 B2 * 10/2006 Penney ..... F41G 11/001 42/126

(Continued)

OTHER PUBLICATIONS

Kensight, Mosm Alpha 34mm dia. Heavy Duty One Piece Scope Mount, [retrieved from Internet Nov. 7, 2024] https://kensight.com/mosm-alpha-34mm-dia-heavy-duty-one-piece-scope-mount-by-kensight/.

(Continued)

*Primary Examiner* — Michelle Clement
(74) *Attorney, Agent, or Firm* — Alston & Bird LLP

(57) ABSTRACT

A scope mount cap may include a lower surface, a single lateral groove being open on a top side and on both lateral ends of the single lateral groove, and a recess on each lateral side of the scope mount cap defined at each of the respective lateral ends of the single lateral groove. The single lateral groove may be laterally shorter at a bottom side opposite the top side than at the top side. A scope mount may engage the scope mount cap and may include a body configured to attach to an upper receiver of the firearm and define a lower scope mount portion. The body may define at least one lateral accessory mount point comprising an opening extending in a lateral direction perpendicular to the longitudinal direction, the opening defined at a height below a height of the passage.

20 Claims, 29 Drawing Sheets

(56) References Cited

U.S. PATENT DOCUMENTS 7,900,390 B2 * 3/2011 Moody ..... F41A 23/08 42/71.01
7,954,273 B1 * 6/2011 Swan ..... F41G 1/35 42/117
8,104,218 B2 * 1/2012 McCann ..... F41G 1/033 42/144
8,220,946 B1 * 7/2012 Teetzel ..... F41G 11/003 89/200
8,468,735 B1 * 6/2013 Keng ..... F41G 1/08 42/148
8,726,562 B1 * 5/2014 Hoskisson ..... F41G 11/003 42/126
8,752,320 B2 * 6/2014 Masters ..... F41C 23/16 42/71.01
D713,921 S * 9/2014 Williams ..... D22/109
D715,393 S * 10/2014 Williams ..... D22/109
9,025,040 B2 * 5/2015 Thyssen ..... H04N 23/6812 235/407
RE45,724 E * 10/2015 Dueck ..... F41G 1/02
9,417,034 B1 * 8/2016 Swan ..... F41G 1/17
9,441,915 B2 * 9/2016 Zimmer ..... F41G 11/001
9,453,707 B2 9/2016 Williams et al.
D779,623 S * 2/2017 Geissele ..... D22/109
9,857,146 B1 * 1/2018 Shelton ..... F41G 11/003
10,030,935 B1 * 7/2018 Ding ..... F41G 1/17
10,254,084 B2 * 4/2019 Connolly ..... F41G 1/38
10,260,841 B2 * 4/2019 Kincel ..... F41C 27/00
10,337,837 B2 * 7/2019 Keller ..... F41G 1/16
10,359,258 B2 7/2019 Geissele
10,495,417 B1 * 12/2019 Geissele ..... F41G 11/003
10,557,687 B2 * 2/2020 Teetzel ..... F41G 1/34
10,627,191 B1 * 4/2020 Fischer ..... F41G 11/008
10,627,192 B1 * 4/2020 Fischer ..... F41G 11/008
10,634,456 B1 * 4/2020 Fischer ..... F41G 11/003
10,670,374 B2 * 6/2020 Storch ..... F41C 27/00
D906,467 S * 12/2020 McCoy, II ..... G01C 9/28 D22/109
10,996,023 B2 * 5/2021 Roberts ..... F41C 27/00
11,060,815 B1 * 7/2021 Novak ..... F41C 27/00
11,067,365 B2 * 7/2021 Roberson ..... F41G 1/16
11,112,216 B1 * 9/2021 Fan ..... F41G 11/00
11,125,530 B2 * 9/2021 Kincel ..... F41C 23/16
11,199,378 B2 * 12/2021 LoRocco ..... F41G 1/545
11,237,379 B2 * 2/2022 McCoy, II ..... F41G 1/38
11,262,168 B1 * 3/2022 Morse ..... F41G 3/165
11,293,721 B2 * 4/2022 Ding ..... F41G 1/44
11,365,954 B2 * 6/2022 Gerber ..... F41G 11/003
11,385,026 B2 * 7/2022 Roberson ..... F41G 11/001
11,435,163 B2 * 9/2022 Roberson ..... F41G 11/003
11,946,724 B2 * 4/2024 Gerber ..... F41G 11/003
12,487,059 B2 * 12/2025 Gerber ..... F41G 11/003
2002/0162267 A1 * 11/2002 Nelson ..... F41G 1/35 42/120
2005/0229465 A1 * 10/2005 Dextraze ..... F41G 11/003 42/85
2006/0026888 A1 * 2/2006 Cheng ..... F41G 11/004 42/146
2007/0033852 A1 * 2/2007 Adams ..... F41G 11/001 42/124
2007/0039225 A1 * 2/2007 Kallio ..... F41G 1/35 42/146
2008/0148619 A1 * 6/2008 Rogers ..... F41G 11/003 42/90
2009/0044439 A1 * 2/2009 Phillips ..... F41C 23/16 42/72
2009/0225557 A1 * 9/2009 Griffin ..... F41G 1/35 362/382
2010/0058640 A1 * 3/2010 Moore ..... F41G 1/36 42/114
2010/0162610 A1 * 7/2010 Moore ..... F41G 11/001 42/117
2011/0308130 A1 * 12/2011 Holmberg ..... F41G 1/473 356/4.01
2011/0310476 A1 * 12/2011 Russ ..... G02B 23/18 359/407
2012/0060402 A1 * 3/2012 Dueck ..... F41G 1/02 42/137
2012/0110886 A1 * 5/2012 Moore ..... F41G 11/003 42/114
2012/0180370 A1 * 7/2012 McKinley ..... F41G 11/003 42/146
2013/0008072 A1 * 1/2013 Chung ..... F41G 1/30 42/113
2013/0036650 A1 * 2/2013 Larue ..... F41G 11/003 42/148
2013/0185985 A1 * 7/2013 Ballard ..... F41G 1/00 42/148
2013/0240733 A1 * 9/2013 Plotsker ..... G01J 5/04 42/111
2013/0288743 A1 * 10/2013 Hunt ..... F16M 11/2014 29/434
2013/0318852 A1 * 12/2013 Teetzel ..... F41C 27/00 42/90
2014/0041273 A1 * 2/2014 Masters ..... F41C 23/16 42/71.01
2014/0090286 A1 * 4/2014 Kupanoff ..... F41G 11/003 42/127
2014/0096429 A1 * 4/2014 Sandler ..... F41G 11/003 42/124
2014/0123532 A1 * 5/2014 Russ ..... F41G 1/38 42/113
2014/0150324 A1 * 6/2014 Keng ..... F41G 1/30 42/118
2014/0157644 A1 * 6/2014 Jiminez ..... F41G 11/003 42/114
2014/0190062 A1 * 7/2014 Turner, Jr. ..... F41G 11/003 42/124
2014/0196349 A1 * 7/2014 Rogers ..... F41G 1/35 42/90
2014/0230306 A1 * 8/2014 Arachequesne ..... F41G 1/387 42/119
2014/0259854 A1 * 9/2014 Williams ..... F41G 11/003 42/124
2014/0360077 A1 * 12/2014 Miller ..... F41C 27/00 42/84
2015/0205066 A1 * 7/2015 Gibson ..... G02B 7/04 29/428
2015/0285584 A1 * 10/2015 Mayberry ..... F41G 11/005 42/71.01
2015/0292837 A1 * 10/2015 Cheng ..... F41G 1/38 42/123
2016/0102941 A1 * 4/2016 Brucker ..... F41G 1/033 42/148
2016/0209176 A1 * 7/2016 Zimmer ..... F41G 11/001
2016/0259374 A1 * 9/2016 Breiwa ..... H01F 7/0247
2018/0073840 A1 * 3/2018 Kristoffersen ..... F41G 1/16
2018/0180386 A1 * 6/2018 Keller ..... F41G 1/065
2018/0195838 A1 * 7/2018 Storch ..... F41G 11/001
2018/0372448 A1 * 12/2018 Noskowicz ..... F41G 1/38
2019/0249958 A1 * 8/2019 Teetzel ..... F41G 3/12
2019/0277605 A1 * 9/2019 Geissele ..... F41G 11/003
2019/0368840 A1 * 12/2019 Banes ..... F41G 11/003
2020/0011642 A1 * 1/2020 Ma ..... F41G 11/004
2020/0025520 A1 * 1/2020 Niswander ..... F41G 11/003
2020/0025522 A1 * 1/2020 Zimmer ..... F41G 1/08
2020/0041890 A1 * 2/2020 Peel ..... G03B 17/566
2020/0064102 A1 * 2/2020 Galli ..... H05B 45/00
2020/0132414 A1 * 4/2020 Shelton ..... F41G 11/003
2020/0191232 A1 * 6/2020 Wagner ..... F16F 13/005
2020/0208946 A1 * 7/2020 Cahill ..... F41G 11/001
2020/0271422 A1 * 8/2020 Ramirez ..... F41G 11/003
2020/0272044 A1 * 8/2020 Walker ..... F41G 11/003
2021/0254923 A1 * 8/2021 Summers ..... F41B 5/1403
2021/0262766 A1 * 8/2021 Roberson ..... F41G 11/001
2021/0372736 A1 * 12/2021 Zhou ..... F41G 1/35
2021/0372739 A1 * 12/2021 Nielsen ..... F41G 11/003
2022/0049929 A1 * 2/2022 Chen ..... F41G 3/065
2022/0074709 A1 * 3/2022 Bellah ..... F41G 1/00

(56) References Cited

U.S. PATENT DOCUMENTS

| | | | | |
|---|---|---|---|---|
| 2022/0276024 | A1* | 9/2022 | Gerber | F41G 11/003 |
| 2024/0151527 | A1 | 5/2024 | Lauser et al. | |

OTHER PUBLICATIONS

Badger Ordnance, Condition One Modular Mount, [retrieved from Internet Nov. 7, 2024], https://www.badgerordnance.com/condition-one-coaxial-laser-integration-fixture-clif-long-700-21-21b.html.

Badger Ordnance, Condition One J-Arm 45º 1.70, [retrieved from Internet Nov. 7, 2024], https://www.badgerordnance.com/condition-one-j-arm-200-10-10b.html.

Badger Ordnance, Condition One Mounting System, [retrieved from Internet Nov. 7, 2024], https://www.badgerordnance.com/media/binaryanvil/slider/slider-1 1.jpg.

Badger Ordnance, Condition One 12 O'clock Top Optical Plate-Aimpoint Micro, [retrieved from Internet Nov. 7, 2024], https://www.badgerordnance.com/condition-one-12-o-clock-top-optical-plate-aimpoint-micro.html.

Badger Ordnance, Condition One Accessory Ring Cap (ARC) Max—Not Compatible With Standard C1, [retrieved from Internet Nov. 7, 2024], https://www.badgerordnance.com/condition-one-accessory-ring-cap-arc-max-not-compatible-with-standard-c1.html.

Badger Ordnance, Condition One 12 O'clock Top Optical Platform (12Top for ARC Only)—Picatinny, [retrieved from Internet Nov. 7, 2024], https://www.badgerordnance.com/condition-one-12-o-clock-top-optical-platform-12top-for-arc-only-picatinny.html.

Badger Ordnance, Condition One Coaxial Laser Integration Fixture (CLIF) Impact, [retrieved from Internet Nov. 7, 2024], https://www.badgerordnance.com/condition-one-coaxial-laser-integration-fixture-clif-impact.html.

Badger Ordnance, Condition One ARC Spacer, [retrieved from Internet Nov. 7, 2024], https://www.badgerordnance.com/condition-one-arc-riser-700-15-15b.html.

Burris, AR-P.E.P.R.™ Scope Mount, [retrieved from Internet Nov. 7, 2024], https://www.burrisoptics.com/mounting-systems/ar-pepr-scope-mount.

Geissele Automatics, Super Precision Scope Cap Mount, top pic, 30MM, Black [retrieved from Internet Nov. 7, 2024], https://geissele.com/super-precision-scope-cap-mount-top-pic-30mm-black.html.

Geissele Automatics, Super Precision Scope Cap Mount, angled pic, 30MM Black, [retrieved from Internet Nov. 7, 2024], https://geissele.com/super-precision-scope-cap-mount-angled-pic-30mm-black.html.

grovtec.com, PAR 45°—Picatinny Angled Rail 45 Degrees—GTSW321, [retrieved from Internet Nov. 7, 2024], https://grovtec.com/products/par-45-picatinny-angled-rail-45-degrees.

grovtec.com, Picatinny Swivel Mounts, [retrieved from Internet Nov. 7, 2024], https://grovtec.com/products/picatinny-mounted-heavy-duty-push-button-base?pr_prod_strat=e5_desc&pr_rec_id=a696a137b&pr_rec_pid=11438583508&pr_ref_pid=4955048640583&pr_seq=uniform.

* cited by examiner

MODULAR SCOPE MOUNTS AND ACCESSORY MOUNTS

TECHNICAL FIELD

The present disclosure relates to various mounts for a firearm and/or firearm scope and associated accessories configured to engage the various mounts.

BACKGROUND

Firearms may be assembled with a number of components, including accessories, coupled thereto to perform a variety of functions. For example, firearms may use components, such as attachable accessories (e.g., optical sights, such as a scope, levels, flashlights, other optical sights, backup sights, lasers, etc.), to improve performance of the weapon, such as through improving the user's shooting accuracy by allowing more precise and accurate targeting, and such accessories may have additional components (e.g., levels, lasers, or other components) mounted thereto. Through applied effort, ingenuity, and innovation, Applicant has solved problems relating to the aforementioned technologies by developing solutions embodied in the present disclosure, which are described in detail below.

BRIEF SUMMARY

In general, embodiments of the present disclosure provided herein include systems, methods, and apparatuses related to various mounts for a firearm and/or firearm scope and associated accessories configured to engage the various mounts.

A scope mount cap for attaching one or more accessories to a scope mount for a firearm may be provided. The scope mount cap may include a lower surface configured to engage a scope; a single lateral groove, the single lateral groove being open on a top side and on both lateral ends of the single lateral groove; and a recess on each lateral side of the scope mount cap defined at each of the respective lateral ends of the single lateral groove. The single lateral groove may be laterally shorter at a bottom side opposite the top side than at the top side.

In some embodiments, a bottom side of the single lateral groove defines the shortest lateral portion of the single lateral groove. The recesses on each lateral side of the scope mount may each define longitudinal fore and aft ends each configured to constrain longitudinal motion of the one or more accessories. A lateral width of the scope mount cap spanning fore ends of the recesses and a second lateral width of the scope mount cap spanning aft ends of the recesses may, in some embodiments, each be greater than a third lateral width of the scope mount cap at a bottom side of the single lateral groove within the recesses.

In some embodiments, each recess is defined by a plurality of inwardly angled surfaces. The plurality of inwardly angled surfaces may include a downwardly angled surface, an upwardly angled surface, at least one at least partially aftwardly angled surface, and at least one at least partially forwardly angled surface. In some embodiments, each of the downwardly angled surface, the upwardly angled surface, the at least one at least partially aftwardly angled surface, and the at least one at least partially forwardly angled surface may be angled towards a center of each respective recess. Each recess may define a midline extending longitudinally and intersecting a bottom side of the single lateral groove, wherein the recess on either side of the midline slopes toward the midline.

In some embodiments, a cross-sectional area of each recess decreases towards a lateral center of the scope mount cap. The scope mount may further define a leading surface and a trailing surface at opposite longitudinal sides of the single lateral groove. The leading surface and trailing surface may each be angled relative to a vertical direction, such that a first distance between an upper edge of the leading surface and an upper edge of the trailing surface is less than a second distance between a lower edge of the leading surface and a lower edge of the trailing surface.

Various embodiments may include a scope mount for a firearm. The scope mount may include a body configured to attach to an upper receiver of the firearm, the body defining a first lower scope mount portion and a second lower scope mount portion longitudinally spaced from the first lower scope mount portion. The scope mount may further include a first scope mount cap for attaching one or more accessories to the scope mount. The first scope mount cap may define a first curved lower surface configured to engage a scope; a first single lateral groove, the first single lateral groove being open on a top side and on both lateral ends of the first single lateral groove; and a first recess on each lateral side of the first scope mount cap defined at each of the respective lateral ends of the first single lateral groove. The first single lateral groove may be laterally shorter at a bottom side of the first single lateral groove opposite the top side of the first single lateral groove than at the top side of the first single lateral groove. The scope mount may further include a second scope mount cap for attaching one or more accessories to the scope mount. The second scope mount cap may include a second curved lower surface configured to engage a scope; a second single lateral groove, the second single lateral groove being open on a top side and on both lateral ends of the second single lateral groove; and a second recess on each lateral side of the second scope mount cap defined at each of the respective lateral ends of the second single lateral groove. The second single lateral groove may be laterally shorter at a bottom side of the second single lateral groove opposite the top side of the second single lateral groove than at the top side of the second single lateral groove.

Some embodiments may include an assembly including a scope mount cap for attaching one or more accessories to a scope mount for a firearm. The scope mount cap may include a lower surface configured to engage a scope; a single lateral groove, the single lateral groove being open on a top side and on both lateral ends of the single lateral groove; and a recess on each lateral side of the scope mount cap defined at each of the respective lateral ends of the single lateral groove. The single lateral groove may be laterally shorter at a bottom side opposite the top side than at the top side. The scope mount cap may further include an accessory mount configured to engage the scope mount cap. The accessory mount may include a first clamp member configured to engage a first recess of the recesses of the scope mount cap and a second clamp member configured to engage a second recess of the recesses of the scope mount cap.

The first clamp member may be fixed to a body of the accessory mount and the second clamp member may be movable relative to the body of the accessory mount. The accessory mount may further include a threaded screw configured to engage the second clamp member to move the second clamp member relative to the body of the accessory mount. The threaded screw may be configured to be at least partially inserted in the single lateral groove of the scope mount cap between the first recess and the second recess.

In some embodiments, the scope mount cap further defines a leading surface and a trailing surface at opposite longitudinal sides of the single lateral groove. The leading surface and trailing surface may each be angled relative to a vertical direction, such that a first distance between an upper edge of the leading surface and an upper edge of the trailing surface is less than a second distance between a lower edge of the leading surface and a lower edge of the trailing surface. The accessory mount may define a leading mating surface and a trailing mating surface. The leading mating surface may be configured to engage the leading surface of the scope mount cap, and the trailing mating surface may be configured to engage the trailing surface of the scope mount cap.

In some embodiments, the single lateral groove may be longer in a lateral direction at a top side of the single lateral groove than at a bottom side of the single lateral groove, such that a top surface of the scope mount cap corresponding to the top side of the single lateral groove is wider in the lateral direction than a second width of the scope mount cap corresponding to the bottom side of the single lateral groove wherein the first recess and the second recess are configured to retain the accessory mount at least partially via the wider top surface of the scope mount cap.

The first recess and the second recess may each define longitudinal fore and aft ends each configured to constrain longitudinal motion of the one or more accessories. The first recess and the second recess may each define a midline extending longitudinally and intersecting a bottom side of the single lateral groove; and for each of the first recess and the second recess, either side of the midline may slope toward the midline.

Various embodiments may include a firearm comprising the assembly and an upper receiver configured to engage the assembly.

Some other embodiments may include a scope mount for a firearm. The scope mount may include a body configured to attach to an upper receiver of the firearm. The body may include a lower scope mount portion; and a scope mount cap configured to engage the lower scope mount portion of the body, at least a portion of the scope mount cap and at least a portion of the lower scope mount portion of the body collectively defining a passage configured to receive a scope therethrough along a longitudinal direction of the body. The body may define at least one lateral accessory mount point comprising an opening extending in a lateral direction perpendicular to the longitudinal direction, the opening defined at a height below a height of the passage.

In some embodiments, the body defines threading in the opening configured to receive a threaded fastener therein. The opening may be defined at a longitudinal position corresponding to the passage.

The at least one lateral accessory mount point may include at least two lateral accessory mount points, including a first lateral accessory mount point and a second lateral accessory mount point laterally opposite the body relative to the first lateral accessory mount point. The opening may extend entirely through the body from the first lateral accessory mount point to the second lateral accessory mount point, such that each of the first lateral accessory mount point and the second lateral accessory mount point comprises the opening. The first lateral accessory mount point and the second lateral accessory mount point may be identically shaped.

In some embodiments, the body further defines a second lower scope mount portion longitudinally spaced from the lower scope mount portion. The scope mount may include a second scope mount cap configured to engage the second lower scope mount portion of the body. At least a portion of the second scope mount cap and at least a portion of the second lower scope mount portion of the body may collectively define a second passage axially aligned with the passage and configured to receive the scope therethrough along the longitudinal direction of the body. The at least one lateral accessory mount point may include at least two lateral accessory mount points, including a first lateral accessory mount point defining the opening and a second lateral accessory mount point defining a second opening extending in the lateral direction perpendicular to the longitudinal direction. The second opening may be defined at a second height below the height of the second passage. The second height may be the same as the height. The opening may be defined at a longitudinal position corresponding to the passage, and the second opening may be defined at a second longitudinal position corresponding to the second passage. In some embodiments, the at least one lateral accessory mount point may include at least four lateral accessory mount points including the first lateral accessory mount point, the second lateral accessory mount point, a third lateral accessory mount point, and a fourth lateral accessory mount point. The first lateral accessory mount point and the third lateral accessory mount point may be defined at a same longitudinal position. The second lateral accessory mount point and the fourth lateral accessory mount point may be at a second same longitudinal position. In some embodiments, the same longitudinal position corresponds to a longitudinal position of the passage. The first lateral accessory mount point may be disposed laterally opposite the body relative to the third lateral accessory mount point, and the second opening may be defined at a second longitudinal position corresponding to the second passage. The second lateral accessory mount point may be disposed laterally opposite the body relative to the fourth lateral accessory mount point.

The at least one lateral accessory mount point may include a first lateral accessory mount point, the first lateral accessory mount point may include a recess formed in a lateral side of the body, and the recess may be configured to receive an accessory mount therein. The recess of the first lateral accessory mount point may define inwardly tapered upper and lower walls. In some embodiments, the recess of the first lateral accessory mount point may define a longitudinally extending groove in the lateral side of the body having open fore and aft ends.

Various embodiments may include a firearm. The firearm may include an upper receiver; and a scope mount for a firearm. The scope mount may include a body configured to attach to an upper receiver of the firearm, the body defining a lower scope mount portion; and a scope mount cap configured to engage the lower scope mount portion of the body, at least a portion of the scope mount cap and at least a portion of the lower scope mount portion of the body collectively defining a passage configured to receive a scope therethrough along a longitudinal direction of the body. The body may define at least one lateral accessory mount point comprising an opening extending in a lateral direction perpendicular to the longitudinal direction, the opening may be defined at a height below a height of the passage. The scope mount may be configured to engage the upper receiver.

In some embodiments, the body defines threading in the opening configured to receive a threaded fastener therein. The opening may be defined at a longitudinal position corresponding to the passage.

The at least one lateral accessory mount point may include at least two lateral accessory mount points, including a first lateral accessory mount point and a second lateral accessory mount point laterally opposite the body relative to the first lateral accessory mount point. The opening may extend entirely through the body from the first lateral accessory mount point to the second lateral accessory mount point, such that each of the first lateral accessory mount point and the second lateral accessory mount point comprises the opening. The first lateral accessory mount point and the second lateral accessory mount point may be identically shaped.

The body may further define a second lower scope mount portion longitudinally spaced from the lower scope mount portion. The scope mount may further include a second scope mount cap configured to engage the second lower scope mount portion of the body, at least a portion of the second scope mount cap and at least a portion of the second lower scope mount portion of the body collectively defining a second passage axially aligned with the passage and configured to receive the scope therethrough along the longitudinal direction of the body. The at least one lateral accessory mount point may include at least two lateral accessory mount points, including a first lateral accessory mount point defining the opening and a second lateral accessory mount point defining a second opening extending in the lateral direction perpendicular to the longitudinal direction, the second opening defined at a second height below the height of the second passage.

The above summary is provided merely for purposes of summarizing some example embodiments to provide a basic understanding of some aspects of the present disclosure. Accordingly, it will be appreciated that the above-described embodiments are merely examples and should not be construed to narrow the scope or spirit of the present disclosure in any way. It will be appreciated that the scope of the present disclosure encompasses many potential embodiments in addition to those here summarized, some of which will be further described below. Other features, aspects, and advantages of the subject matter will become apparent from the description, the drawings, and the claims.

BRIEF DESCRIPTION OF THE DRAWINGS

Figure 1:
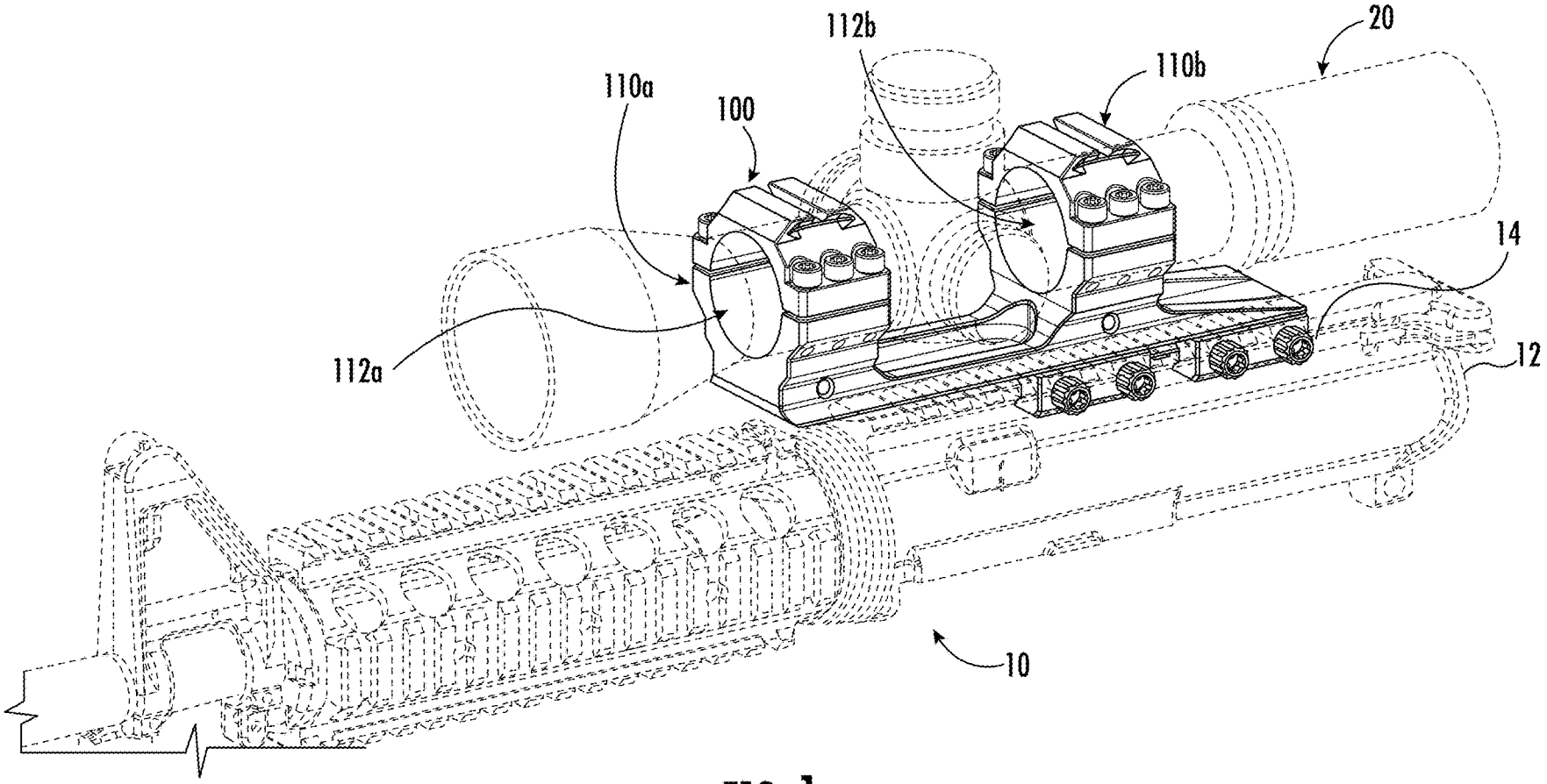

Having thus described certain example embodiments of the present disclosure in general terms above, non-limiting and non-exhaustive embodiments of the subject disclosure are described with reference to the following figures, which are not necessarily drawn to scale and wherein like reference numerals refer to like parts throughout the various views unless otherwise specified. The components illustrated in the figures may or may not be present in certain embodiments described herein. Some embodiments may include fewer (or more) components than those shown in the figures.

Figure 6:
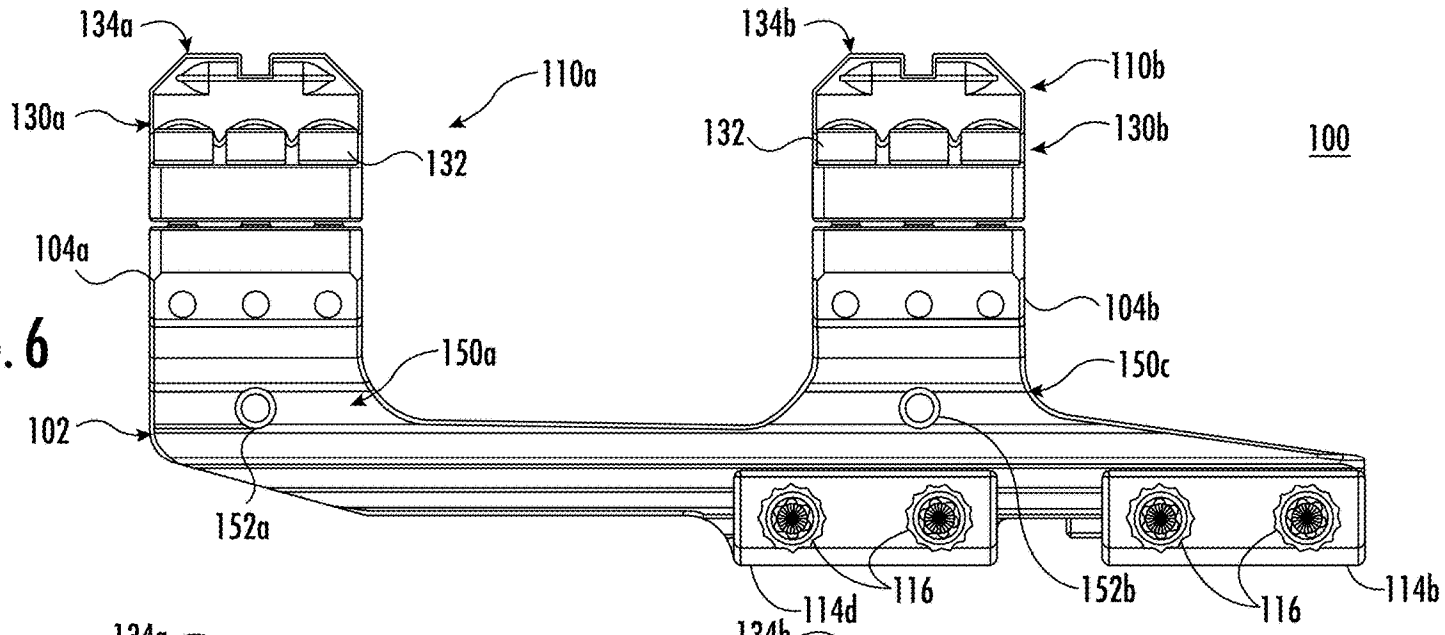
Figure 7:
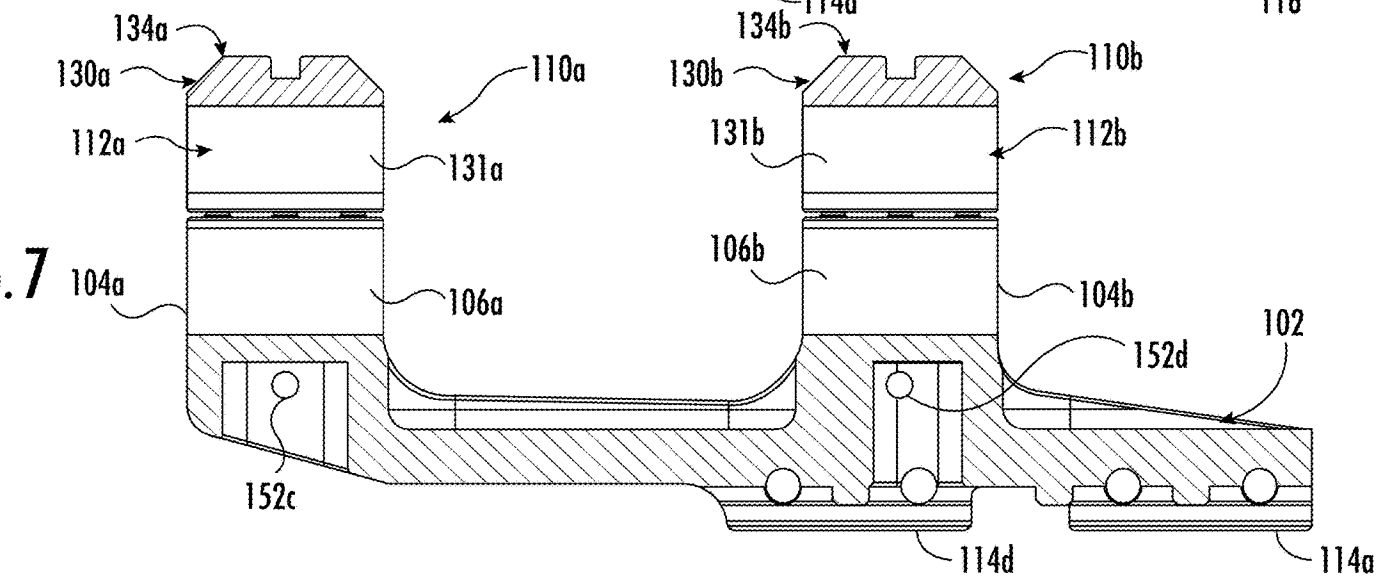
Figure 8:
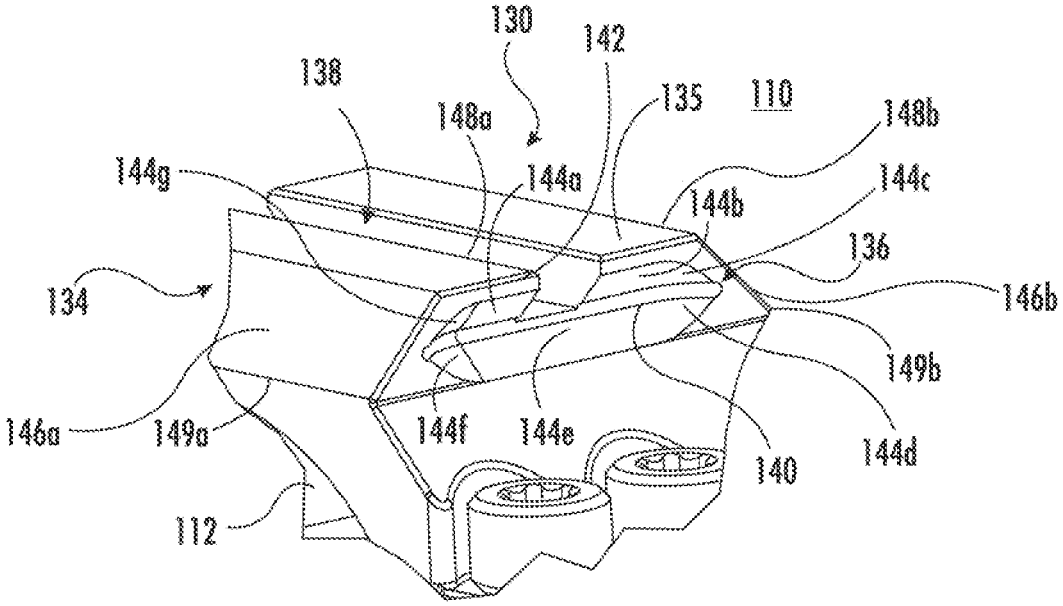
Figure 9:
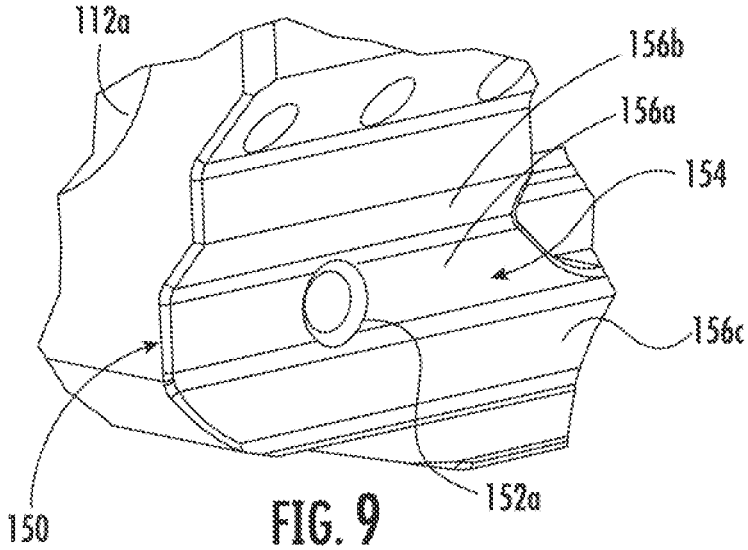
Figure 10:
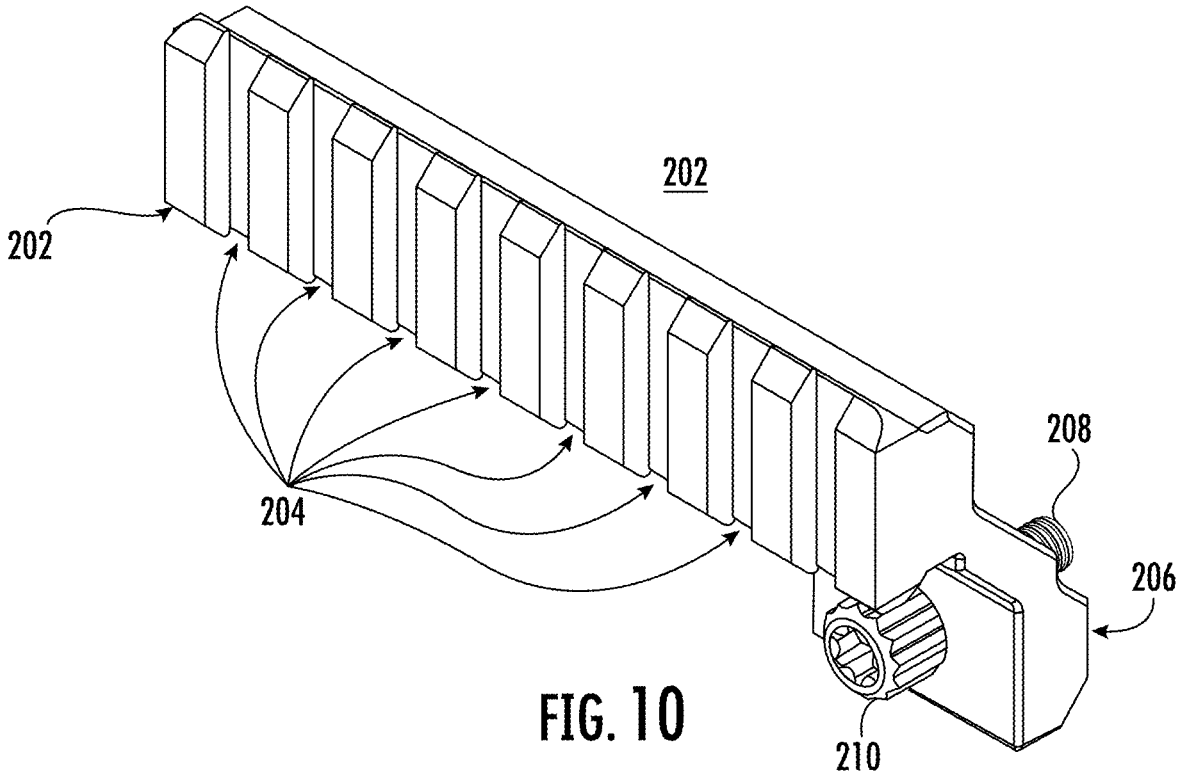
Figure 11:
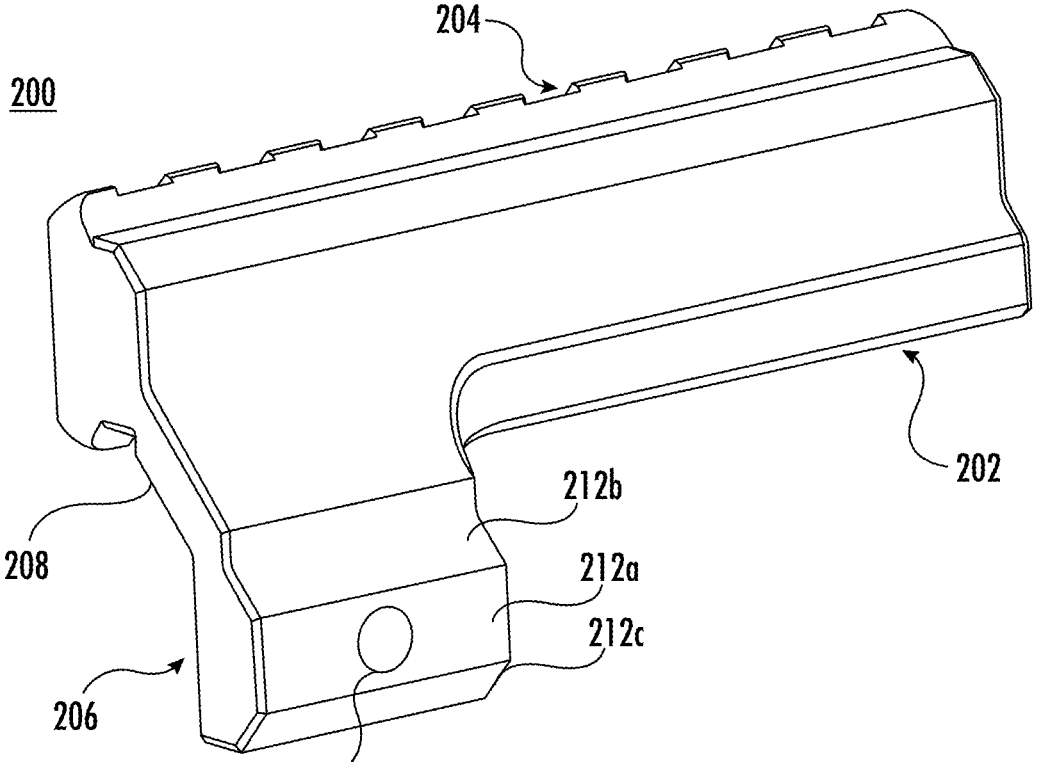
Figure 12:
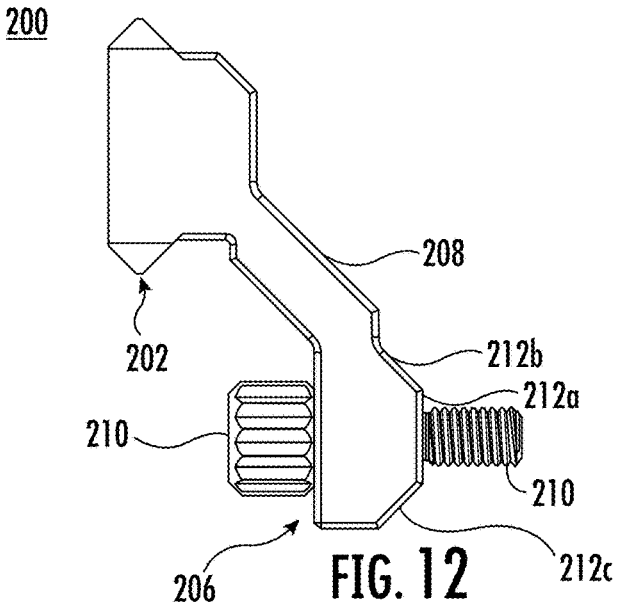
Figure 13:
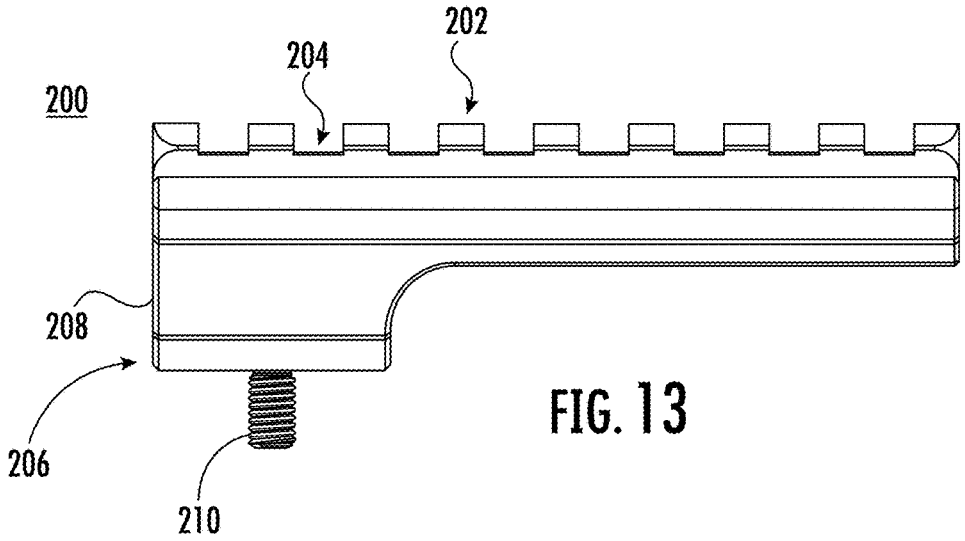
Figure 14:
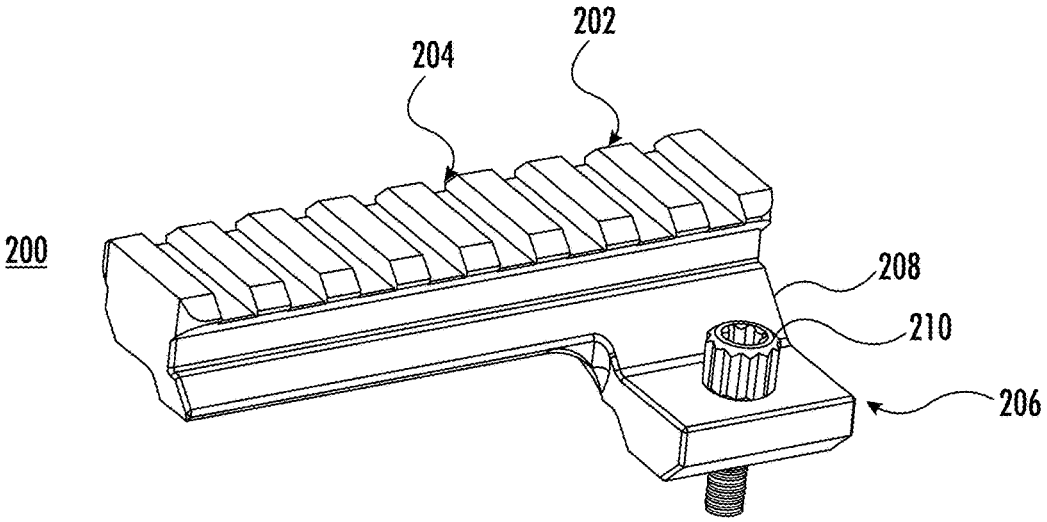
Figure 15:
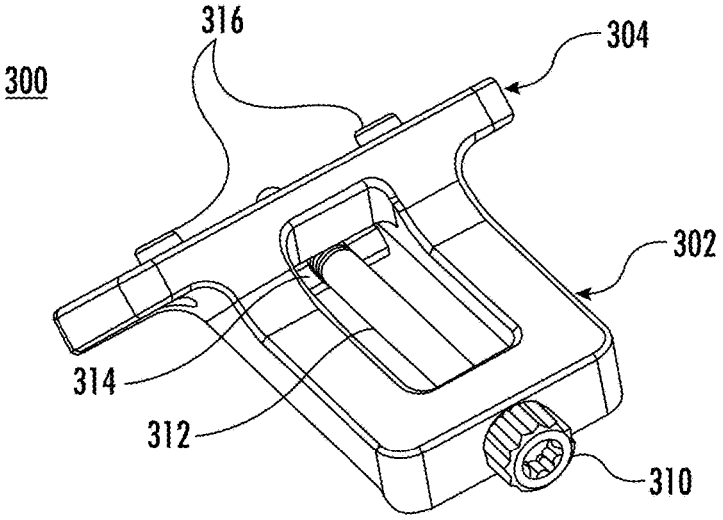
Figure 16:
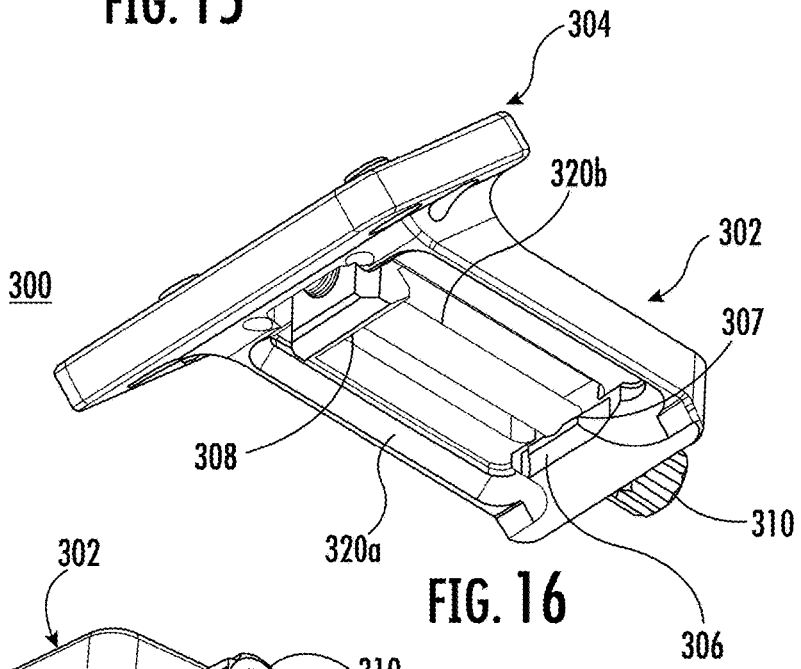
Figure 17:
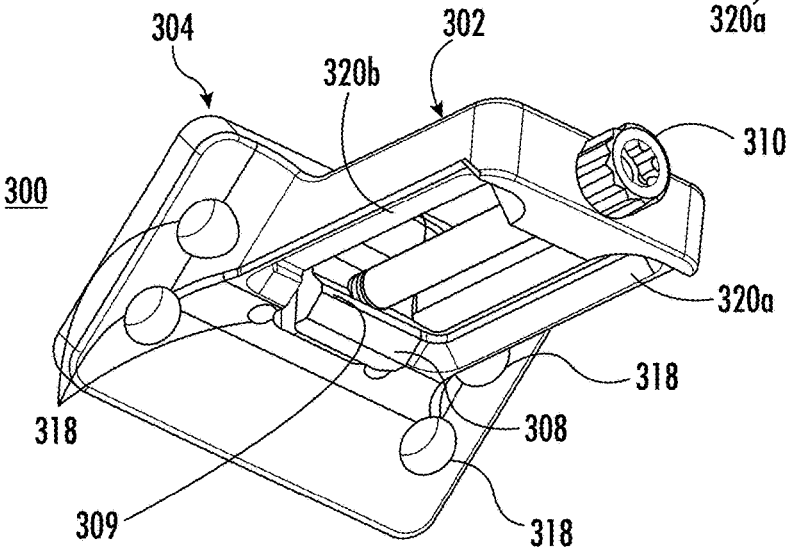
Figure 18:
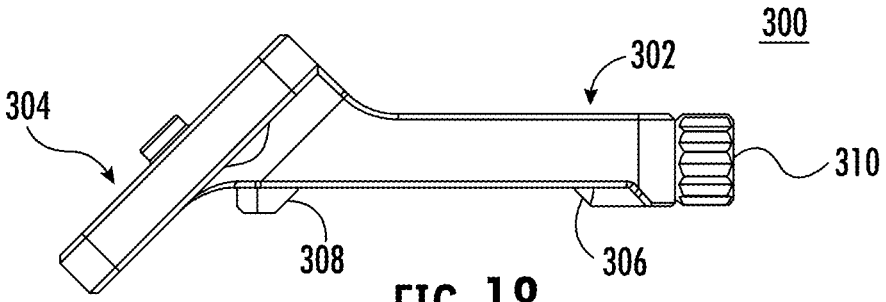
Figure 19:
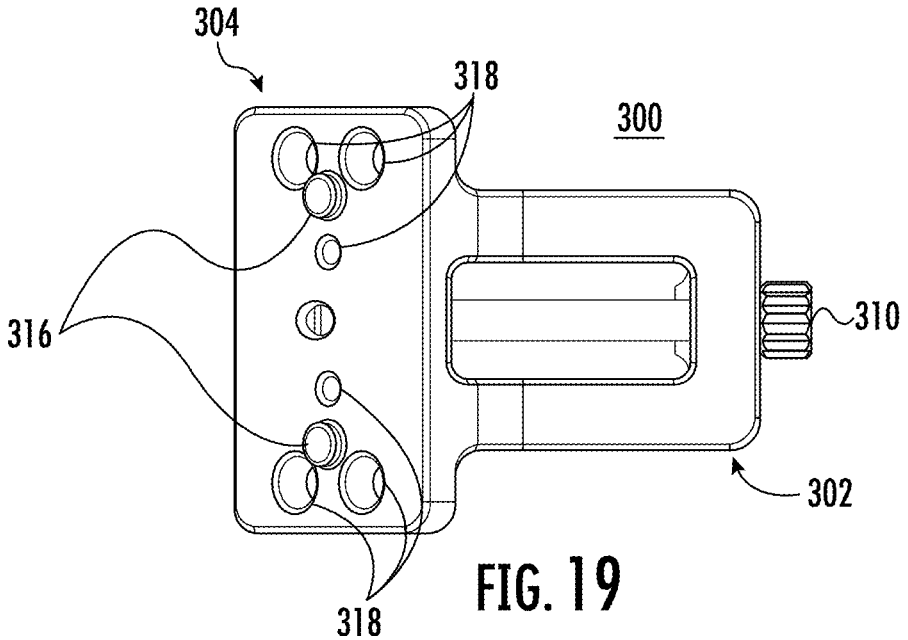
Figure 20:
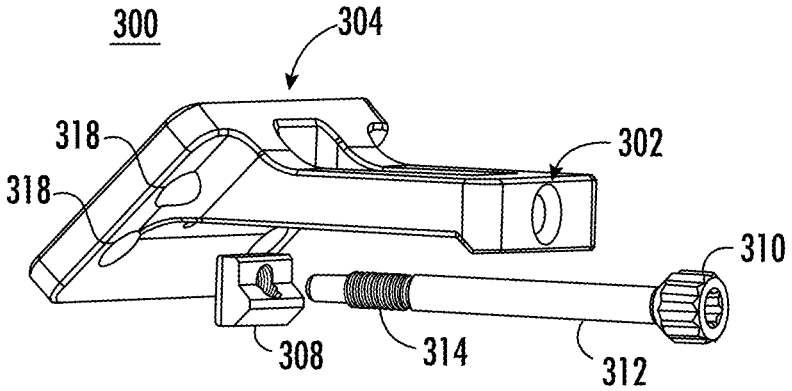
Figure 21:
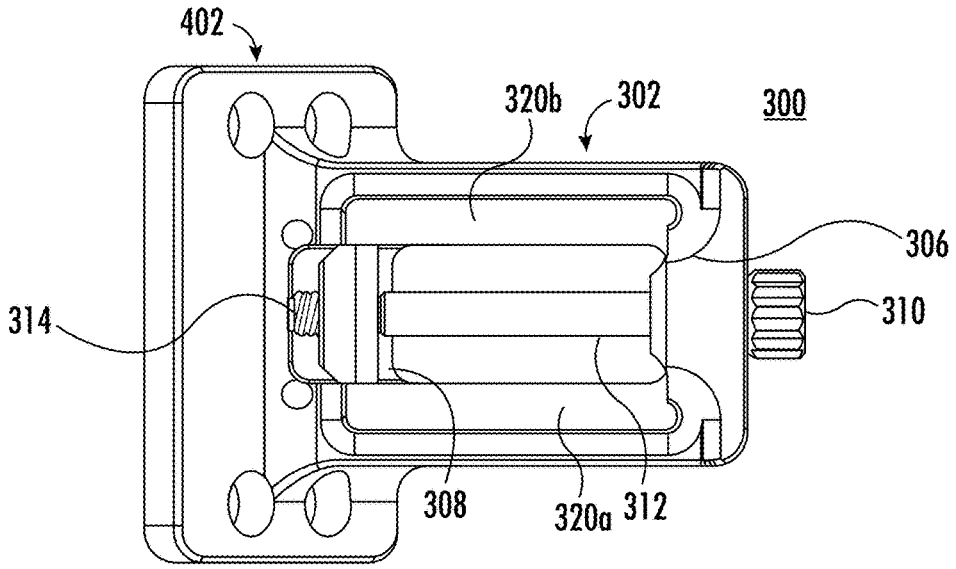
Figure 22:
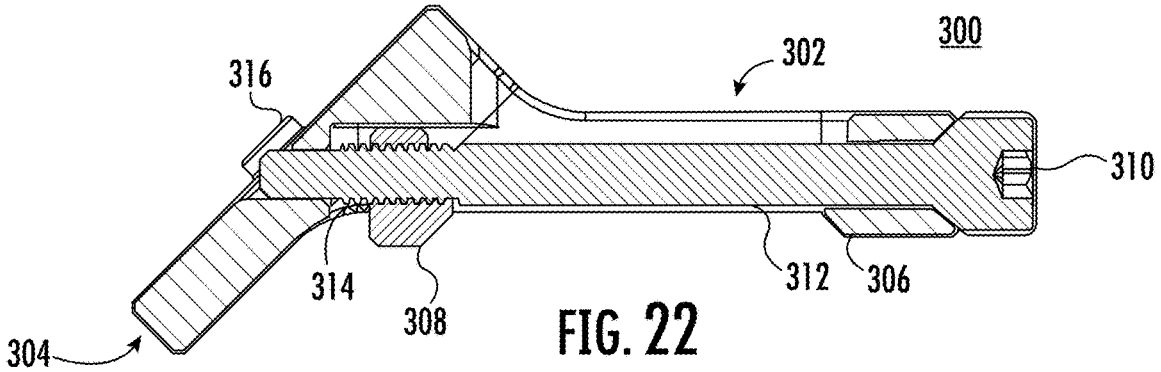
Figure 23:
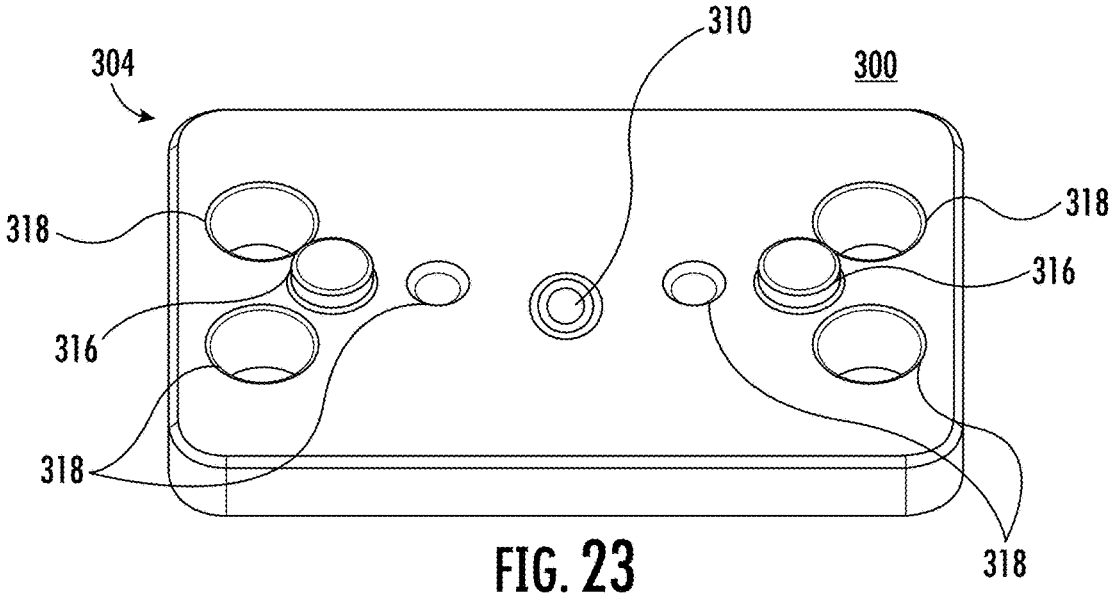
Figure 24:
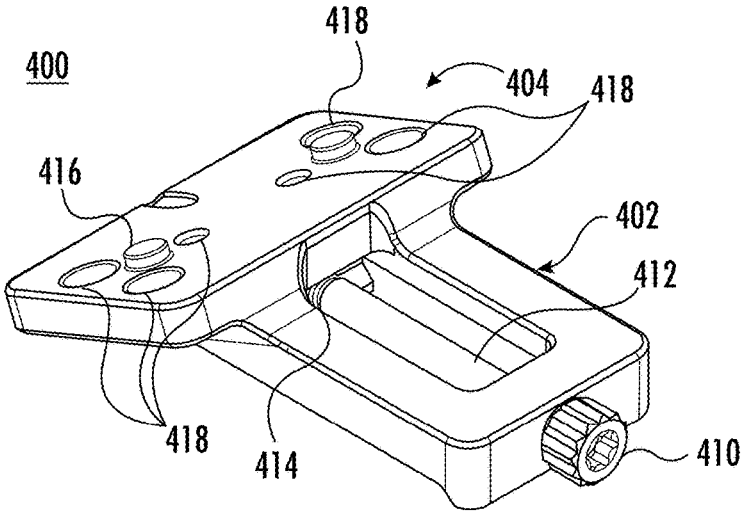
Figure 25:
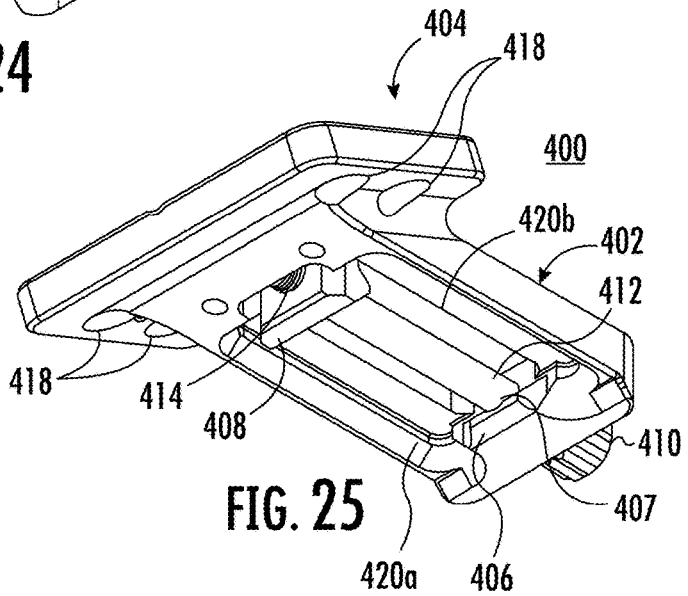
Figure 26:
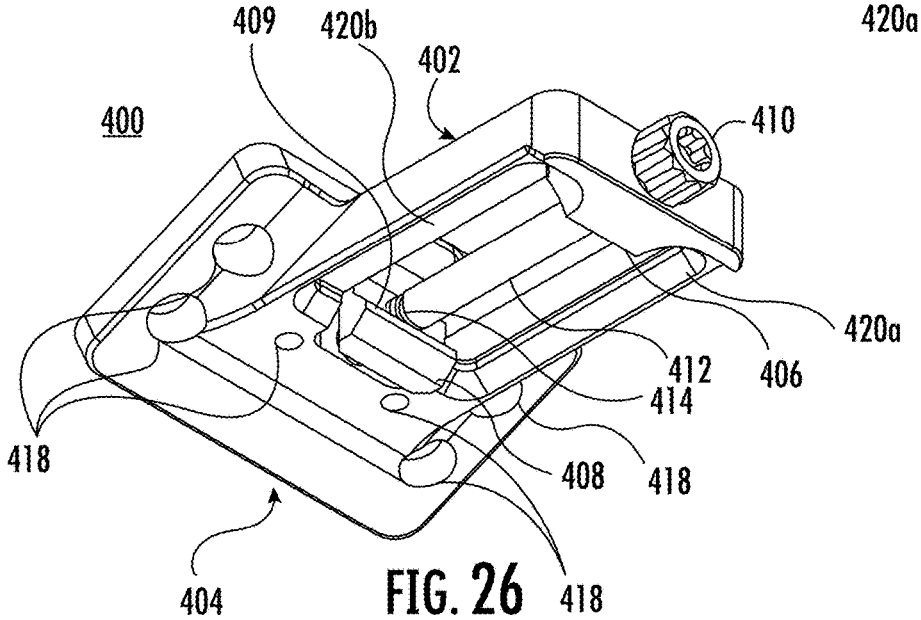
Figure 27:
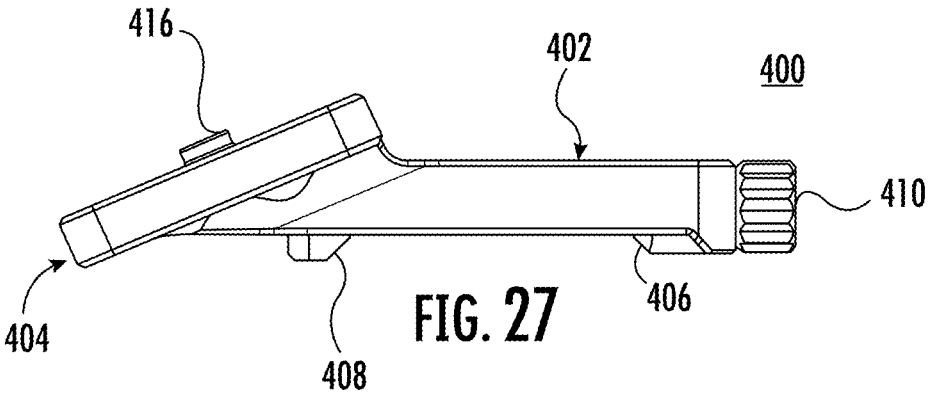
Figure 28:
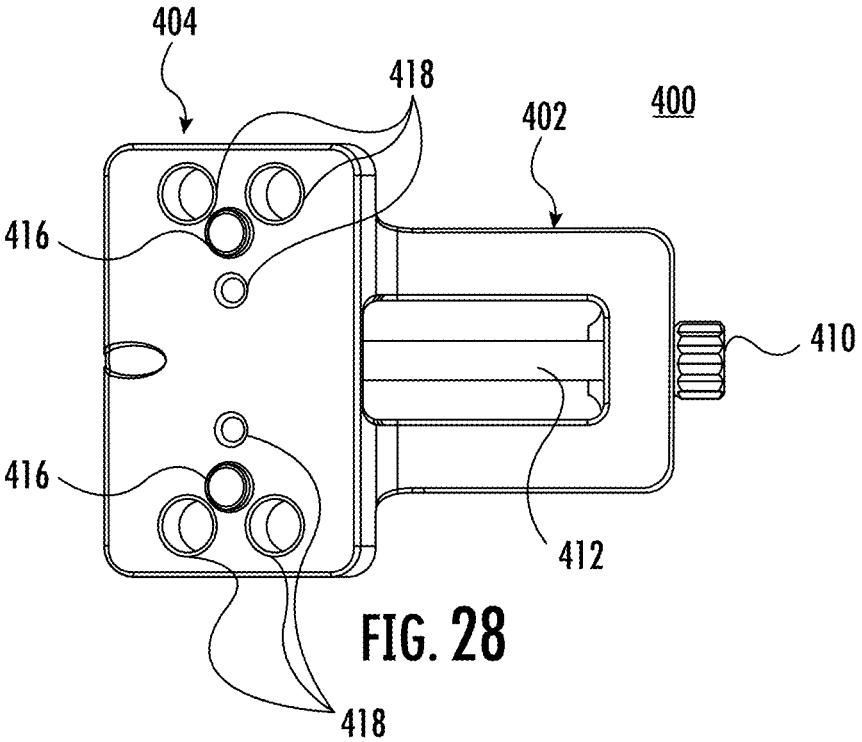
Figure 29:
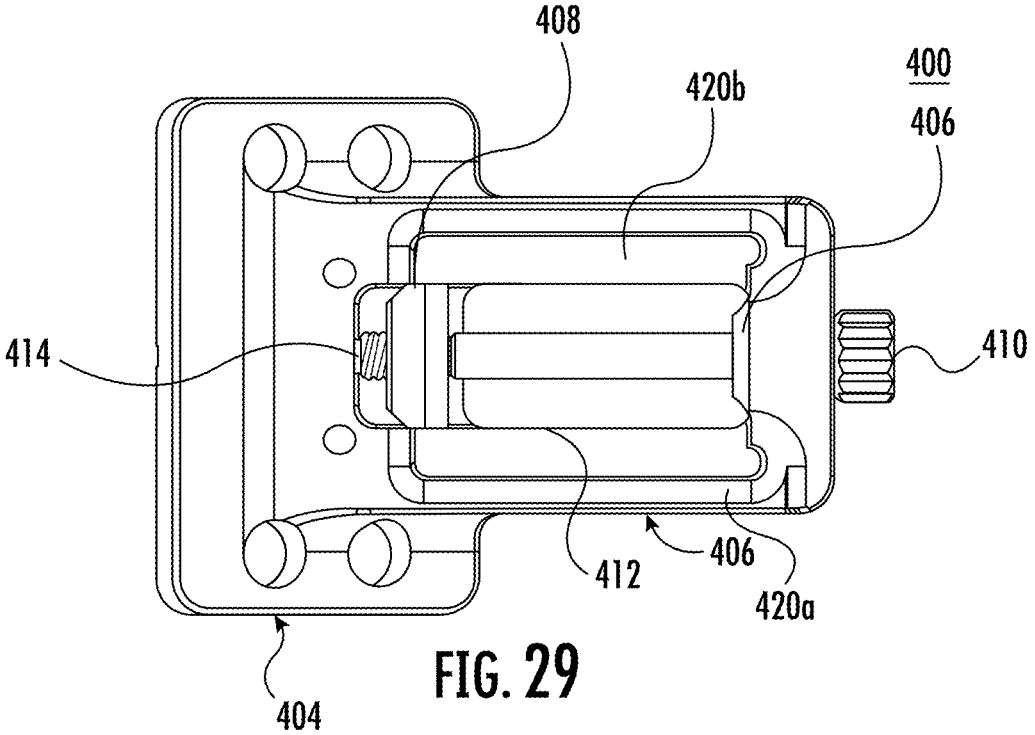
Figure 30:
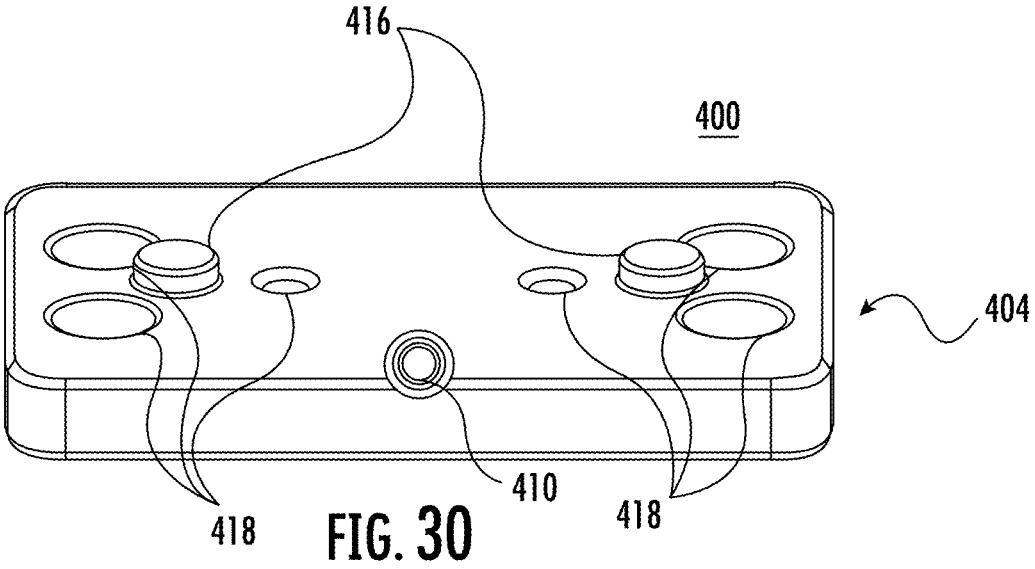
Figure 31:
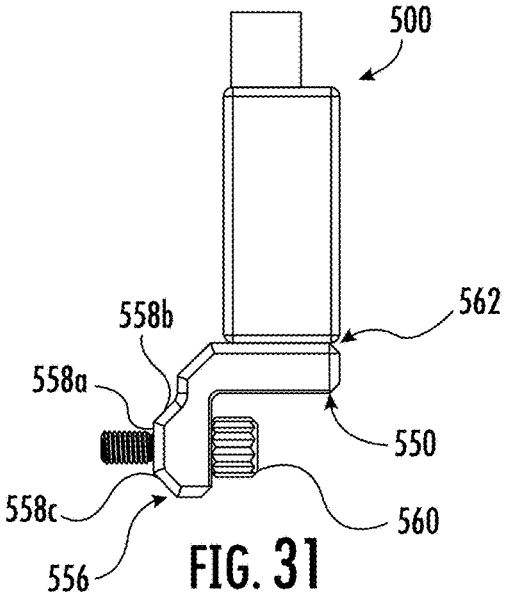
Figure 32:
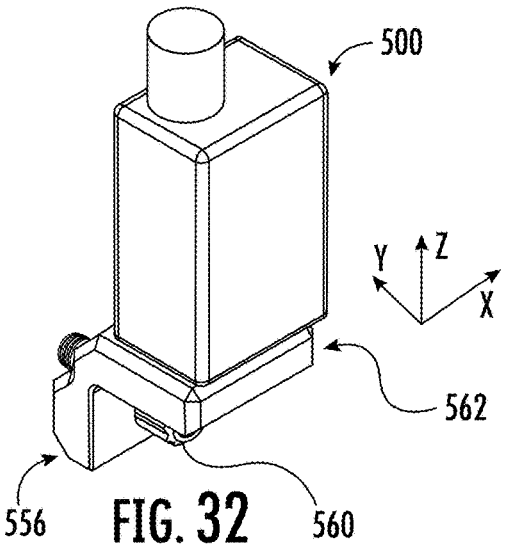
Figure 33:
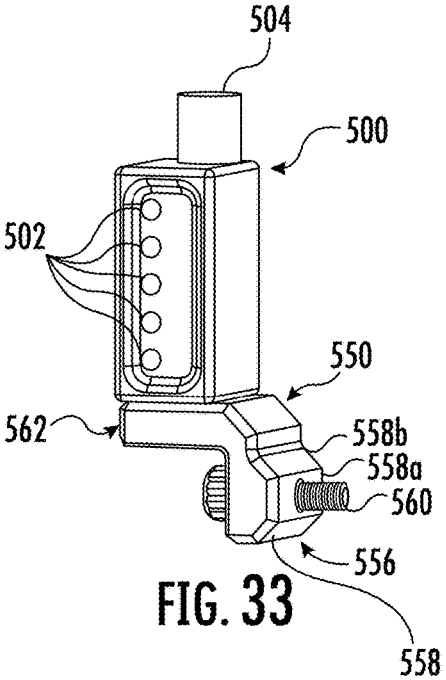
Figure 34:
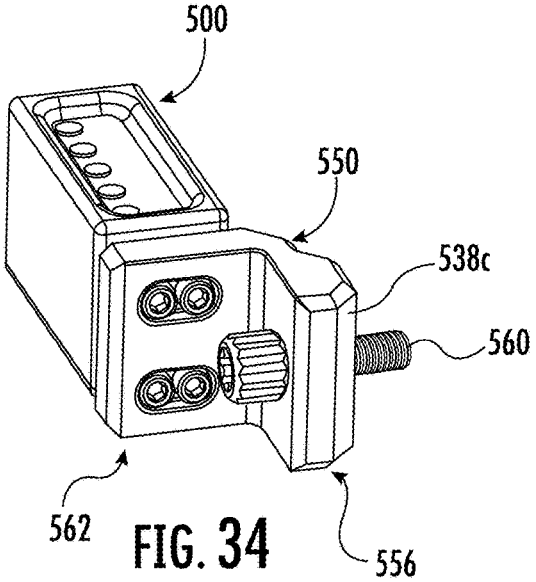
Figure 35:
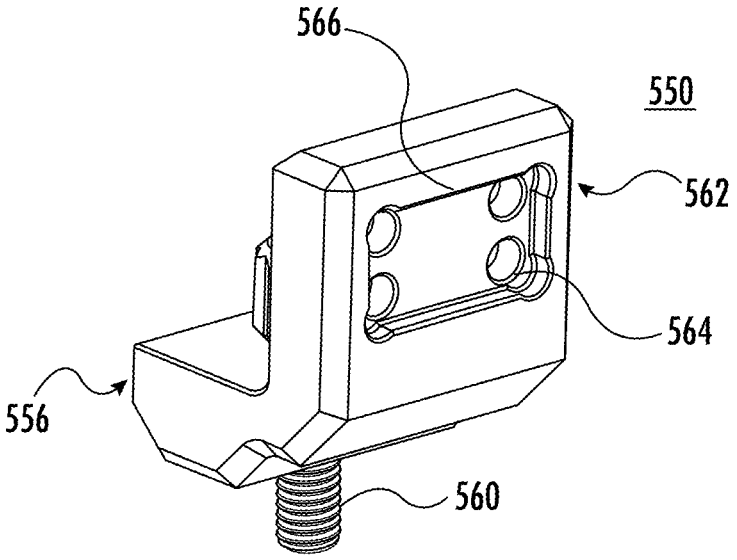
Figure 36:
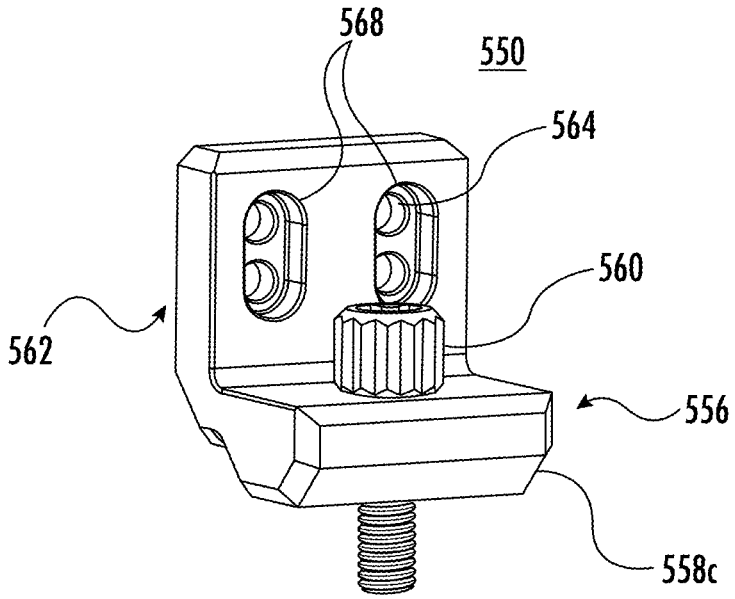
Figure 37:
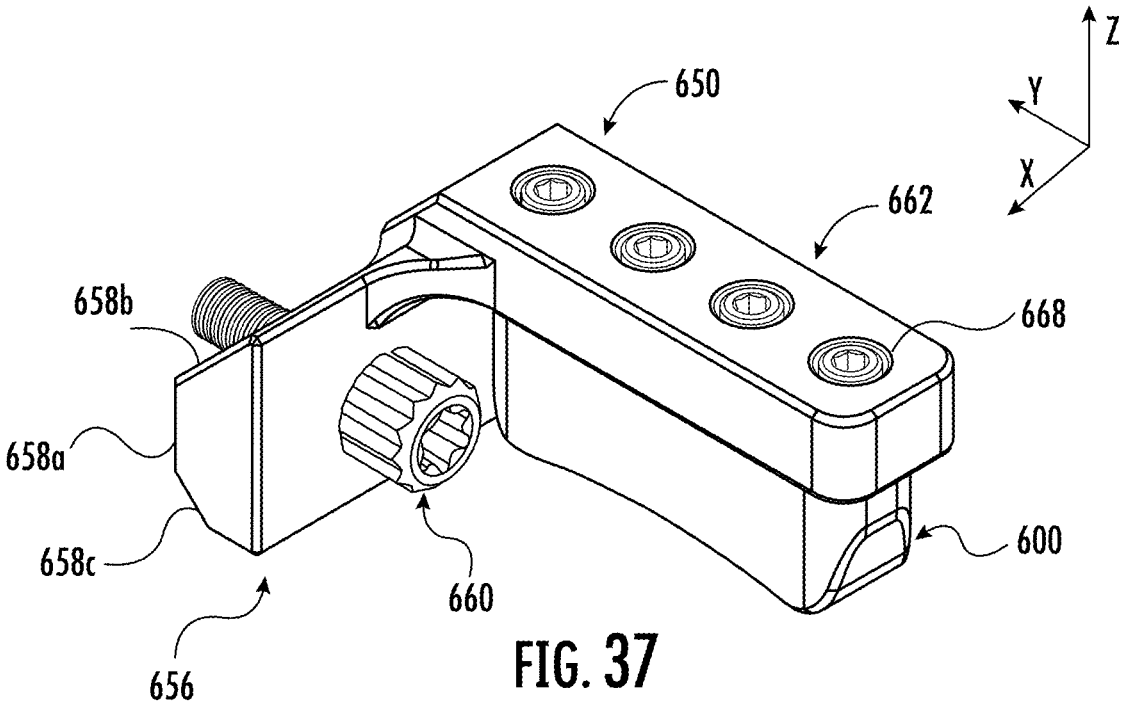
Figure 38:
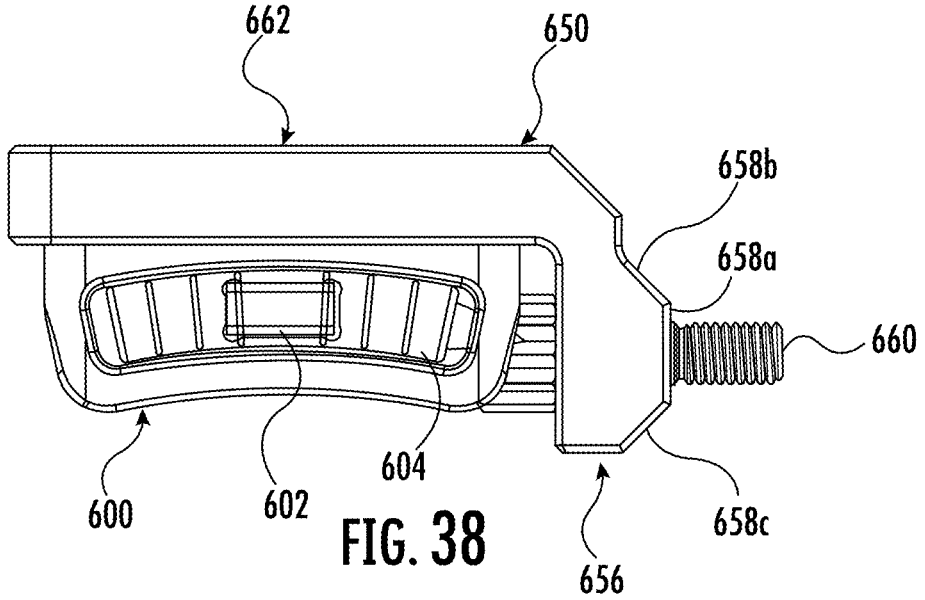
Figure 39:
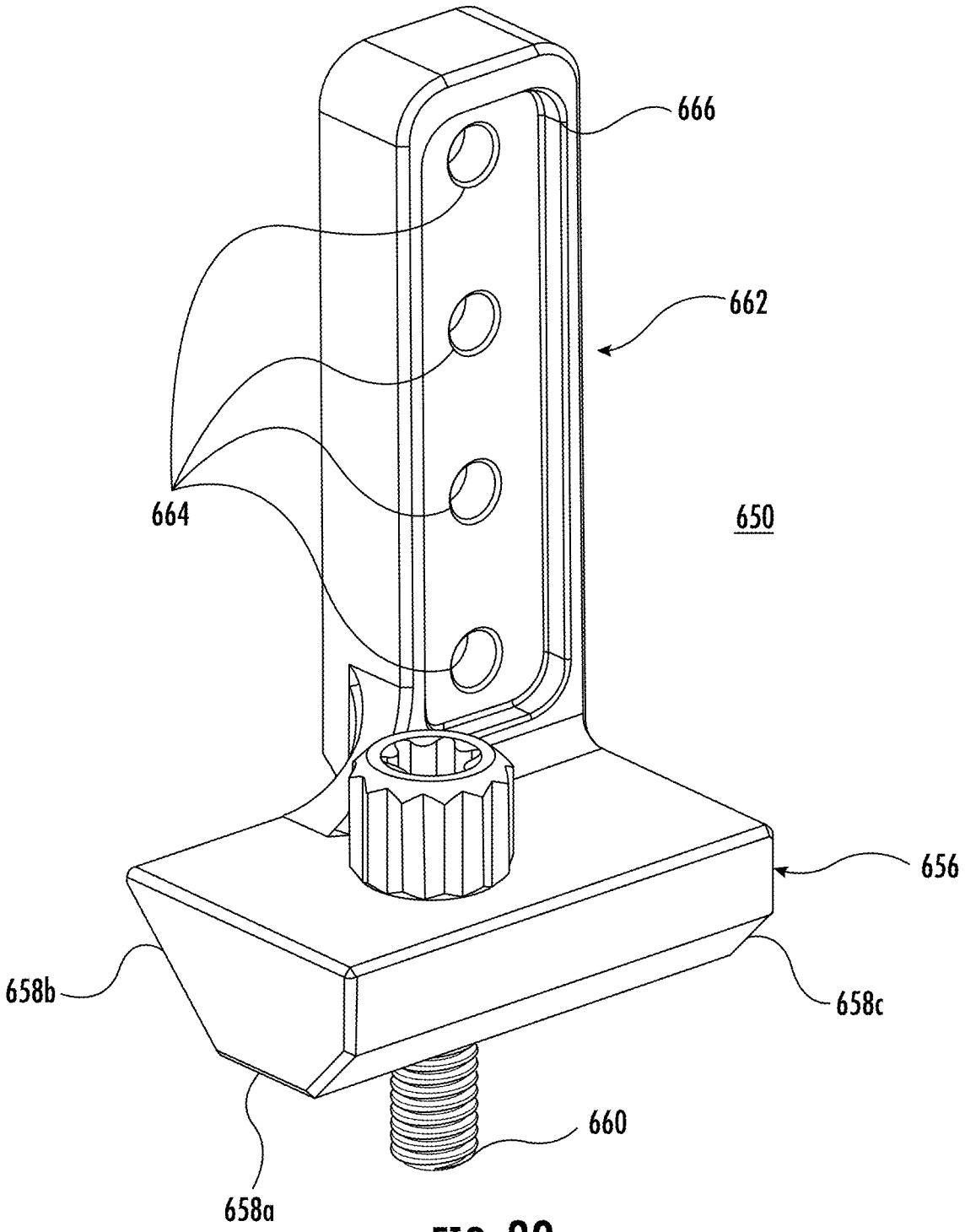
Figure 40:
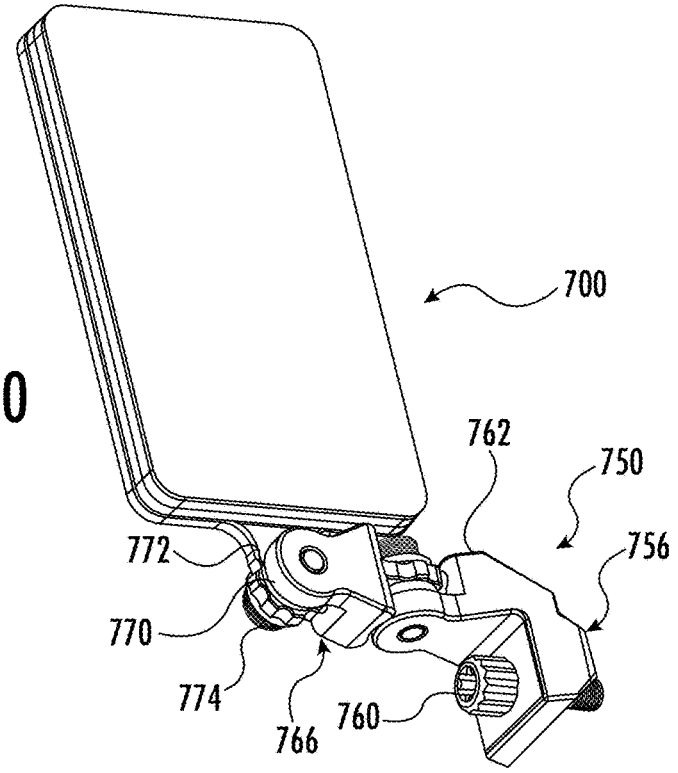
Figure 41:
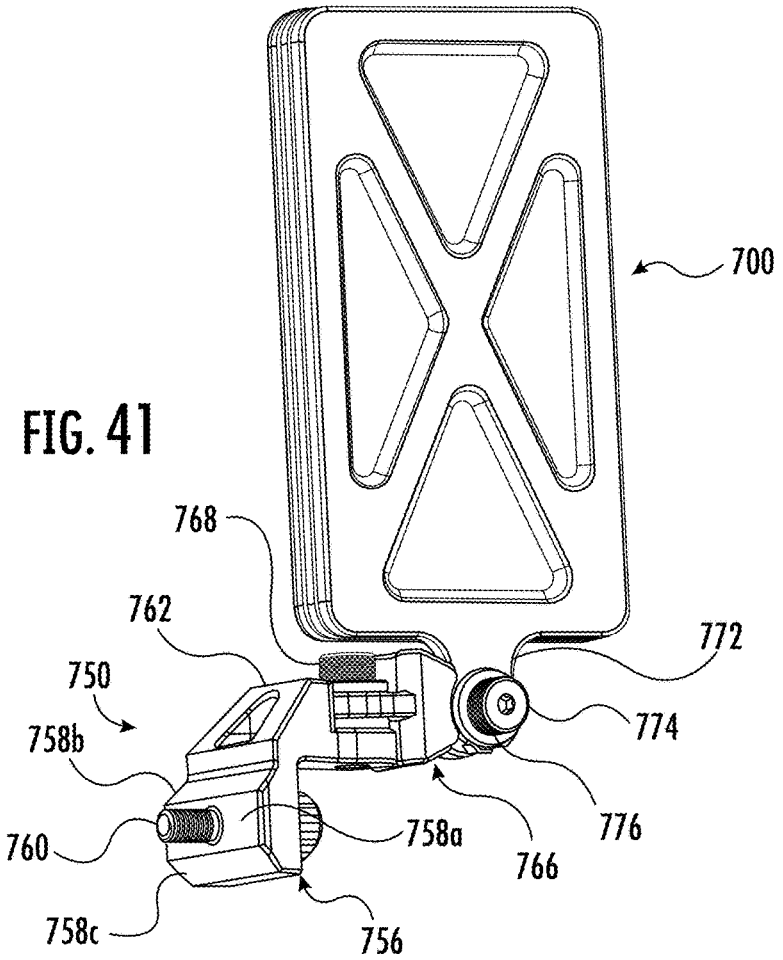
Figure 42:
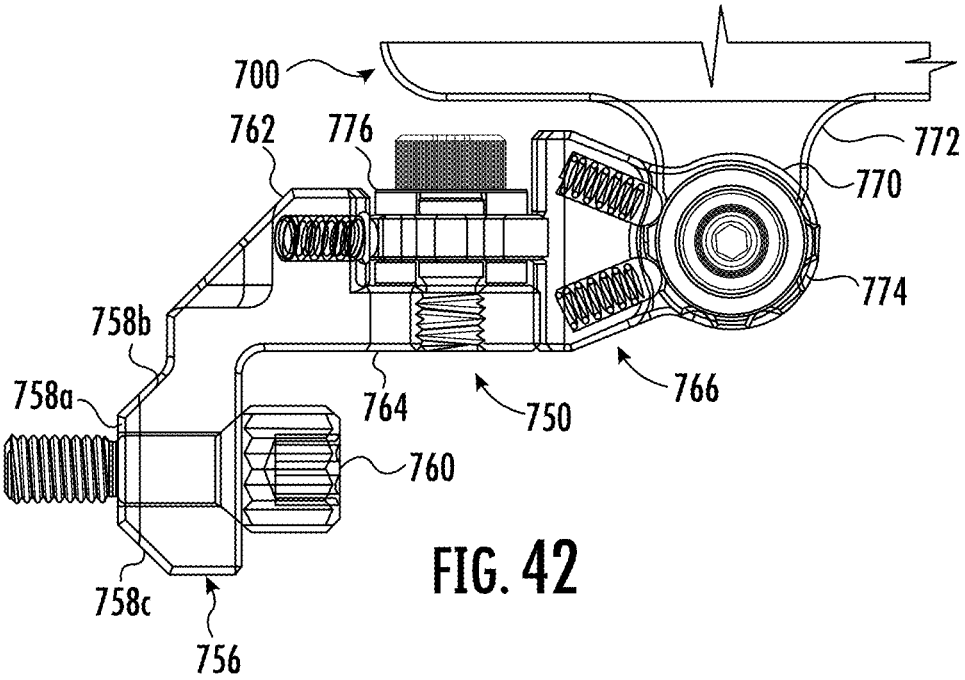
Figure 44:
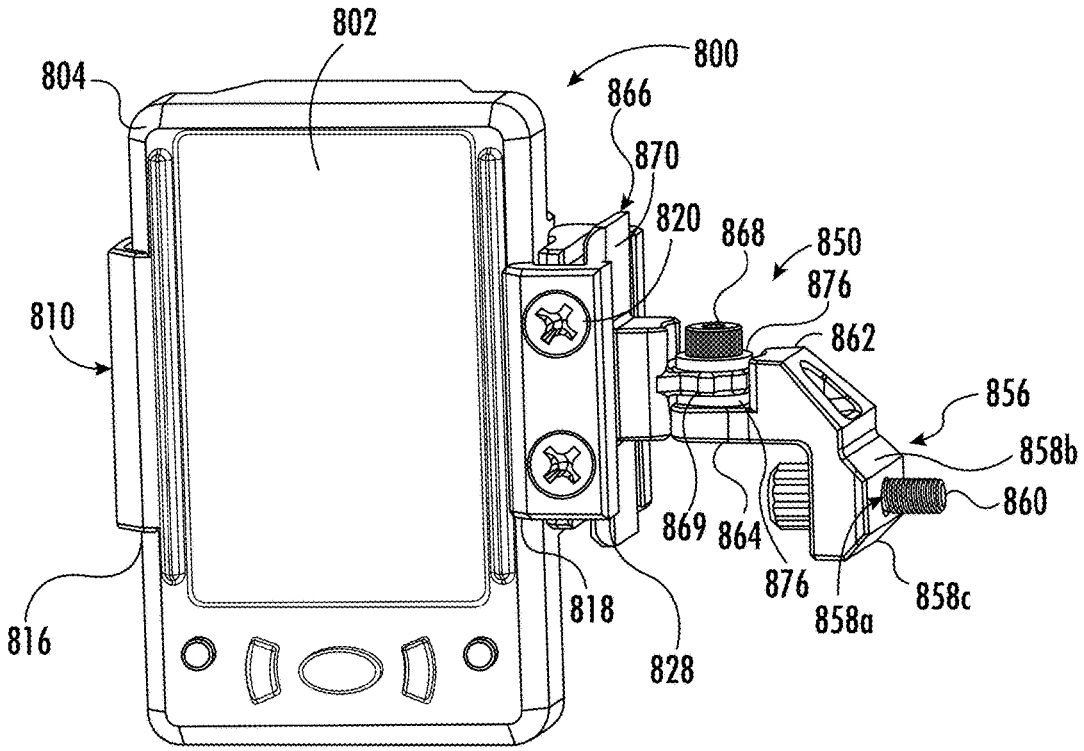
Figure 45:
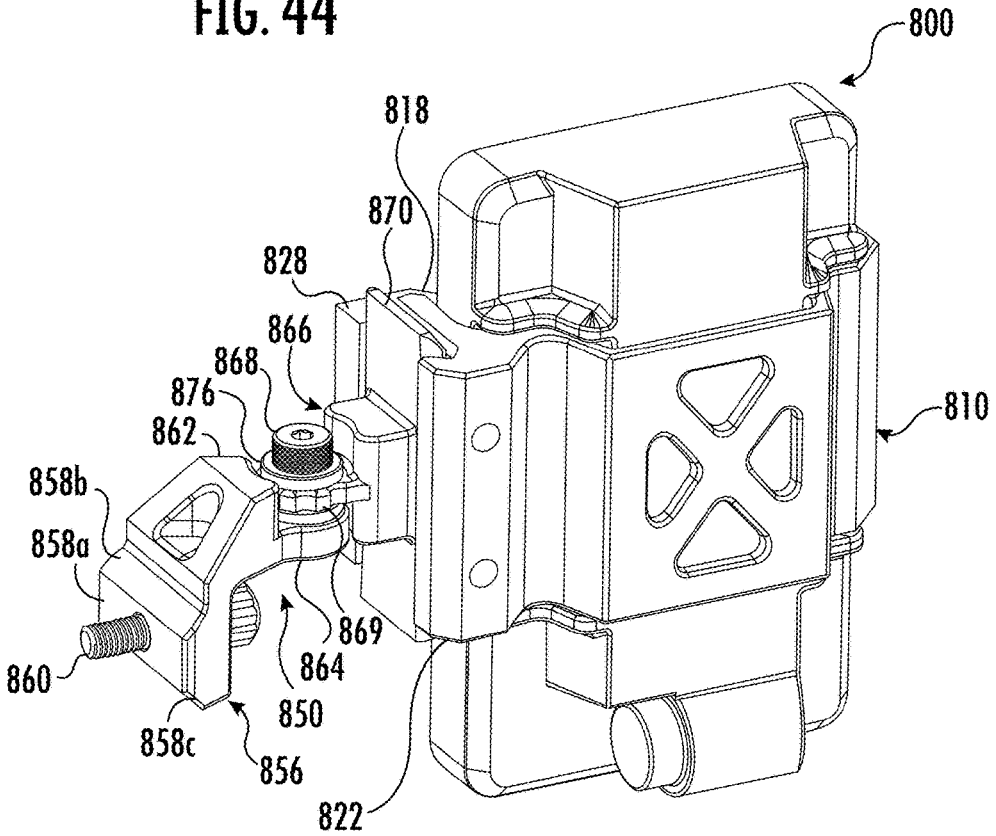
Figure 46:
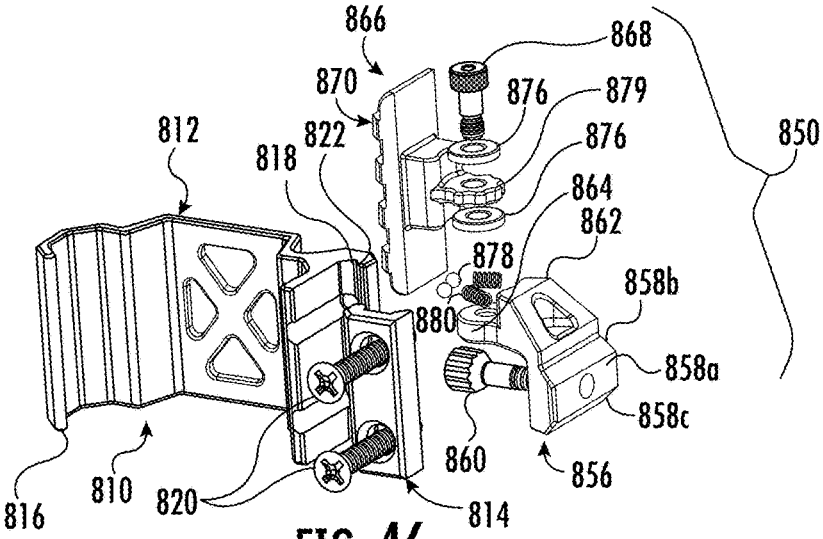
Figure 47:
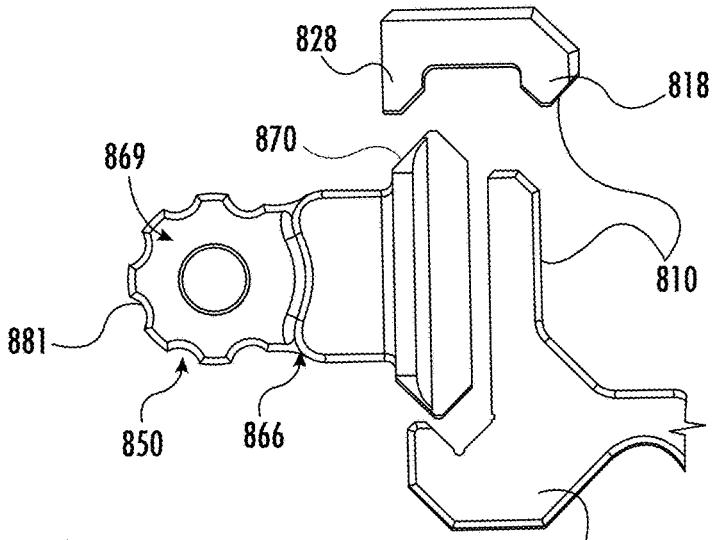
Figure 48:
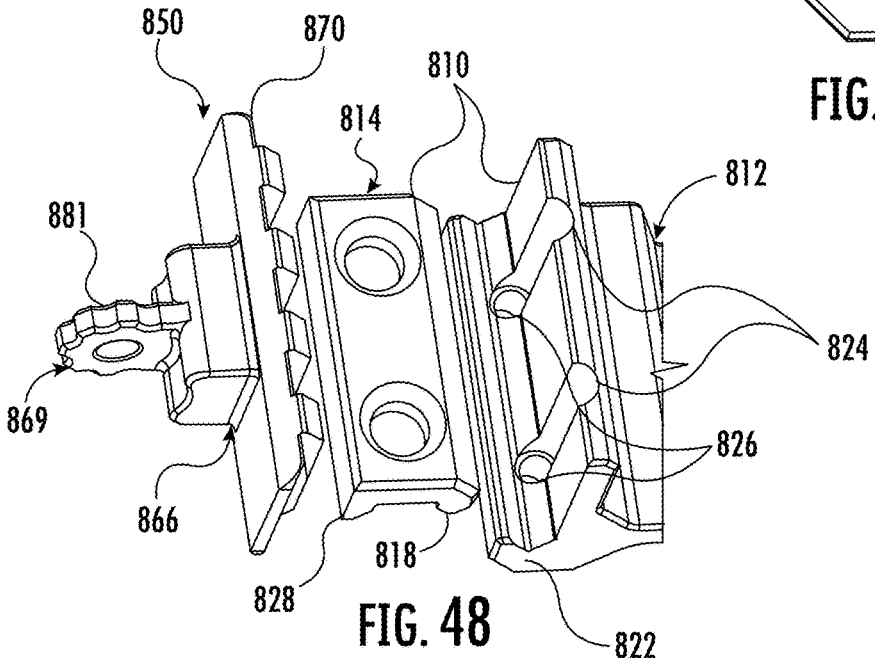
Figure 49:
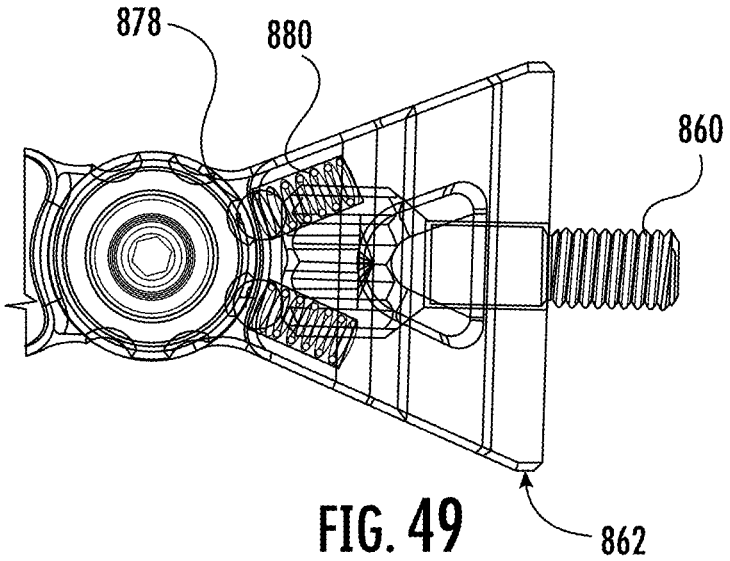
Figure 50:
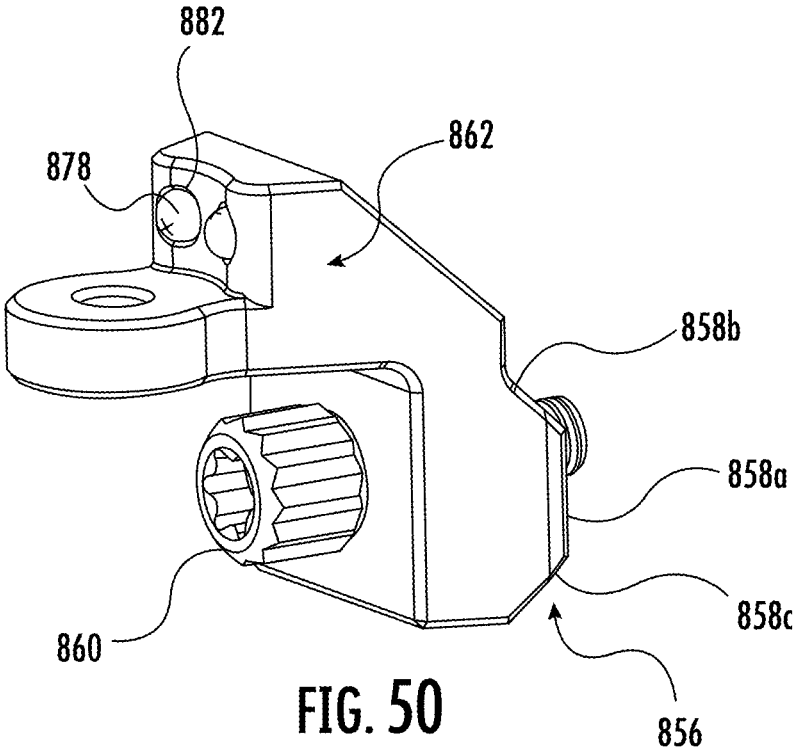
Figure 51:
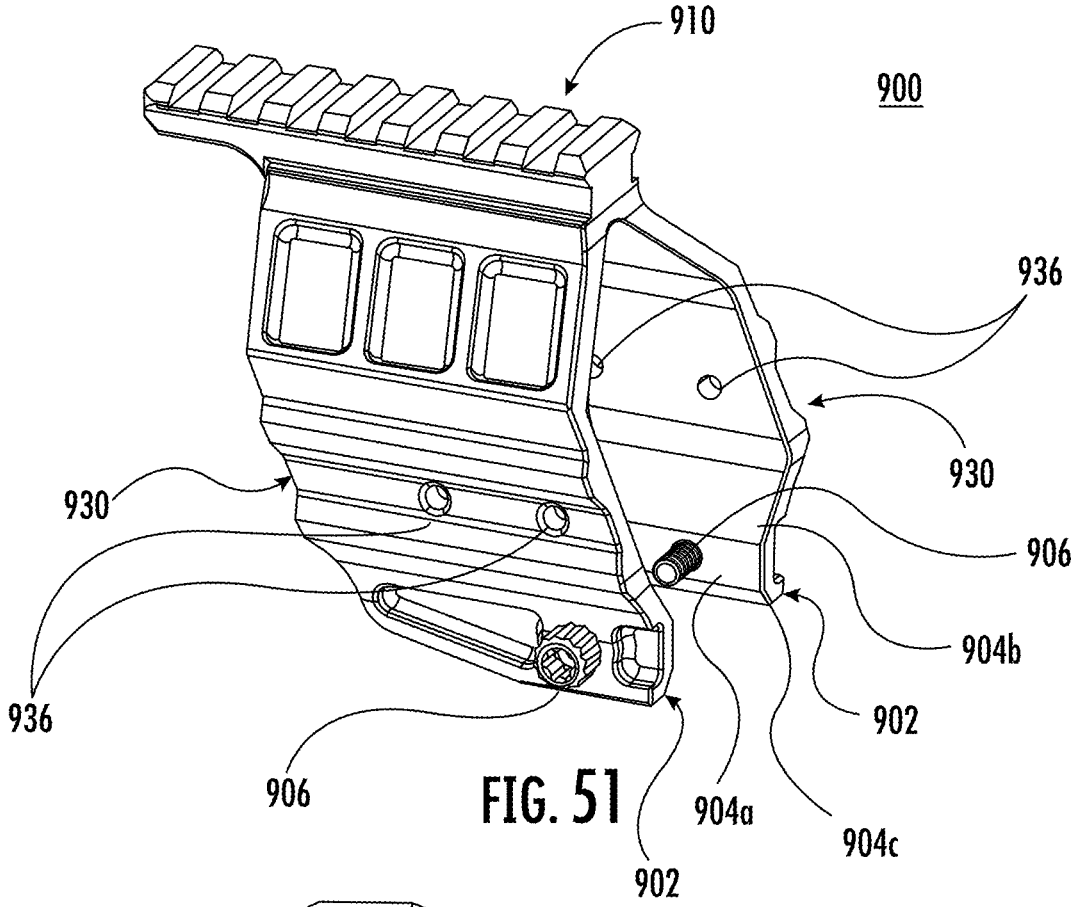
Figure 52:
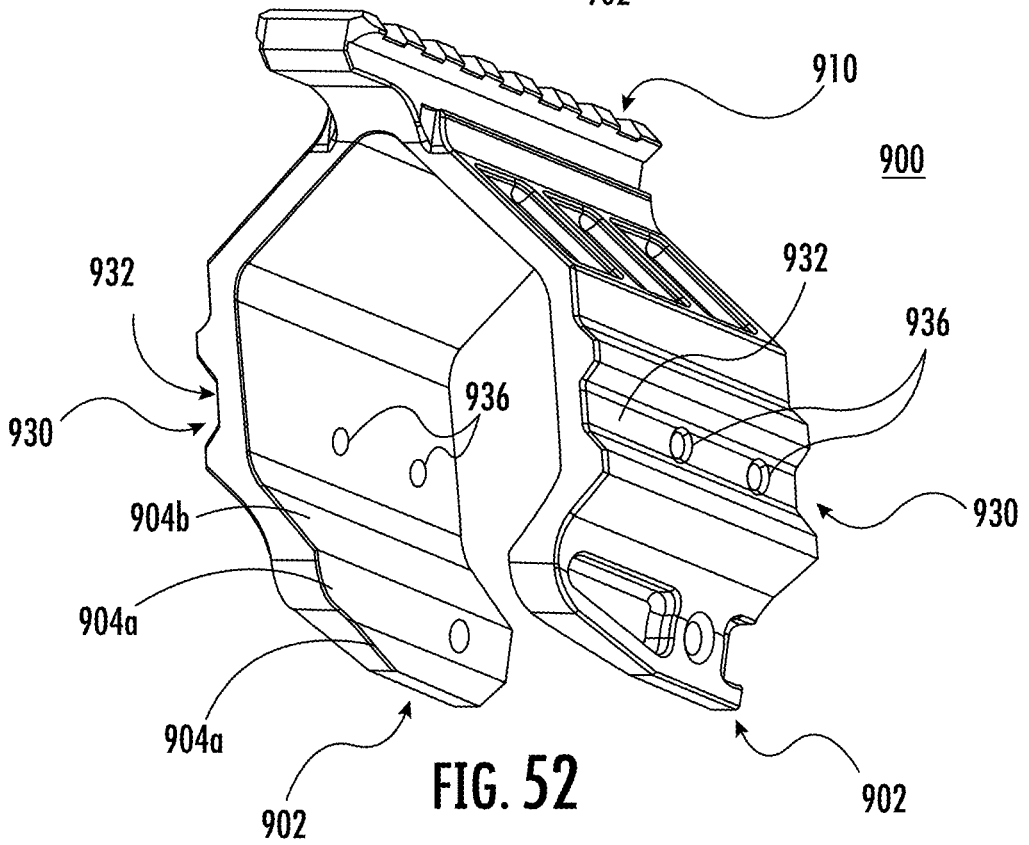
Figure 60:
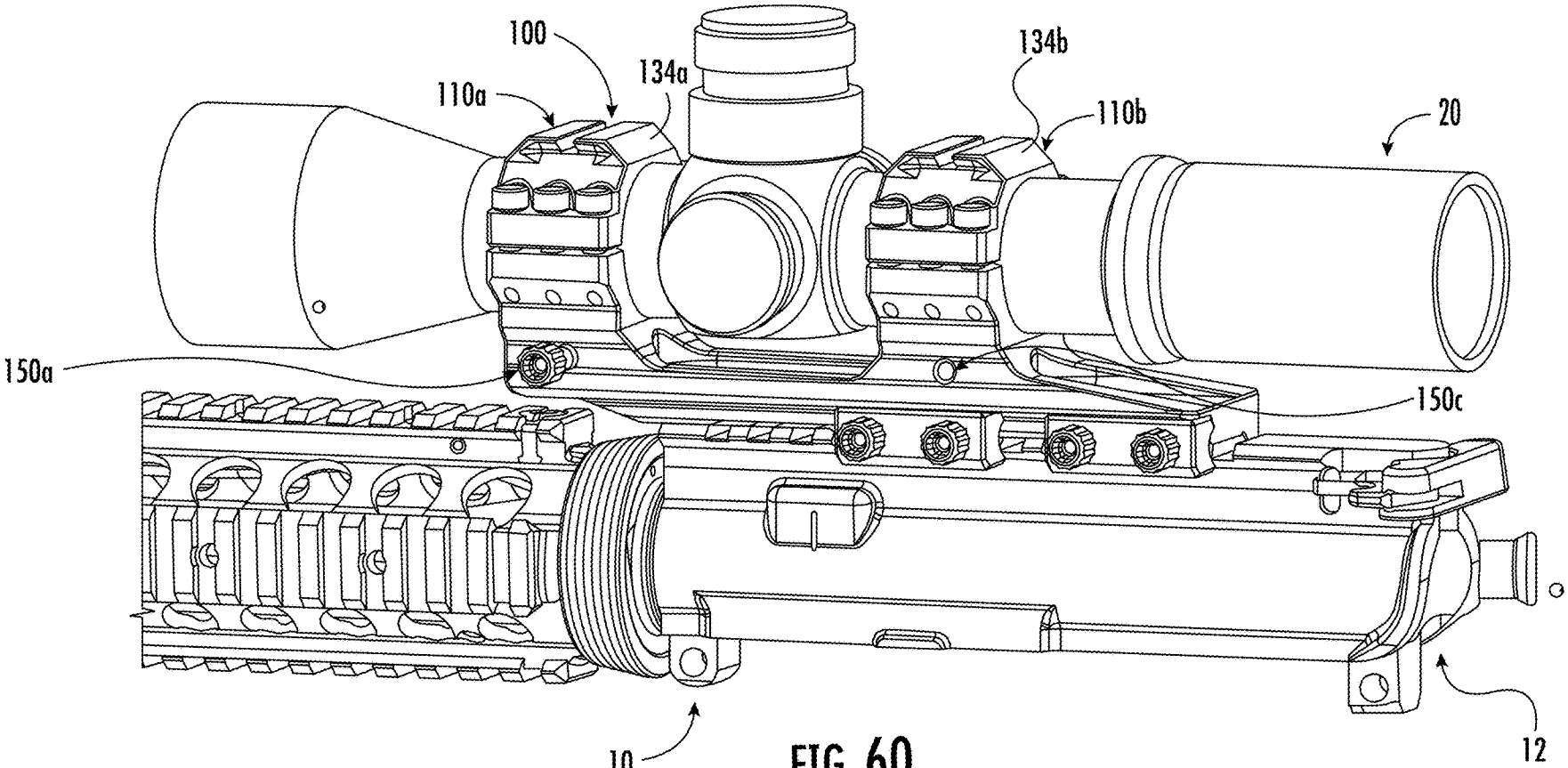

FIG. 1 illustrates a firearm with a scope mounted to a Picatinny rail of the firearm upper receiver using a scope mount in accordance with various embodiments of the present disclosure;

FIGS. 2-6 illustrate various views of a scope mount in accordance with various embodiments of the present disclosure;

FIG. 7 illustrates a cross-sectional view of the scope mount of FIG. 6 taken along a center, longitudinal plane of the scope mount;

FIG. 8 illustrates a partial perspective view of a cap accessory mount of the scope mount of FIGS. 1-7;

FIG. 9 illustrates a partial perspective view of a lateral accessory mount point of the scope mount of FIGS. 1-7;

FIGS. 10-14 illustrate various views of a Picatinny rail mount configured to engage a lateral accessory mount point of a scope mount in accordance with various embodiments of the present disclosure;

FIGS. 15-23 illustrate various views of a first embodiment of an angled accessory mount configured to engage a cap accessory mount in accordance with various embodiments of the present disclosure;

FIGS. 24-30 illustrate various views of a second embodiment of an angled accessory mount configured to engage a cap accessory mount in accordance with various embodiments of the present disclosure;

FIGS. 31-34 illustrate various views of an electronic level and electronic level mount configured to engage a lateral accessory mount point of a scope mount in accordance with various embodiments of the present disclosure;

FIGS. 35-36 illustrate various views of an electronic level mount configured to engage a lateral accessory mount point of a scope mount in accordance with various embodiments of the present disclosure;

FIGS. 37-38 illustrate various views of a bubble level and bubble level mount configured to engage a lateral accessory mount point of a scope mount in accordance with various embodiments of the present disclosure;

FIG. 39 illustrates a bubble level mount configured to engage a lateral accessory mount point of a scope mount in accordance with various embodiments of the present disclosure;

FIGS. 40-43 illustrate various views of a data card holder and pivot mount configured to engage a lateral accessory mount point of a scope mount in accordance with various embodiments of the present disclosure;

FIGS. 44-45 illustrate various views of a heads-up display (HUD), HUD clamp, and pivoting rail mount configured to engage a lateral accessory mount point of a scope mount in accordance with various embodiments of the present disclosure;

FIGS. 46-48 illustrate various views of a HUD clamp and portions of a pivoting rail mount in accordance with various embodiments of the present disclosure;

FIGS. 49-50 illustrate various views of portions of a pivot base usable in a pivot mount and pivoting rail mount in accordance with various embodiments of the present disclosure;

FIGS. 51-54 illustrate various views of a bridge mount configured to engage a plurality of lateral accessory mount points of a scope mount in accordance with various embodiments of the present disclosure;

FIGS. 55-59 illustrate various views of a Picatinny rail mount for an angled mount in accordance with various embodiments of the present disclosure;

FIG. 60 illustrates a firearm with a scope mounted to a Picatinny rail of the firearm upper receiver using a scope mount in accordance with various embodiments of the present disclosure; and FIGS. 61-64 illustrate a firearm with a scope mount supporting various combinations of accessories in accordance with various embodiments of the present disclosure.

DETAILED DESCRIPTION

One or more embodiments are now more fully described with reference to the accompanying drawings, wherein like reference numerals are used to refer to like elements throughout and in which some, but not all embodiments of the inventions are shown. In the following description, for purposes of explanation, numerous specific details are set forth in order to provide a thorough understanding of the various embodiments. It is evident, however, that the various embodiments can be practiced without these specific details. It should be understood that some, but not all embodiments are shown and described herein. Indeed, the embodiments may be embodied in many different forms, and accordingly this disclosure should not be construed as limited to the embodiments set forth herein. Rather, these embodiments are provided so that this disclosure will satisfy applicable legal requirements.

As used herein, the term "exemplary" means serving as an example, instance, or illustration. Any aspect or design described herein as "exemplary" is not necessarily to be construed as preferred or advantageous over other aspects or designs. Rather, use of the word exemplary is intended to present concepts in a concrete fashion. In addition, while a particular feature may be disclosed with respect to only one of several implementations, such feature may be combined with one or more other features of the other implementations as may be desired and advantageous for any given or particular application. Furthermore, to the extent that the terms "includes" and "including", and variants thereof, are used in either the detailed description or the claims, these terms are intended to be inclusive in a manner similar to the term "comprising."

As used herein, terms of direction, such as "front," "rear," "top," etc. are used for explanatory purposes in the examples provided below to describe the relative positions of certain elements or portions of elements relative to other elements or portions of elements and does not require an absolute orientation of any element or portion of any element relative to an absolute reference frame (e.g., a "top" of a firearm need not always face upwards relative to the earth, and in some instances, such as when held upside down, a "bottom" of a firearm may be above the "top" relative to the earth). As used herein, the term "or" is used in both the alternative and conjunctive sense, unless otherwise indicated. The term "along," and similarly utilized terms, means near or on, but not necessarily requiring directly on an axis, edge, or other referenced location.

As used herein, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

As used herein, the terms "coupled," "fixed," "attached to," and the like refer to both direct coupling, fixing, or attaching, as well as indirect coupling, fixing, or attaching through one or more intermediate components or features, unless otherwise specified herein.

As used herein, the term "positioned directly on" refers to a first component being positioned on a second component such that they make contact. Similarly, as used herein, the term "positioned directly between" refers to a first component being positioned between a second component and a third component such that the first component makes contact with both the second component and the third component. In contrast, a first component that is "positioned between" a second component and a third component may or may not have contact with the second component and the third component. Additionally, a first component that is "positioned between" a second component and a third component is positioned such that there may be other intervening components between the second component and the third component other than the first component.

As used herein, terms of approximation, such as "approximately," "substantially," or "about," refer to being within manufacturing or engineering tolerances. For example, terms of approximation may refer to being withing a five percent margin of error.

Example Scope Mount

Referring to FIG. 1, an example firearm 10 is shown having an upper receiver 12 defining a Picatinny rail 14. The firearm may be any firearm capable of being equipped with a scope, including but not limited to AR-platform firearms (e.g., AR-15 platform firearms, AR-10 platform firearms, etc.), other rifles, pistols, shotguns, and/or other firearms. In the depicted example, the firearm 10 is an AR-15 platform firearm. A scope mount 100 in accordance with various embodiments of the present disclosure is attached to the Picatinny rail 14 in the depicted embodiment, and the scope mount is supporting a scope 20 for use in aiming the firearm. The scope mount 100 includes a pair of scope mount rings 110*a*, 110*b* (collectively and individually also labeled as "110") defining corresponding passages 112*a* (collectively and individually also labeled as "112") that surround and support the scope 20 relative to the firearm 10. The passages 112 may define generally cylindrical shapes configured to match an exterior profile of the scope.

Figure 2:
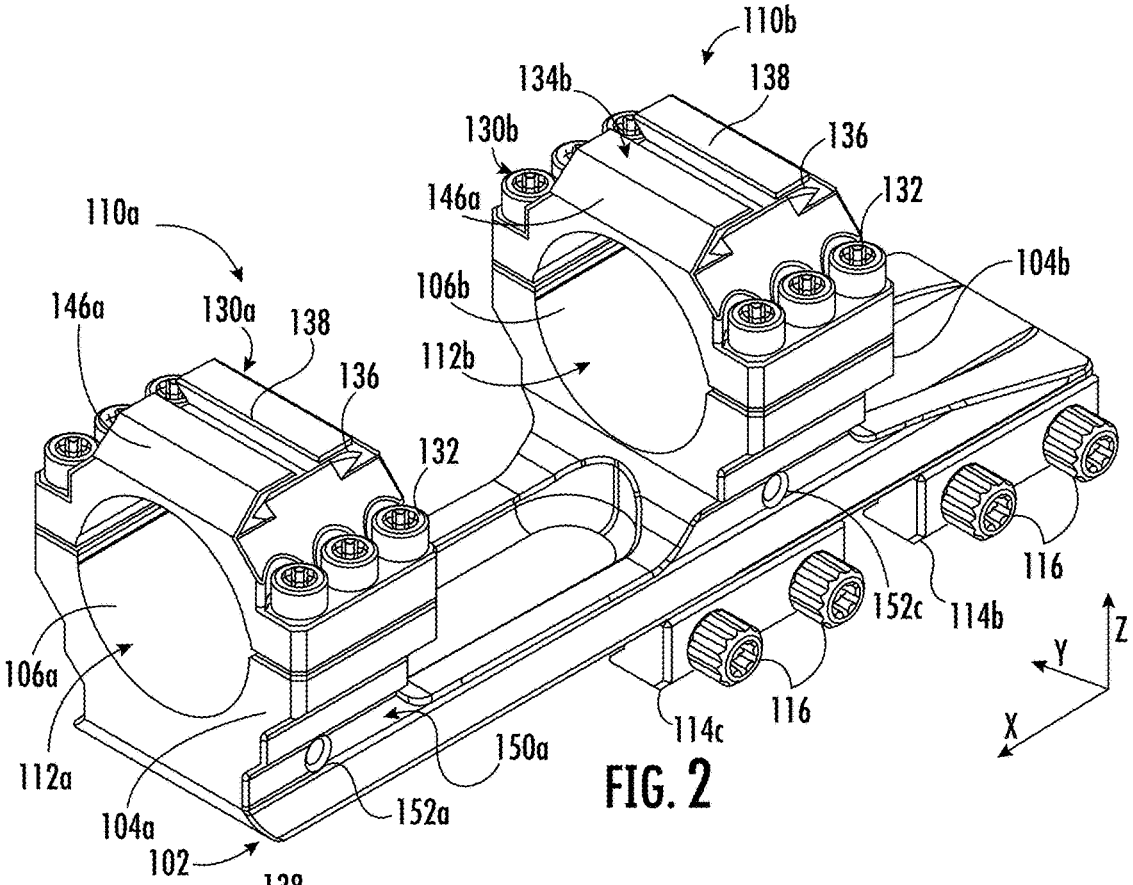
Figure 3:
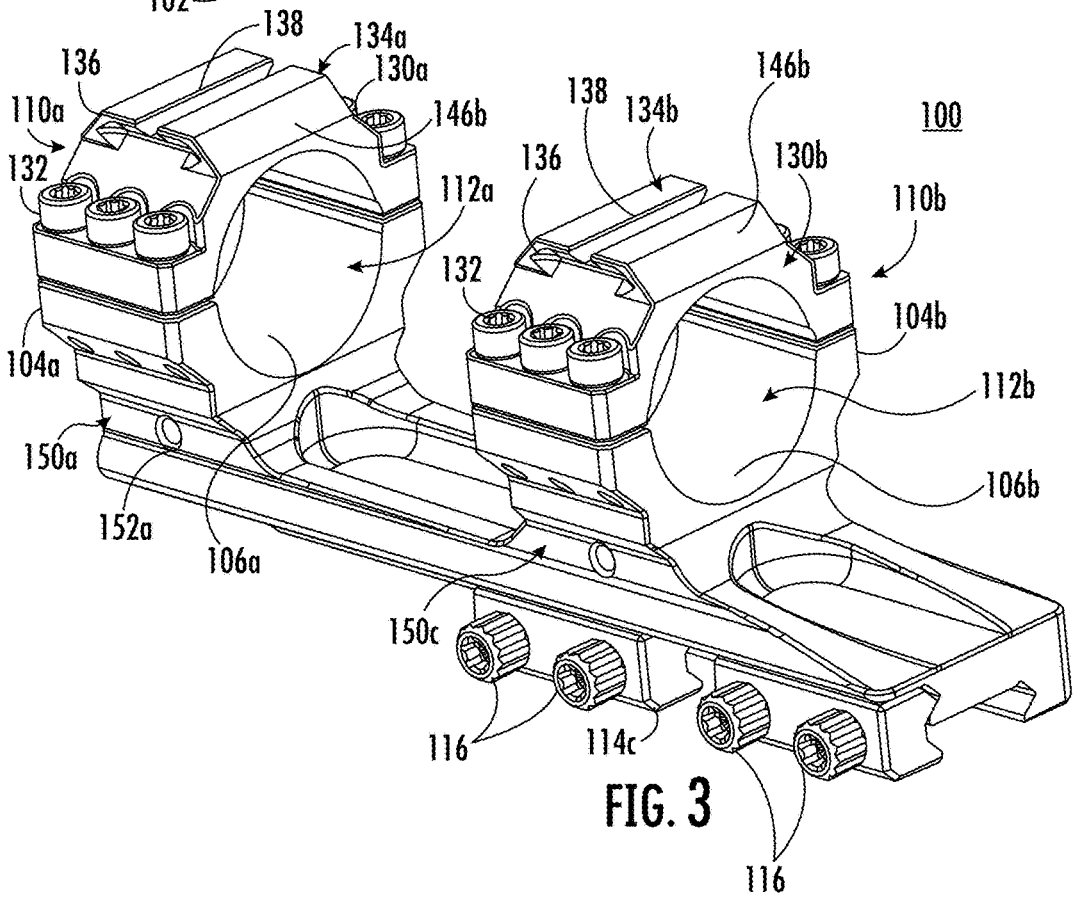
Figure 4:
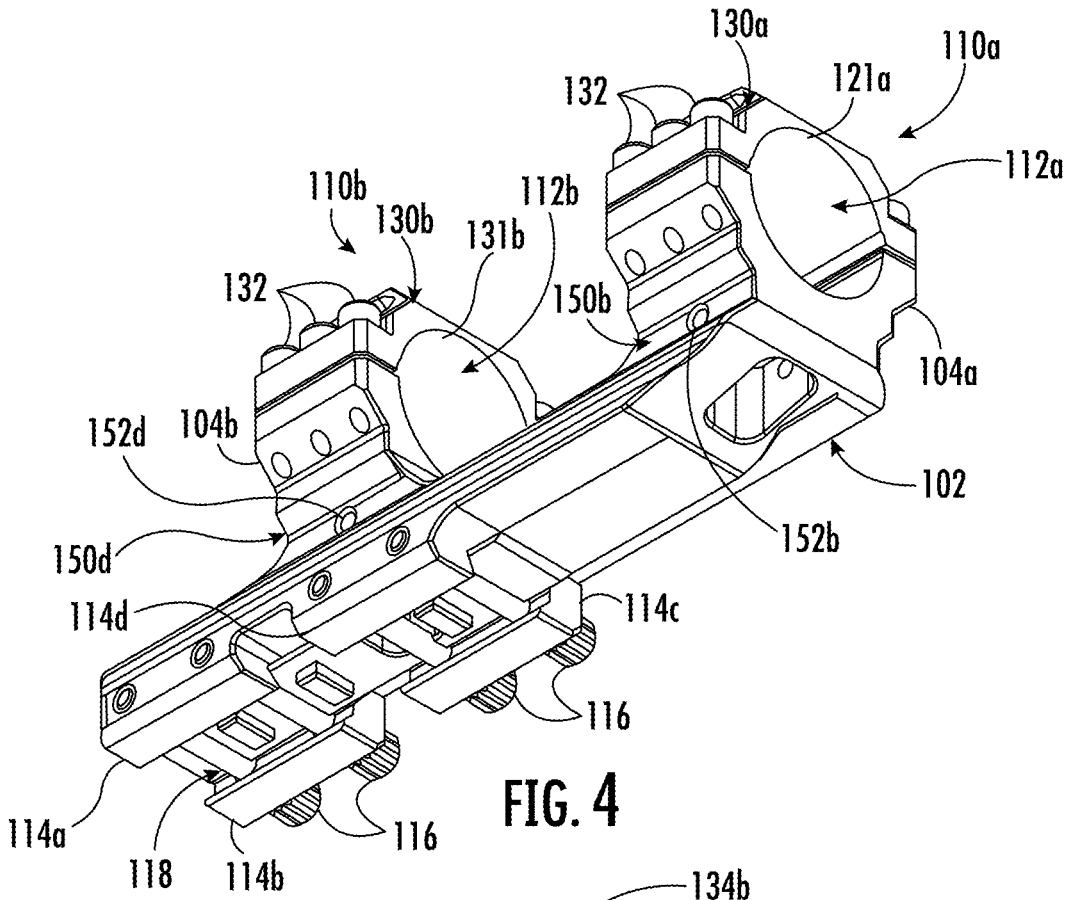

Referring to FIGS. 2-9, various views and portions of the scope mount 100 of FIG. 1 are shown. FIGS. 2-4 illustrate various perspective views of the scope mount 100. In the depicted embodiment, the scope mount 100 defines two scope mount rings 110*a*, 110*b* spaced from each other along the longitudinal direction of the scope mount 100 (defined along the positive and negative x axis labeled in FIG. 2).

The scope mount 100 includes a body 102 configured to engage the Picatinny rail 14 or another mounting surface (e.g., a Weaver rail or other attachment point) of the firearm (e.g., firearm 10 shown in FIG. 1). In some embodiments, the body 102 may be a unitary component formed from a single contiguous piece of material. In some embodiments, the body 102 may comprise multiple components attached (whether permanently or impermanently) together. In the depicted embodiment, the scope mount 100 is configured to engage the Picatinny rail 14 of the firearm 10 via scope mount rail clamps 114*a*-114*d* disposed along an underside of the body 102. The scope mount rail clamps may include one or more fixed scope mount rail clamps 114*a*, 114*d* and one or more movable scope mount rail clamps 114*b*, 114*c*. One or more screws 116 may extend between a respective fixed scope mount rail clamp 114*a*, 114*d* and a respective movable scope mount rail clamp 114*b*, 114*c* to move the movable scope mount rail clamps towards the fixed scope mount rail clamps and secure the Picatinny rail therebetween. In some embodiments, the screw(s) 116 and/or one or more fixed alignment protrusions 118 on the underside of the body 102 may longitudinally secure the scope mount 100 relative to the Picatinny rail.

In the depicted embodiment, the scope mount rail clamps 114*a*-114*d* are arranged in pairs with a first fixed scope mount rail clamp 114*a* being disposed laterally opposite a first movable scope mount rail clamp 114*b* relative to the Picatinny rail, which may be captured therebetween to secure the scope mount 100 to the firearm. Similarly, a second fixed scope mount rail clamp 114*d* is shown disposed laterally opposite a second movable scope mount rail clamp 114*c* relative to the Picatinny rail. As used herein, the lateral direction refers to the direction defined along the positive and negative y axis labeled in FIG. 2, which is perpendicular to the x axis. In some embodiments, the fixed and/or movable scope mount rail clamp(s) may include one or more clamps having a wider or narrower longitudinal dimension than shown. In some embodiments, one wider clamp may be disposed opposite two or more narrower clamps, such that identical numbers of clamps are not required. In some embodiments, the movable scope mount rail clamps 114*b*, 114*c* may be disposed on a same side of the Picatinny rail and the fixed scope mount rail clamps 114*a*, 114*b* may be disposed on a same side of the Picatinny rail, opposite the movable scope mount rail clamps to ensure alignment of the scope mount 100 with the firearm. The scope mount rail clamps 114*a*-114*d* may be mounted towards a rear of the scope mount 100 (e.g., a center of mass of one or both clamps being closer towards the aft end of the scope mount body 102 than a fore end). In some embodiments at least one of the scope clamp rings 110*a*, 110*b* may be cantilevered past the foremost scope mount rail clamp 114*a*, such as is shown in the present embodiments. The cantilever may allow the scope mount 100 to span or at least support a portion of the scope 20 above a gap in the Picatinny rail between the upper receiver and the handguard of the firearm.

The scope mount rings 110*a*, 110*b* may be formed by one or more separate components. For example, as shown in FIGS. 2-7, the scope mount rings 110*a*, 110*b* may be defined by a scope mount cap 130*a*, 130*b* (collectively and individually also labeled as "130") and a lower scope mount portion 104*a*, 104*b* (collectively and individually also labeled as "104") of the body 102. In the depicted embodiment, the scope mount caps 130*a*, 130*b* and lower scope mount portions 104*a*, 104*b* of the body 102 define the respective passages 112*a*, 112*b* and surround the scope in the locations of the respective scope mount rings 110*a*, 110*b*. For example, a first scope mount cap 130*a* and a first lower scope mount portion 104*a* may define the first passage 112*a*, and a second scope mount cap 130*b* and a second lower scope mount portion 104*b* may define the second passage 112*b*. The scope mount caps 130*a*, 130*b* may define lower surfaces 131*a*, 131*b* (e.g., curved surfaces) and the lower scope mount portions 104*a*, 104*b* may define upper surfaces 106*a*, 106*b* configured to engage the scope and define portions of the passages 112*a*, 112*b*. In the depicted embodiment, each component defines approximately half of each passage. The scope mount caps 130*a*, 130*b* may be connected to the respective lower scope mount portions 104*a*, 104*b* via various fasteners and/or hinges. In the depicted embodiment, the scope mount caps 130*a*, 130*b* are removably connected to the respective lower scope mount portions 104*a*, 104*b* via screws 132 (e.g., six screws, three per side in the depicted embodiment).

Example Accessory Mounts

Embodiments of the present disclosure illustrate accessory mounts configured to engage one or more accessories with the scope mount 100. Various embodiments of the scope mount may include one or more such accessory mounts in any one or more of various configurations. With continued reference to the embodiments of FIGS. 2-9, the depicted scope mount 100 includes a plurality of accessory mounts, including scope mount cap accessory mounts 134*a*, 134*b* and lateral accessory mount points 150*a*-150*d*. Scope mounts according to various embodiments of the present disclosure may include any one or more of the scope mount cap accessory mounts 134*a*, 134*b* and/or lateral accessory mount points 150*a*-150*d*, each of which may be usable alone or in combination with one or more other accessory mounts, such as with accessories that span multiple mounts or with multiple accessories (e.g., one per mount or a subset of mounts).

With reference to FIGS. 2-8, example scope mount cap accessory mounts 134*a*, 134*b* are depicted. In the depicted embodiment, the fore scope mount cap accessory mount 134*a* and aft scope mount cap accessory mount 134*b* are identical. Therefore, reference will be made to the scope mount cap accessory mount 134 generally. While each scope mount ring 110*a*, 110*b* need not include a scope mount cap accessory mounts, and such mounts need not be identical in each instance, the teachings discussed herein may be used with either mount 134.

Figure 5:
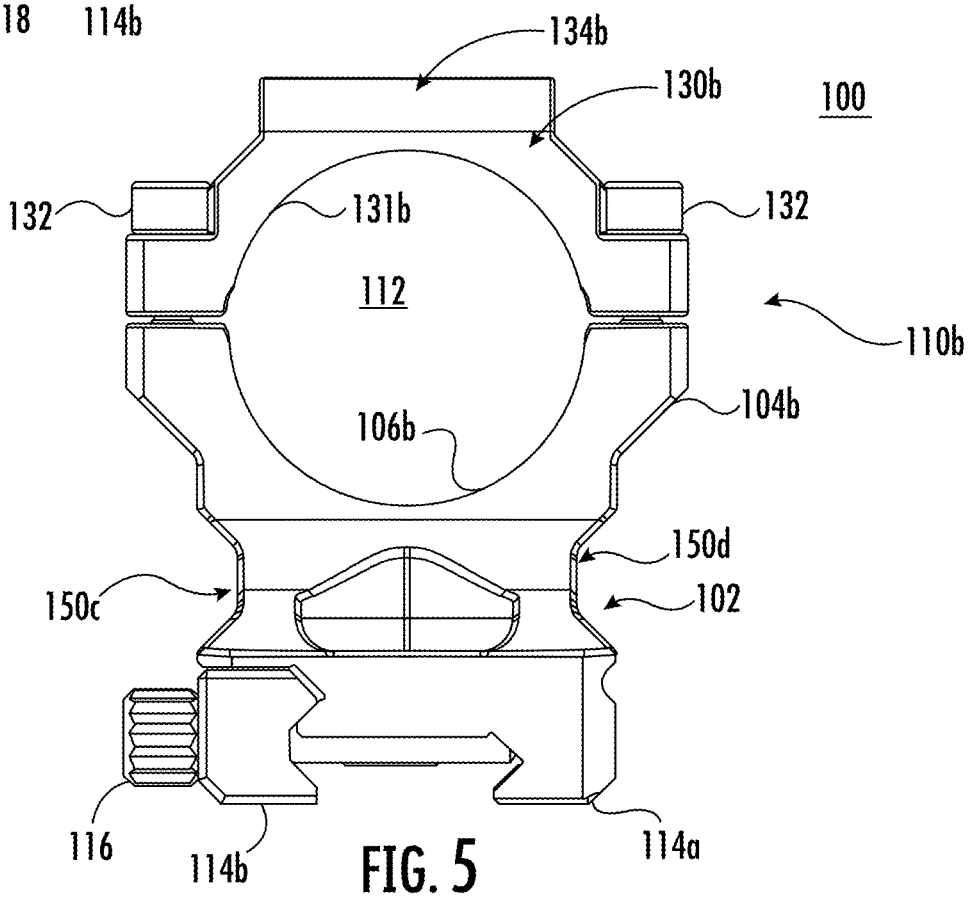

In the depicted embodiments, the scope mount cap 130 includes the scope mount cap accessory mount 134 integrally formed thereon. In some embodiments, the scope mount cap accessory mount may be formed as part of another component or may be a standalone component. With reference to FIG. 5, the depicted scope mount cap accessory mount 134 defines a rectangular cross section when viewed from the rear (and front). With reference to FIGS. 6 and 7, the depicted scope mount cap accessory mount 134 defines a generally trapezoidal cross section when viewed from either lateral side.

With reference to FIG. 8, the scope mount cap accessory mount 134 may define a lateral groove 138 oriented in the lateral direction (e.g., along the positive and negative y direction shown in FIG. 8). In some embodiments, the scope mount cap accessory mount 134 may include only a single lateral groove 138, and in some embodiments, multiple lateral grooves may be used on a single scope mount cap accessory mount. In the depicted embodiment, the scope mount cap accessory mount 134 comprises a top surface 135 and the lateral groove 138 is defined along a lateral center axis of the top surface, with the lateral groove 138 being open to the top side.

The lateral groove 138 extends between lateral ends of the scope mount cap accessory mount 134, where each lateral end is also open. In the depicted embodiment, the scope mount cap accessory mount 134 defines a recess 136 at each lateral end, with the groove 138 terminating at the opposing recesses 136. The scope mount cap accessory mount 134 may receive corresponding engaging surfaces from one or more accessories within the recess 136, which may facilitate, at least in part, the rigid retention of the accessories on six axes.

Due at least in part to the shape of the recesses 136, the depicted lateral groove 138 is laterally shorter at a bottom side opposite the top side than at the top side. In particular, in the depicted embodiment, the scope mount cap accessory mount 134 is narrower at the bottom, closed side of the lateral groove 138 than at the open, top side, such that the groove is longer along the top surface 135 than at the bottom of the groove (e.g., defining a partly trapezoidal cross-sectional shape). In some embodiments, the lateral groove 138 may define a square or rectangular cross section taken in a vertical-longitudinal plane (e.g., as shown in FIG. 6). The scope mount cap accessory mount 134 thereby defines an overhang 142 where the side wall meets the top surface 135 from which the recess 136 is then undercut.

In the depicted embodiment, the recess 136 includes a midline 140 extending longitudinally between a fore end and an aft end of the recess. The midline 140 may align with the bottom side of the lateral groove 138 and may define the narrowest part of the scope mount cap accessory mount 134 at the longitudinal center of the scope mount cap accessory mount 134 corresponding to the lateral groove 138. The recess 136 may shallow along the midline 140 towards the fore and aft ends of the recess. For example, a lateral width of the scope mount cap accessory mount 134 spanning the fore ends of the recesses 136 opposite each other across the scope mount cap accessory mount 134 and a second lateral width of the scope mount cap spanning the aft ends of the recesses 136 opposite each other across the scope mount cap accessory mount 134 are each greater than a third lateral width of the scope mount cap at a bottom side of the lateral groove 138 within the recesses 136. Similarly, in some embodiments, the bottom side of the lateral groove 138 may be the shortest lateral dimension of the lateral groove. In such embodiments, the fore and aft ends of the recess 136 are each configured to constrain longitudinal motion of the one or more accessories (e.g., via attaching the accessories within the recess so that the fore and aft ends of the recess are wider than the accessory clamps).

With continued reference to FIG. 8, the recesses 136 may define inwardly angled surfaces 144*a*-144*g* configured to assist with centering the accessory mount(s) during engagement and retain the accessory mounts during operation. For example, in the depicted embodiment, each of the surfaces 144*a-c, g* above the midline 140 are at least partially angled downwardly and each of the surfaces 144*d-f* below the midline 140 are at least partially angled upwardly to direct the accessory mount clamps towards the midline 140 as they are tightened. Moreover, the surfaces 144*f-g* at the fore end of the recess 136 may be at least partially aftwardly angled, and the surfaces 144*c-d* at the aft end of the recess 136 may be at least partly forwardly angled. In the depicted embodiment, the recess 136 defines central surfaces 144*a-b, e* that are purely upwardly or downwardly angled. Moreover, in the depicted embodiment, the upper surfaces 144*a-c, g* are symmetrical to the bottom surfaces 144*d-f* of the recess 136. In some embodiments, the surfaces may all be oriented at least partially towards a center of the recess 136 (e.g., the terminus of the bottom side of the lateral groove 138 which intersects the midline 140 in the depicted embodiment). Moreover, in the depicted embodiment, the cross-sectional area of each recess 136 decreases towards a lateral center of the scope mount cap. For example, a cross sectional area of the recess 136 defined in a vertical-longitudinal plane (e.g., the plane of the paper in FIG. 6) positioned at a lateral position of the overhang 142 is greater than a cross-sectional area of the recess 136 defined in a second vertical-longitudinal plane positioned at the intersection of the midline 140 and the groove 138.

With continued reference to FIG. 8, the scope mount cap accessory mount 134 may further include a leading surface 146*a* and a trailing surface 146*b* on longitudinally opposing sides of the top surface 135, which may be used for accessory mount clearance, support, and/or alignment. The leading surface 146*a* and the trailing surface 146*b* are depicted at opposite longitudinal sides of the lateral groove 138 on the depicted scope mount cap accessory mount 134. The leading surface 146*a* and the trailing surface 146*b* may each be angled relative to a vertical direction (e.g., not parallel to the vertical axis z), such that a first distance between an upper edge 148*a* of the leading surface 146*a* and an upper edge 148*b* of the trailing surface 146*b* is less than a second distance between a lower edge 149*a* of the leading surface and a lower edge 149*b* of the trailing surface.

Referring to FIGS. 1-7 and 9, the scope mount 100 may additionally or alternatively include one or more lateral accessory mount points 150*a-d* (collectively and individually also labeled as "150") configured to engage one or more accessory mounts. The lateral accessory mount points 150*a-d* may comprise one or more openings 152*a-d* (collectively and individually also labeled as "152") configured to engage fasteners (e.g., pins, clips, threaded fasteners such as screws, other protrusions, etc.) to secure the accessory mounts to the scope mount 100. The openings 152*a-d* may be shaped to receive the respective fasteners (e.g., threaded to receive screws, etc.). The openings 152*a-d* may extend laterally into the body 102 of the scope mount 100 to receive fasteners from external, lateral directions (e.g., fasteners inserted along the positive or negative y axis illustrated in FIG. 2, which is perpendicular to the longitudinal, x axis). In the depicted embodiment, opposing lateral accessory mount points (e.g., the pairs 150*a-b* and 150*c-d*) may share a common opening 152 and/or may define openings 152*a-b* and 152*c-d* that are concentrically aligned (e.g., such that a first screw can extend between a first pair of opposing openings 152*a-b* and a second screw can extend between a second pair of opposing openings 152*c-d*). In some embodiments, opposing openings may not be aligned. In some embodiments, the scope mount 102 may be solid along the lateral axis of the openings 152*a-d* such that the same physical opening defines each opposing pair of openings. In some embodiments, one or more voids or recesses may be formed in the scope mount 102, such as shown in the embodiment of FIGS. 1-9, to create an air gap between opposing openings 152*a-d*.

With continued reference to FIGS. 1-7 and 9, the lateral accessory mount point(s) 150*a-d* may be defined low on the body 102, for example, to stabilize heavy accessories. In the depicted embodiment, the lateral accessory mount points 150*a-d* are positioned such that the openings 152*a-d* are positioned at heights below the passage 112*a-b* of the scope mount rings 110*a*, 110*b*. Such a mounting position may, as a non-limiting example, permit the accessories to avoid interfering with the scope while remaining stably attached to the scope mount 100 and not interfering with (or minimizing interference of) the accuracy of the scope. Moreover, in the depicted embodiment, the lateral accessory mount points 150*a-d* are disposed at a same longitudinal position (e.g., a same position along the x axis, without regard to other axial positions) as the respective passages 112*a, b*. In some embodiments, the respective lateral accessory mount points 150*a-d* may be disposed at a longitudinal centerline of the corresponding scope mount rings 110*a*, 110*b*. In some embodiments, the lateral accessory mount points 150*a-d* may additionally or alternatively be disposed at a same longitudinal position as the lateral groove 138 of the scope mount cap accessory mount 134.

In some embodiments, the lateral accessory mount points 150*a-d* may be defined in pairs on opposite sides of one or more scope mount rings 110*a*, 110*b*. For example, in the depicted embodiments, a first lateral accessory mount point 150*a* is disposed opposite a second lateral accessory mount point 150*b* on opposite sides of the first scope mount ring 110*a*. Similarly, a third lateral accessory mount point 150*c* is disposed opposite a fourth lateral accessory mount point 150*d* on opposite sides of the second scope mount ring 110*b*. In some embodiments, each of the lateral accessory mount points 150*a-d* may define the same shape (mirrored for opposing sides). In some embodiments, at least the pairs of lateral accessory mount points 150*a-d* opposing each other may define the same respective shapes (mirrored on opposing sides).

Referring to FIG. 9, the lateral accessory mount points 150 may define a recess 154 configured to receive at least a portion of an accessory mount therein. In the depicted embodiment, the recess 154 defines a channel shape extending longitudinally from fore to aft of the scope mount rings 110*a*, 110*b* (e.g., at or proximate a junction between the rings and a lower base portion of the body 102). The channel shape may be configured to vertically and rotationally (e.g., about the y axis corresponding to the rotational axis of a fastener) position the accessory mount for operation. The fastener may thereby secure the accessory mount relative to six axes in cooperation with the channel structure. In some embodiments, the fore and aft ends of the recess 154 may be open.

With continuing reference to FIG. 9, the recesses 154 may include a vertical base surface 156*a* adjacent an upper surface 156*b* that is partly downwardly angled and a lower surface 156*c* opposite the upper surface that is partly upwardly angled. Collectively the surfaces 156*a-c* define a generally trapezoid shaped cross section of the recess 154. In some embodiments, the upper surface 156*b* and lower surface 156*c* may define mirrored angles of equal magnitude relative to a horizontal plane. In some embodiments, the upper surface 156*b* and lower surface 156*c* may be the same length and/or width. The vertical base surface 156*a* may be defined along a vertical-longitudinal plane relative to the body 102 (e.g., perpendicular to the lateral dimension along a plane defined by the longitudinal and vertical directions). In the depicted embodiment, the recess surfaces 156*a-c* terminate in different longitudinal positions, while maintaining the same cross section along their lengths. The openings 152 may be formed in the vertical base surface 156*a*.

While depicted having a horizontal fore-aft direction, in some embodiments, the recess 154 and corresponding structures (e.g., vertical base surface 156*a*, upper surface 156*b*, and/or lower surface 156*c*) may extend at least partially vertically and/or laterally relative to the firearm in an operable position. In such embodiment, the corresponding accessory engagement structures (e.g., the corresponding mount base(s) of an accessory and/or accessory mount) may define a matching angle. In an example embodiment, one or more recesses 154 may be vertically oriented such that the corresponding accessories and/or accessory mounts engage one or more of the lateral accessory mount points 150*a-d* by translating vertically along the recess, perpendicular to the illustrated direction. In various embodiments, the recesses may be larger or smaller, and/or may include open (e.g., as depicted) or closed ends.

Various configurations of the lateral accessory mount points 150*a-d* may be used. For example, in addition to the depicted configuration, in some embodiments, only the front scope mount ring 110*a* or only the rear scope mount ring 110*b* may include lateral accessory mount points. In some embodiments, one or more lateral accessory mount points may be defined between, fore, or aft of one or more scope mount rings. In some embodiments, the lateral accessory mount points need not have counterparts on both sides of the firearm and may include two or more unmatched lateral accessory mount points along the left or right side of the scope mount.

Example Accessories and Accessory Mounts

Reference will now be made to FIGS. 10-59 which illustrate various embodiments of accessories and/or accessory mounts configured to engage a scope mount cap accessory mount 134, a lateral accessory mount point 150, and/or each other in various configurations and combinations.

Turning first to FIGS. 10-14, a Picatinny rail mount 200. The Picatinny rail mount 200 defines a Picatinny rail 202 configured to engage one or more accessories and/or accessory mounts in accordance with procedures known in the art. The Picatinny rail 202 defines a t-shaped cross section with a plurality of cross-cut grooves 204 configured to engage and secure accessories and accessory mounts to the rail.

In the depicted embodiment, the Picatinny rail 202 is connected to a mount base 206 via a cantilever arm 208. The cantilever arm 208 may be configured to hold the Picatinny rail 202 in any desired position relative to the mount base 206. In the depicted embodiment, the cantilever arm 208 offsets the Picatinny rail 202 longitudinally (along the positive x axis illustrated in FIG. 10), vertically (along the positive z axis illustrated in FIG. 10), and laterally (along the negative y axis illustrated in FIG. 10), while positioning the rail 202 to receive accessories and/or accessory mounts from a lateral side of the firearm and orient the accessories towards the muzzle of the firearm. In some embodiments, the mount base 206 may be configured to engage a lateral accessory mount point 150 in a plurality of positions that adjust the offset (e.g., rotating the Picatinny rail mount 200 one hundred eighty degrees about a longitudinal axis of the fastener 210 shown in FIG. 10. Moreover, the existence of multiple lateral accessory mount points 150 further enables adjustment of the position for the Picatinny rail 202.

The depicted mount base 206 is configured to engage a lateral accessory mount point 150 in accordance with embodiments of the present disclosure. The depicted mount base 206 may be configured to engage the recess 154 of the lateral accessory mount point 150 (e.g., as shown in FIG. 9). For example, referring to FIGS. 11-12, the mount base 206 may include a vertical base surface 212*a*, upper angled surface 212*b*, and lower angled surface 212*c* which may be configured to match and nest with the respective vertical base surface 156*a*, upper surface 156*b*, and lower surface 156*c* of the recess 154 (e.g., as shown in FIG. 9). Although described as "upper" and "lower", the surfaces may be inverted when engaging the recess upside down and may similarly be described as "first" and "second" surfaces without changing their intended meaning. As with the recess of the lateral accessory mount point, the upper surface 212*b* may be angled in an opposite direction of the lower surface 212*c* to define a partly trapezoidal cross-section, which may insert into the corresponding trapezoidal channel of the lateral accessory mount point.

The mount base 206 may be secured to the lateral accessory mount point 150 with a fastener (e.g., threaded screw 210) configured to extend through the mount base 206 and into the scope mount 102. For example, a screw 210 may extend through an opening 214 on the mount base 206 and into a correspondingly threaded opening 152 of the lateral accessory mount point 150.

Turning to FIGS. 15-30, two embodiments of an angled accessory mount 300, 400 are shown. Unless noted or illustrated otherwise herein, the angled accessory mounts 300, 400 may have the same general structure and function. The depicted embodiments of the angled accessory mounts 300, 400 are configured to engage a scope mount cap accessory mount, such as the scope mount accessory mounts 134*a*, 134*b* of the scope mount caps 130*a*, 130*b* illustrated in FIGS. 1-8.

The angled accessory mounts 300, 400 may include a cap mount base 302, 402 configured to engage a scope mount cap accessory mount and an angled platform 304, 404 configured to engage an accessory (e.g., a red dot sight, Picatinny rail adapter, or any other accessory configured to engage the engagement features of the angled platform). In some embodiments, the angled platform 304, 404 may hold the accessory in a different orientation than the corresponding scope mount accessory mount (e.g., the plane of an upper surface of the angled platform 304, 404 may not be parallel to a top surface of the scope mount accessory mounts (e.g., top surface 135 shown in FIGS. 1-8). As between the angled accessory mount 300 of FIGS. 15-23 and the angled accessory mount 400 of FIGS. 24-30 the angled platforms 304, 404 define different angles and different translational positions relative to the cap mount base 302, 402, which may allow selection of an appropriate position and orientation for a given accessory (e.g., red dot sight positioning). While two examples are shown, the angled platforms may be manufactured with any angle to suit the corresponding accessory. For example, in some embodiments, the angled platforms may be defined at 40 degrees from horizontal (e.g., so that an operator may rotate the firearm 40 degrees to use a red dot sight that may be mounted on the angled platform). In some embodiments, the angled platforms may be defined at 45 degrees from horizontal. In some embodiments, the angled platforms may be defined at 50 degrees from horizontal. In some embodiments, in some embodiments, the angled platforms may be defined from 40 to 50 degrees from horizontal.

With continued reference to the embodiments of FIGS. 15-30, the cap mount base 302, 402 may include one or more clamp members 306, 308, 406, 408 configured to engage corresponding recesses (e.g., recesses 136 shown in FIGS. 1-8) of a scope mount cap accessory mount. For example, the depicted clamp members 306, 308, 406, 408 include a flat tip 307, 309, 407, 409 configured to abut the midline of the recess (e.g., midline 140 shown in FIG. 8). Similar to the configuration of the recesses, the cap mount base 302, 402 may include at least one clamp member configured to engage each opposing lateral side of the scope mount cap accessory mount to secure the angled accessory mount 300, 400 to the scope mount (e.g., scope mount 100 shown in FIGS. 1-9).

In some embodiments, at least one clamp member 306, 308, 406, 408 of each cap mount base 302, 402 may be movable relative to the rest of the angled accessory mounts 300, 400 and/or movable relative to an opposing clamp member. In some embodiments, the opposing clamp member may be fixed. For example, in the embodiment shown in FIGS. 15-23, the cap mount base 302 includes a movable clamp member 308 and a fixed clamp member 306. The embodiment shown in FIGS. 24-30 similarly shows a cap mount base 402 that includes a movable clamp member 408 and a fixed clamp member 406. In some embodiments, the tips 307, 309, 407, 409 of the opposing clamp members 306, 308, 406, 408 may form a wedge or chisel shape and may be aligned in the longitudinal and vertical directions (e.g., aligned relative to the y axis and z axis shown in FIG. 15) to reduce or eliminate torque on the angled accessory mounts caused by the clamp members.

The angled accessory mounts 300, 400 may include clamp adjustment mechanisms configured to move the movable clamp members 308, 408. For example, the threaded screw 310 illustrated 310 in FIGS. 15-23 and the threaded screw 410 illustrated in FIGS. 24-30 may engage corresponding threaded openings in the respective movable clamp members 308, 408, such that rotating the threaded screw 310, 410 is configured to push or pull the clamp members (e.g., dependent upon the direction of rotation). Moreover, the surrounding structure of the cap mount base 302, 402 may prevent rotation of the movable clamp members 308, 408 such that the rotational movement of the threaded screw 310, 410 is converted into translational movement of the movable clamp members.

As further depicted in the embodiment of FIGS. 15-23 and the embodiment of FIG. 24-30, the threaded screw 310, 410 may extend through the fixed clamp member 306, 406 to an exterior, actuatable portion of the threaded screw (e.g., a knurled screw head). As illustrated, the threaded screw 310, 410 includes at least one smooth portion 312, 412 between the actuatable head and a threaded portion 314, 414. The smooth portion(s) 312, 412 may be configured to pass through objects on which the threaded screw 310, 410 is not configured to act, such as the fixed clamp member 306, 406 and/or the lateral groove (e.g., lateral groove 138 shown in FIG. 8) of the scope mount cap accessory mounts. For example, the threaded screw 310, 410 may be configured to pass through the opening of the fixed clamp members 306, 406 and rotate freely relative to the fixed clamp members without moving or binding on the fixed clamp members because of the smooth portion 312, 412. In addition, as suggested above, the threaded screw 310, 410 may be configured to be at least partially disposed in the lateral groove of the scope mount cap accessory mounts, which may provide additional longitudinal resistance to removal. In the depicted embodiments, a distal tip of the threaded screw 310, 410 may protrude from the surface of the angled platforms 304, 404, which may ensure robust engagement of the threads with the angled platforms.

In some embodiments, an underside of the cap mount base 302, 402 may include angled mating surfaces 320*a-b*, 420*a-b* configured to engage the leading surface 146*a* and/or trailing surface 146*b* of the scope mount cap accessory mount 134 (shown in FIGS. 1-8) to stabilize and facilitate rigid engagement of the angled accessory mount 300, 400 with the scope mount cap accessory mount. For example, in the depicted embodiments of FIGS. 15-30, the angled accessory mount 300, 400 include angled mating surfaces 320*a-b*, 420*a-b* having matching angles to the leading surface 146*a* and/or trailing surface 146*b* of the scope mount cap accessory mount 134 (shown in FIGS. 1-8). The angled accessory mount 300, 400 may be reversible relative to the scope mount 100 and the angled mating surfaces 320*a-b*, 420*a-b* in the forwardmost position may be defined as the leading angled mating surface and the angled mating surfaces in the aftmost position may be defined as the trailing angled mating surface. In some embodiments, the depicted mating surfaces 320*a-b*, 420*a-b* may be used for gross location of the accessory mount while the threaded screw and clamp members may be used for fine adjustment (e.g., sequentially, the mating surfaces first help to generally align the accessory mount and subsequently the threaded screw may be tightened for fine adjustment). In some embodiments, the threaded screw may be used for rough alignment while the mating surfaces provide finer adjustment dependent upon the tolerances of the shapes.

In the illustrated embodiments, the angled platforms 304, 404 define a plurality of protrusions 316, 416 and a plurality of openings 318, 418 configured to engage one or more accessories. In various embodiments, an angled platform may comprise any structural feature necessary to engage a particular accessory. For example, the protrusions and/or openings on the angled platforms 304, 404 may take numerous patterns, including but not limited to AIMPOINT, DOCTOR, C-MORE, TRIJICON, RMS/C, GLOCK MOS, and the like mount types.

Turning to FIGS. 31-36, various views of an electronic level 500 and/or electronic level mount 550 are illustrated. Referring to FIGS. 31-34 an electronic level 500 is shown, such as the Send iT Electronic Level™ by Long Range Arms. The electronic level 500 may provide a visual indication of a vertical and/or horizontal incline of the firearm via a series of lights 502 and may be controlled using an adjustment knob 504. The electronic level mount 550 illustrated in FIGS. 31-36 comprises a mount base 556 configured to engage a lateral accessory mount point (e.g., lateral accessory mount point 150 shown in FIGS. 1-7, 9). The mount base 556 may define the same recess-engaging structure and operation of the mount base 206 depicted in FIGS. 11-12. For example, the mount base 556 may include a vertical base surface 558*a*, upper angled surface 558*b*, and lower angled surface 558*c* which may be configured to match and nest with the respective vertical base surface 156*a*, upper surface 156*b*, and lower surface 156*c* of the recess 154 (e.g., as shown in FIG. 9). Although described as "upper" and "lower", the surfaces may be inverted when engaging the recess upside down and may similarly be described as "first" and "second" surfaces without changing their intended meaning. The mount base 556 may also include a fastener (e.g., threaded screw 560) configured to engage the scope mount (e.g., scope mount 100 illustrated in FIGS. 1-9). For example, the threaded screw 560 may extend through an opening in the mount base 556 and engage corresponding threads in an opening of the lateral accessory mount point (e.g., threaded opening 152 of the lateral accessory mount point 150 shown in FIG. 9). In some embodiments, the mount base 556 may include different longitudinal lengths than other mount bases discussed herein (e.g., different lengths along the longitudinal, x axis labeled in FIG. 32), which length may not affect engagement with the scope mount recess but may inform spacing and/or stability of the mounts. For example, a heavier and/or larger accessory may use a longer base in some embodiments without affecting the ability of the bases to attach to the lateral accessory mount points disclosed herein.

The electronic level mount 550 may further include a level support 562 configured to engage the electronic level 500 and position the electronic level relative to the scope mount and ultimately relative to the firearm. In the depicted configuration, the level support 562 is configured to hold the electronic level 500 perpendicular to the mount base 556 and in a vertical orientation relative to the firearm (e.g., with the electronic lights extending vertically). In some embodiments, the level support 562 may be attached to or integrally formed with the mount base 556 at any other angle (e.g., laterally horizontal with the electronic lights extending to either side of the firearm). The level support 562 may include one or more openings 564 configured to receive fasteners therethrough for securing the level 500 to the base. Referring to FIGS. 35-36, in the depicted embodiment, the level support 562 further includes a recess 566 configured to facilitate alignment and support by receiving a corresponding end or portion of an end of the electronic level 500. The level support 562 may also include countersunk recesses 568 for receiving fastener heads.

Turning to FIGS. 37-39, various views of a bubble level 600 and/or bubble level mount 650 are illustrated. Referring to FIGS. 37-38 a bubble level 600 is shown. The bubble level 600 may provide a visual indication of an incline of the firearm via a bubble or other indicator 602 floating in a fluid within a curved vial 604. The bubble level mount 650 illustrated in FIGS. 37-39 comprises a mount base 656 configured to engage a lateral accessory mount point (e.g., lateral accessory mount points 150 shown in FIGS. 1-7, 9). The mount base 656 may define the same recess-engaging structure and operation of the mount base 206 depicted in FIGS. 11-12. For example, the mount base 656 may include a vertical base surface 658*a*, upper angled surface 658*b*, and lower angled surface 658*c* which may be configured to match and nest with the respective vertical base surface 156*a*, upper surface 156*b*, and lower surface 156*c* of the recess 154 (e.g., as shown in FIG. 9). Although described as "upper" and "lower", the surfaces may be inverted when engaging the recess upside down and may similarly be described as "first" and "second" surfaces without changing their intended meaning. The mount base 656 may also include a fastener (e.g., threaded screw 660) configured to engage the scope mount (e.g., scope mount 100 illustrated in FIGS. 1-9). For example, the threaded screw 660 may extend through an opening in the mount base 656 and engage corresponding threads in an opening of the lateral accessory mount point (e.g., threaded opening 152 of the lateral accessory mount point 150 shown in FIG. 9). In some embodiments, the mount base 656 may include different longitudinal lengths than other mount bases discussed herein (e.g., different lengths along the longitudinal, x axis labeled in FIG. 37), which length may not affect engagement with the scope mount recess but may inform spacing and/or stability of the mounts. For example, a heavier and/or larger accessory may use a longer base in some embodiments without affecting the ability of the bases to attach to the lateral accessory mount points disclosed herein.

The bubble level mount 650 may further include a level support 662 configured to engage the bubble level 600 and position the bubble level relative to the scope mount and ultimately relative to the firearm. In the depicted configuration, the level support 662 is configured to hold the bubble level 600 parallel to the threaded screw 660 by hanging the bubble level 600 below the level support 662 in at least some configurations (e.g., the bubble level could also be disposed atop the level support or in another relative position). In some embodiments, the level support 662 may be attached to or integrally formed with the mount base 656 at any other angle. The level support 662 may include one or more openings 664 configured to receive fasteners therethrough for securing the level 600 to the base. Referring to FIG. 39, in the depicted embodiment, the level support 662 further includes a recess 666 configured to facilitate alignment and support by receiving a corresponding end or portion of an end of the bubble level 600. The level support 662 may also include countersunk recesses 668 (illustrated in FIG. 37) for receiving fastener heads.

Turning to FIGS. 40-43, various views of a data card holder 700 and/or pivot mount 750 are illustrated. The data card holder 700 may provide efficient access to information via a number of different means, including but not limited to being or engaging a disposable media (e.g., holding a piece of paper) or a reusable media (e.g., holding a white board, electronic display, etc.). The pivot mount 750 illustrated in FIGS. 40-43 comprises a mount base 756 configured to engage a lateral accessory mount point (e.g., lateral accessory mount points 150 shown in FIGS. 1-7, 9). The pivot mount 750 may provide flexible movement and positioning of the data card holder 700 or other accessories or accessory mounts, such as to provide customized visibility to the operator or to allow transportation and/or storage in a firearm case or other storage container. The mount base 756 may define the same recess-engaging structure and operation of the mount base 206 depicted in FIGS. 11-12. For example, the mount base 756 may include a vertical base surface 758*a*, upper angled surface 758*b*, and lower angled surface 758*c* which may be configured to match and nest with the respective vertical base surface 156*a*, upper surface 156*b*, and lower surface 156*c* of the recess 154 (e.g., as shown in FIG. 9). Although described as "upper" and "lower", the surfaces may be inverted when engaging the recess upside down and may similarly be described as "first" and "second" surfaces without changing their intended meaning. The mount base 756 may also include a fastener (e.g., threaded screw 760) configured to engage the scope mount (e.g., scope mount 100 illustrated in FIGS. 1-9). For example, the threaded screw 760 may extend through an opening in the mount base 756 and engage corresponding threads in an opening of the lateral accessory mount point (e.g., threaded opening 152 of the lateral accessory mount point 150 shown in FIG. 9). In some embodiments, the mount base 756 may include different longitudinal lengths than other mount bases discussed herein (e.g., different lengths along the longitudinal, x axis labeled in FIG. 40), which length may not affect engagement with the scope mount recess but may inform spacing and/or stability of the mounts. For example, a heavier and/or larger accessory may use a longer base in some embodiments without affecting the ability of the bases to attach to the lateral accessory mount points disclosed herein.

The pivot mount 750 may further include a pivot base 762 connected to the mount base 756. In the depicted embodiment, the pivot base 762 extends perpendicular to and is integral with the mount base 756. The pivot base 762 may include a hinge pivot 764 configured to engage at least one hinge 766 or other rotatable structural component of the pivot mount to permit planar rotation therebetween. In the depicted embodiment, the hinge 766 is configured to rotate within an x-y plane relative to the pivot base 762 about a hinge pin 768, which may be threaded into one of the hinge or pivot base (e.g., with another smooth portion for rotating relative to the non-threaded component) or may be secured via any other means. In some embodiments, the hinge pivot 764 may be rotated (e.g., 90 degrees) such that the hinge 766 rotates in a different direction.

In some embodiments, the hinge 766 may directly engage the data card holder 700 or another accessory, accessory mount, and/or another portion of the pivot mount 750 to permit rotation between the mount base 756 and data card holder 700 or other component. With reference to FIGS. 40-43, the hinge 766 may define a first pivot portion 769 configured to directly or indirectly engage the hinge pivot 764 of the pivot base 762, and the hinge 766 may define a second pivot portion 770 configured to directly or indirectly engage a data card holder pivot 772 of the data card holder 700. In the depicted embodiment, the second pivot portion 770 is perpendicular to the first pivot portion 769 to allow additional degrees of movement freedom for the data card holder 700. For example, the data card holder 700 may pivot about a vertical axis (e.g., along a horizontal plane) defined by the hinge pin 768 via the interface between the hinge 766 and pivot base 762, and the data card holder 700 may additionally or alternatively pivot about a horizontal axis (e.g., along a vertical plane) defined by a second hinge pin 774 connecting the second pivot portion 770 with the data card holder pivot 772. In some embodiments, as shown in FIGS. 40-43, one or more bushings 776 may be disposed between the respective hinging components to facilitate better operation while at least friction within the hinge points holds the data card holder stable relative to the firearm when not being adjusted. Moreover, any number of hinges and hinge points in any relative orientations may be used to connect the mount base 756 with the data card holder 700 to confer a desired degree of movement to the data card holder.

Figure 43:
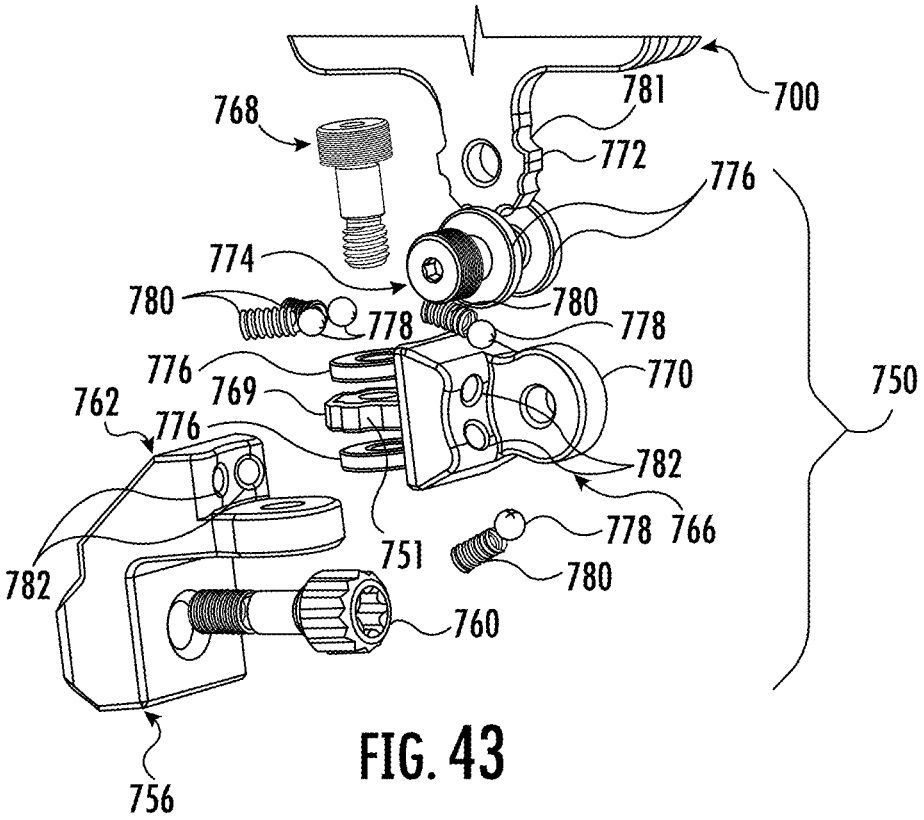

With reference to FIG. 43, the pivot mount 750 may further include one or more ball detent mechanisms to define discrete holding positions for each of the hinge points of the pivot mount. Each joint may define a separate ball detent mechanism, or one or more joints may omit the ball detent mechanism. The ball detent mechanism may comprise one or more balls 778 engaging one or more springs 780. The balls 778 and springs 780 may be inserted into openings 782 in the walls adjacent the respective hinge points. By way of non-limiting example, as shown in FIG. 43, the pivot base 762 may include openings 782 adjacent the hinge pivot 764, which may be configured to engage one or more detents 781 along the outer perimeter of the first pivot portion 769 of the hinge 766. The hinge 766 may include openings 782 adjacent the second pivot portion 770 configured to hold one or more balls 778 and springs 780. The balls 778 and springs 780 of the hinge 766 may then be configured to engage one or more detents 781 along the outer perimeter of the data card holder pivot 772 of the data card holder 700. In some embodiments, multiple balls 778 and multiple springs 780 may be used at different respective rotational positions (e.g., two sets per hinge joint as illustrated in FIG. 43). Moreover, the mounting positions of the balls/springs and detents may be reversed or moved so long as the balls and detents are configured to engage each other.

In the depicted embodiment the data card holder 700 defines the data card holder pivot 772 extending from a lower, narrow edge of the data card holder. In various embodiments, the data card holder pivot 772 may extend from any surface of the data card holder 700 in any desired direction, including a rear, flat surface of the data card holder. The pivot mount 750 may similarly be configured for use with any other accessories or accessory mounts.

Turning to FIGS. 44-50, various views of a heads-up display (HUD) 800, a HUD clamp 810, and/or pivoting rail mount 850 are illustrated. The HUD 800 may provide efficient access to information via a number of different means, including but not limited to an electronic display (e.g., a display of target data). The HUD 800 may interact with one or more other components (e.g., sensors) on the firearm to display real-time information to the user.

The pivoting rail mount 850, portions of which are illustrated in each of FIGS. 44-50 comprises a mount base 856 configured to engage a lateral accessory mount point (e.g., lateral accessory mount points 150 shown in FIGS. 1-7, 9). The mount base 856 may define the same recess-engaging structure and operation of the mount base 206 depicted in FIGS. 11-12. For example, the mount base 856 may include a vertical base surface 858*a*, upper angled surface 858*b*, and lower angled surface 858*c* which may be configured to match and nest with the respective vertical base surface 156*a*, upper surface 156*b*, and lower surface 156*c* of the recess 154 (e.g., as shown in FIG. 9). Although described as "upper" and "lower", the surfaces may be inverted when engaging the recess upside down and may similarly be described as "first" and "second" surfaces without changing their intended meaning. The mount base 856 may also include a fastener (e.g., threaded screw 860) configured to engage the scope mount (e.g., scope mount 100 illustrated in FIGS. 1-9). For example, the threaded screw 860 may extend through an opening in the mount base 856 and engage corresponding threads in an opening of the lateral accessory mount point (e.g., threaded opening 152 of the lateral accessory mount point 150 shown in FIG. 9). In some embodiments, the mount base 856 may include different longitudinal lengths than other mount bases discussed herein (e.g., different lengths along the longitudinal, x axis labeled in FIG. 44), which length may not affect engagement with the scope mount recess but may inform spacing and/or stability of the mounts. For example, a heavier and/or larger accessory may use a longer base in some embodiments without affecting the ability of the bases to attach to the lateral accessory mount points disclosed herein.

The pivoting rail mount 850 may include a pivot base 862 that may function similar to the pivot base 762 of the embodiment of FIGS. 40-43. In the depicted embodiment, the pivoting rail mount 850 includes a hinging rail 866 comprising a pivot portion 869 configured directly or indirectly (e.g., via one or more bushings) engage and pivot relative to a hinge pivot 864 of the pivot base 862. For example, a hinge pin 868 may rotationally couple the pivot portion 869 and the pivot base 862, and one or more bushings 876 may provide improved rotation of the hinging rail 866.

With reference to FIGS. 46, 49, and 50, the pivoting rail mount 850 may further include one or more ball detent mechanisms to define discrete holding positions for each of the hinge points of the pivoting rail mount 850. The ball detent mechanism may comprise one or more balls 878 engaging one or more springs 880. The balls 878 and springs 880 may be inserted into openings 882 in the walls adjacent the respective hinge points. By way of non-limiting example, as shown in FIG. 50, the pivot base 862 may include openings 882 adjacent the hinge pivot 864, which may be configured to engage one or more detents 881 (shown in FIGS. 44-49) along the outer perimeter of the pivot portion 869 of the hinging rail 866. In some embodiments, multiple balls 878 and multiple springs 880 may be used at different respective rotational positions (e.g., two sets per hinge joint as illustrated in FIGS. 49-50). Moreover, the mounting positions of the balls/springs and detents may be reversed or moved so long as the balls and detents are configured to engage each other.

With continued reference to FIGS. 44-50, in some embodiments, the pivoting rail mount 850 may include a Picatinny rail 870 or other mount configured to pivot relative to the pivot base 862. In the depicted embodiment, the Picatinny rail 870 is vertically oriented (e.g., to orient accessories along the vertical, z axis labeled in FIG. 44) and integrally formed with the pivot portion 869 as part of the hinging rail 866. The Picatinny rail 870 may define one or more attachment points configured to engage corresponding additional accessory mounts (e.g., Picatinny-compatible mounts). In the depicted embodiment, a HUD clamp 810 is configured to secure the HUD 800 to the Picatinny rail 870.

Referring to FIGS. 44-46, the HUD clamp 810 may define a base plate 812 and a movable clamp member 814. In the depicted embodiment, the base plate 812 includes at least one rim 816 configured to at least partially surround at least one edge of the HUD 800 to grip the HUD (e.g., to overlap at least a portion of a front edge surface of the HUD) without obstructing the screen 802 of the HUD. For example, the at least one rim 816 of the base plate 812 may engage a bezel 804 of the HUD 800. In the depicted embodiment, an opposite edge of the HUD (e.g., an opposing lateral side of the bezel on an opposite side of the screen) may be engaged and secured to the base plate 812 with a movable clamp member 814.

The movable clamp member 814 may define a body having at least one clamp rim 818 along one side thereof. The movable clamp member 814 may engage the base plate 812 via one or more fasteners (e.g., threaded screws 820) to pull the at least one clamp rim 818 towards a rear of the base plate, and by doing so, clamp the HUD 800 within the HUD clamp 810. The fasteners 820 and the rims 816, 818 may prevent the HUD 800 from detaching from the HUD clamp 810 without first unscrewing the fasteners. In the depicted embodiment, the base plate 812 includes partial channels 824 extending front-to-back along the path of the fasteners 820 to stabilize and provide support for the fasteners prior to entering openings 826 to which the fasteners may secure (see FIG. 48).

With reference to FIGS. 44-48, the base plate 812 and movable clamp member 814 may similarly grip the Picatinny rail 870. For example, the depicted base plate 812 includes a fixed clamp member 822 having a groove that engages a first side of the profile of the Picatinny rail 870. The movable clamp member 814 may further include a second rim 828 configured to engage a second side of the profile of the Picatinny rail 870 as shown in FIG. 47. The second rim 828 may be laterally opposite the clamp rim 818 along the body of the movable clamp member 814. In such embodiments, the normal forces from the Picatinny rail 870 and the HUD 800 on either side of the movable clamp member 814 may offset to balance the forces (e.g., reducing torque on the fasteners 820) and facilitate securing both the HUD 800 and the Picatinny rail 870 to the HUD clamp 810 with the same fasteners 820. In various other embodiments, separate clamp elements, including any of the various mounts and components disclosed herein, may be used with or instead of the depicted components. Moreover, in some embodiments, one or more hinges (e.g., similar to hinge 766 in the embodiments of FIGS. 40-43) may be added between the pivot base 862 and the hinging rail 866 to provide additional articulation to the assembly.

In the depicted embodiments, the various rims and clamp members may be tapered to a wedge tip and may be configured to engage corresponding grooves for improved engagement. While one particular configuration of movement and relative positioning is shown, the features may be connected in different orientations to reach a desired position (e.g., attaching various components, such as the Picatinny rail in different orientations and/or adding more or different hinge points to increase the movement capabilities of the mount).

Turning to FIGS. 51-54, various views of a bridge mount 900 configured to engage a plurality of lateral accessory mount points of a scope mount are shown. The bridge mount 900 may define a generally u-shaped cross section and may be configured to engage two or more lateral accessory mount points (e.g., lateral accessory mount point 150 shown in FIGS. 1-7, 9) on opposite lateral sides of the scope mount (e.g., both fore lateral accessory mount points 150*a-b* shown in the embodiment of FIGS. 1-7, 9 and/or both aft lateral accessory mount points 150*c-d* shown in the embodiment of FIGS. 1-7, 9). In such embodiments, the bridge mount 900 may be configured to extend over the scope and allow mounting of accessories and/or accessory supports in one or more locations (e.g., similar to a second, larger scope clamp ring 110 that does not hold the scope).

The bridge mount 900 may connect to the respective lateral accessory mount points in a similar manner to other embodiments discussed herein. For example, the bridge mount 900 illustrated in FIGS. 51-54 comprises a pair of mount bases 902 on opposite lowermost ends of its generally u-shaped body. The pair of mount bases 902 face each other and are configured to engage opposing lateral accessory mount points on opposite sides of a scope mount (e.g., the scope mount 100 shown in FIGS. 1-9). The mount bases 902 may each define the same recess-engaging structure and operation of the mount base 206 depicted in FIGS. 11-12. For example, the mount bases 902 may include a vertical base surface 904*a*, upper angled surface 904*b*, and lower angled surface 904*c* which may be configured to match and nest with the respective vertical base surface 156*a*, upper surface 156*b*, and lower surface 156*c* of the recess 154 (e.g., as shown in FIG. 9). Although described as "upper" and "lower", the surfaces may be inverted when engaging the recess upside down and may similarly be described as "first" and "second" surfaces without changing their intended meaning. The mount bases 904 may also include a fastener (e.g., threaded screw 906 shown in FIG. 51) configured to engage the scope mount (e.g., scope mount 100 illustrated in FIGS. 1-9). For example, the threaded screw 906 may extend through an opening in the respective mount base 904 and engage corresponding threads in an opening of the lateral accessory mount point (e.g., threaded opening 152 of the lateral accessory mount point 150 shown in FIG. 9). In some embodiments, the mount bases 904 may include different longitudinal lengths than other mount bases discussed herein (e.g., different lengths along the longitudinal, x axis labeled in FIG. 51), which length may not affect engagement with the scope mount recess but may inform spacing and/or stability of the mounts. For example, a heavier and/or larger accessory may use a longer base in some embodiments without affecting the ability of the bases to attach to the lateral accessory mount points disclosed herein. In particular with regard to the bridge mount 900, the longitudinal length of the mount bases 904 may be longer than other mounts discussed herein because the bridge mount 900 may be configured to engage two or more accessories and/or accessory mounts.

The bridge mount 900 may include one or more accessory and/or accessory mount attachment points. For example, the depicted embodiment includes a Picatinny rail 910 disposed along a top of the bridge mount and oriented along the longitudinal direction (e.g., along the positive and negative x axis as labeled in FIG. 51) at the lateral center of the bridge mount. As with other embodiments of the Picatinny rail 910 discussed herein, the rail may include a t-shaped cross section configured to engage one or more accessories and/or accessory mounts at one or more locations along the rail.

Moreover, the bridge mount 900 may also include one or more auxiliary mount points, such as one or more auxiliary lateral accessory mount points 930 as shown in the embodiment of FIGS. 51-54. The auxiliary lateral accessory mount points 930 may be configured to engage one or more mount bases (e.g., mount bases 206, 556, 656, 756, 856, 902) in a similar manner to the lateral accessory mount points (e.g., lateral accessory mount point 150 shown in FIGS. 1-7, 9) disclosed herein. For example, the depicted auxiliary lateral accessory mount points 930 may include one or more recesses 932 configured to receive at least a portion of an accessory mount therein. In the depicted embodiment, the recesses 932 define a channel shape extending longitudinally from fore to aft of the bridge mount 900. The channel shape may be configured to vertically and rotationally (e.g., about the y axis corresponding to the rotational axis of a fastener) position the accessory mount for operation. The fastener may thereby secure the accessory mount relative to six axes in cooperation with the channel structure. In some embodiments, the fore and aft ends of the recesses 932 may be open. In the depicted embodiment, the recesses 932 are disposed on either lateral side of the bridge mount 900 facing outwardly at a position above the mount bases 902, which position may generally correspond to a height of the scope when assembled with a firearm.

Figure 53:
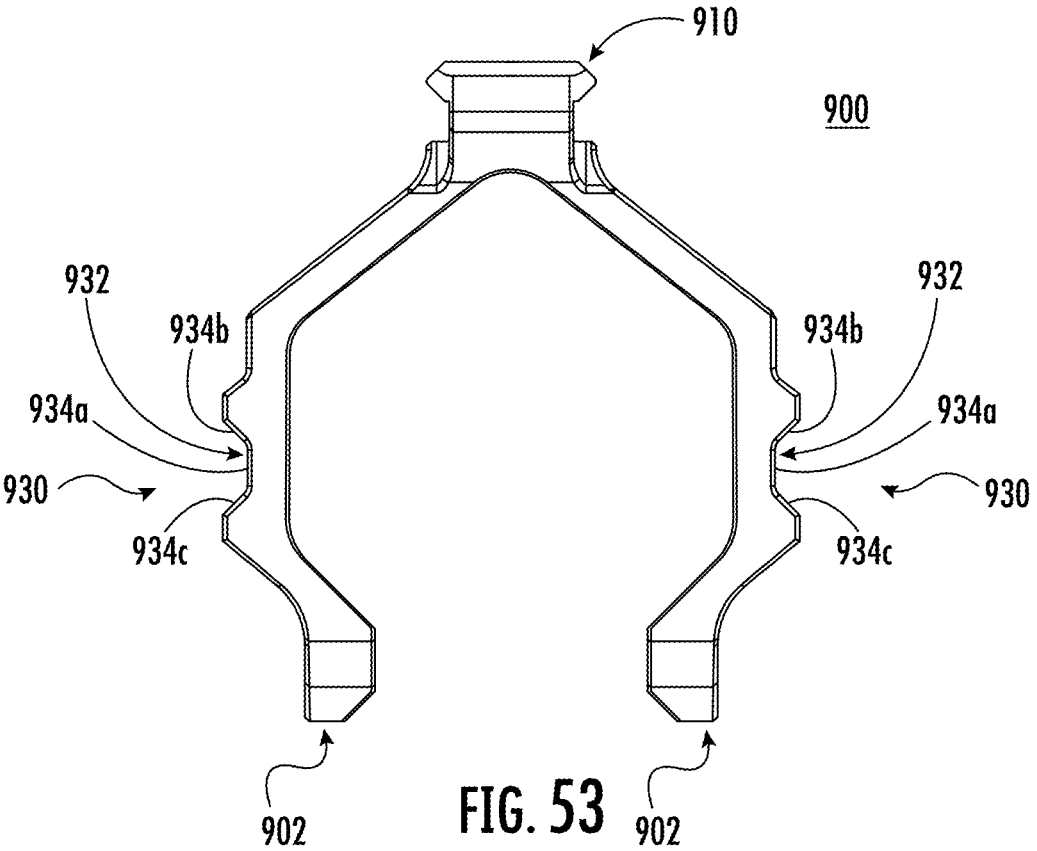
Figure 54:
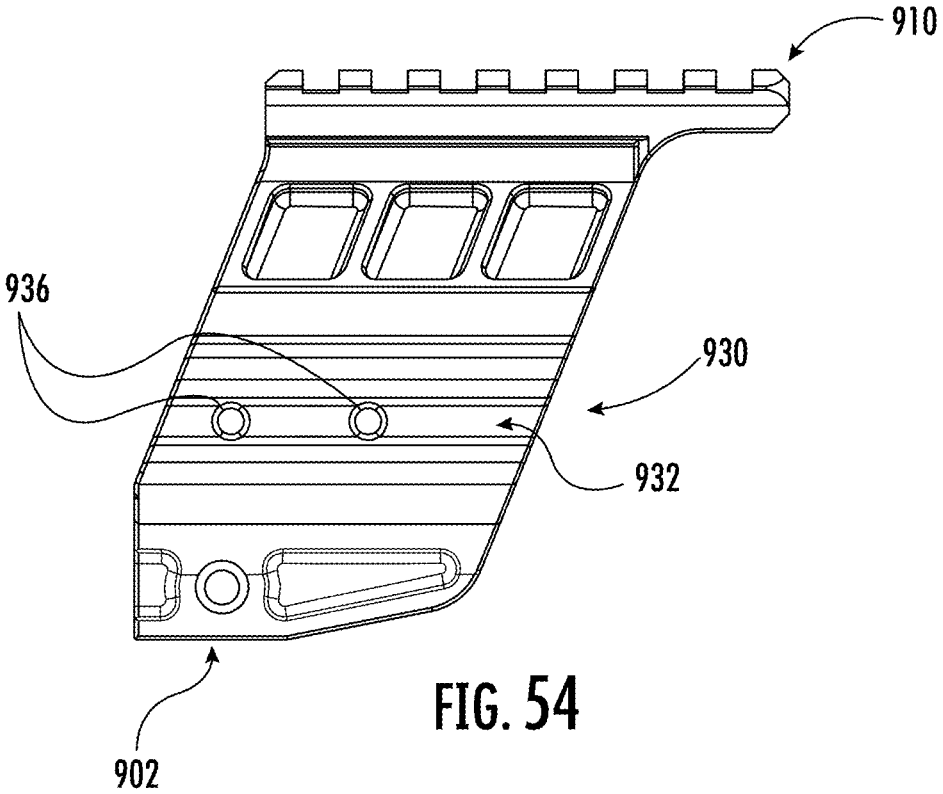
Figure 55:
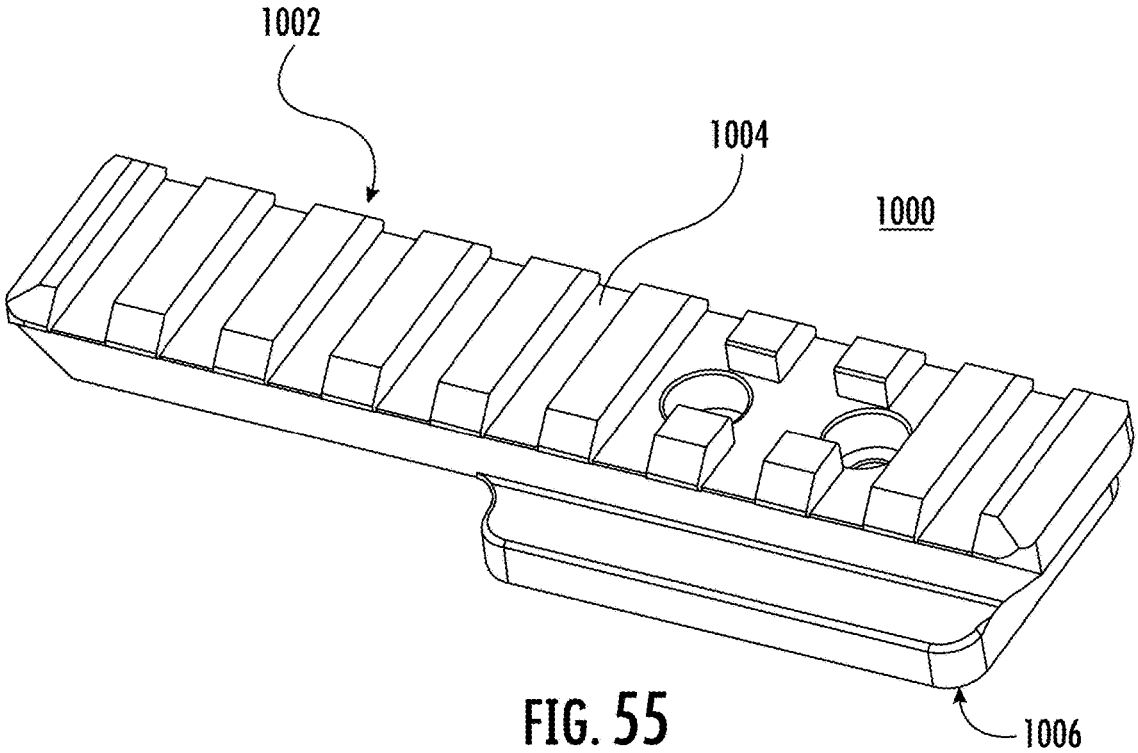
Figure 56:
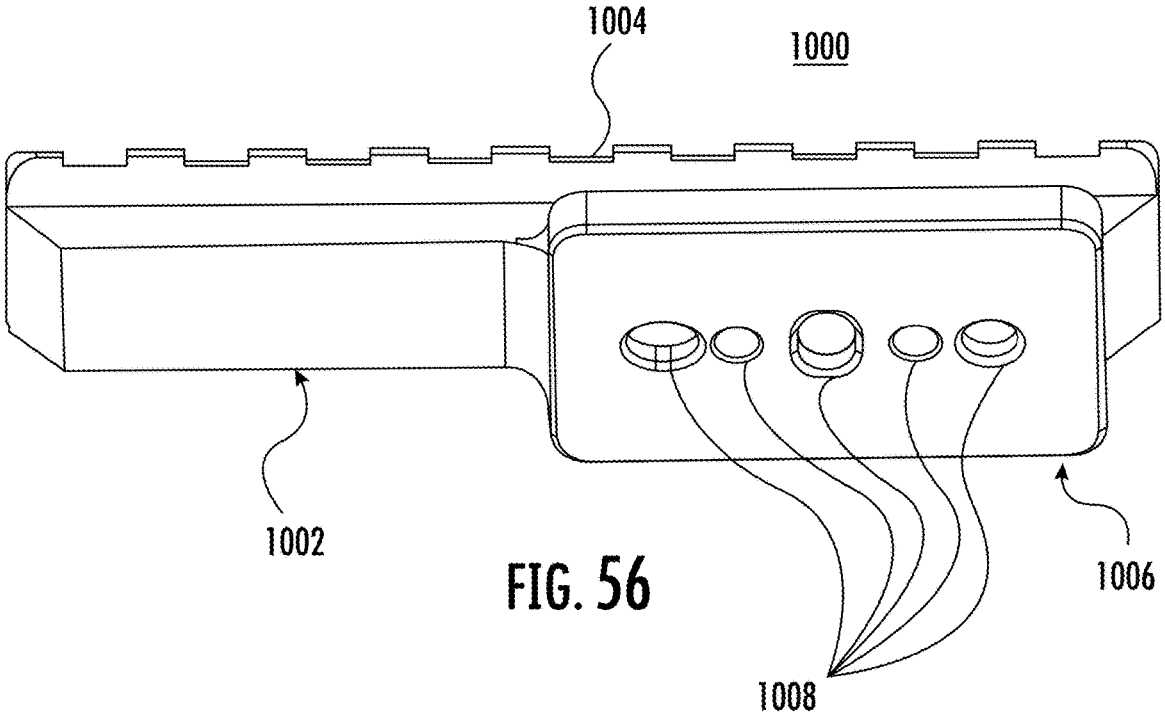
Figure 57:
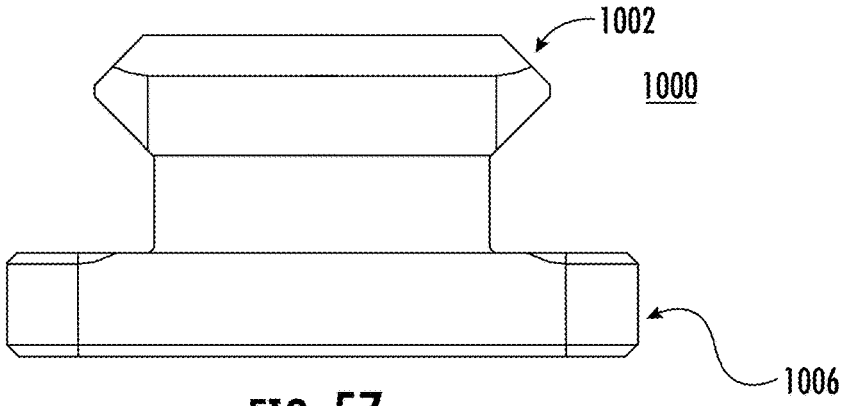
Figure 58:
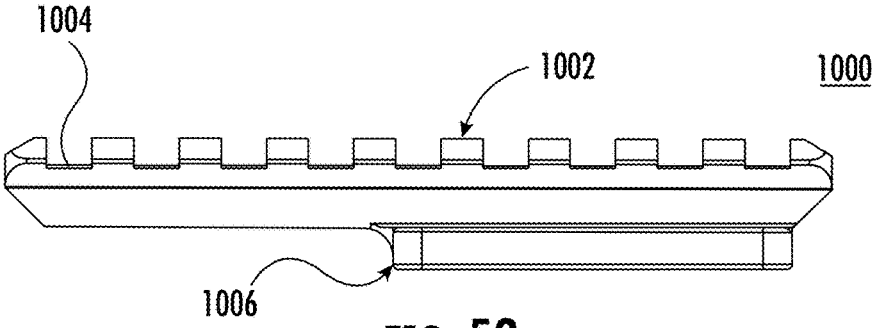
Figure 59:
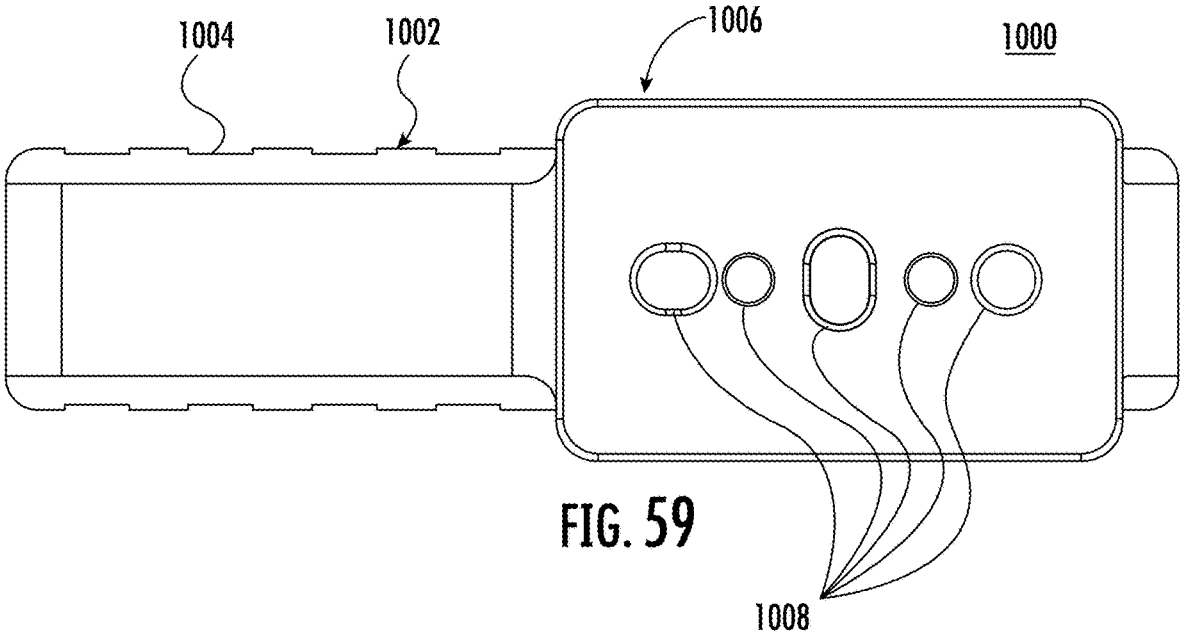

With reference to FIG. 53, the recesses 932 may include a vertical base surface 934*a* adjacent an upper surface 934*b* that is partly downwardly angled and a lower surface 934*c* opposite the upper surface that is partly upwardly angled. Collectively the surfaces 934*a-c* define a generally trapezoid shaped cross section of the recess 902. In some embodiments, the upper surface 934*b* and lower surface 934*c* may define mirrored angles of equal magnitude relative to a horizontal plane. In some embodiments, the upper surface 934*b* and lower surface 934*c* may be the same length and/or width. The vertical base surface 934*a* may be defined along a vertical-longitudinal plane relative to the bridge mount 900 in an installed position (e.g., perpendicular to the lateral dimension along a plane defined by the longitudinal and vertical directions). In the depicted embodiment, the recess surfaces 934*a-c* terminate in different longitudinal positions, while maintaining the same cross section along their lengths.

The auxiliary lateral accessory mount points 930 may comprise one or more openings 936 configured to engage fasteners (e.g., pins, clips, threaded fasteners such as screws 906, other protrusions, etc.) to secure the accessory mounts to the bridge mount 900. The openings 936 may be shaped to receive the respective fasteners (e.g., threaded to receive screws 906, etc.). The openings 936 may extend laterally into the body of the bridge mount 900 to receive fasteners from external, lateral directions (e.g., fasteners inserted along the positive or negative y axis illustrated in FIG. 51, which is perpendicular to the longitudinal, x axis). In the depicted embodiment, opposing lateral accessory mount points may be aligned longitudinally and/or vertically. In some embodiments, opposing openings may not be aligned. In the depicted embodiment, each recess 932 includes two openings 936 configured to receive a fastener therein. Thus, in some embodiments, the bridge mount 900 may be said to define two auxiliary lateral accessory mount points 930 per side (e.g., with each opening corresponding to a separate mount point). In some embodiments, the dual openings may be considered a single auxiliary lateral accessory mount points 930.

In the depicted embodiment, the u-shaped body of the bridge mount 900 is cantilevered slightly forward, such that the center of the Picatinny rail 910 is forward of the screws 906 of the mount bases 902. In some embodiments, the bridge mount 900 may be mounted to the scope mount with the cantilever oriented in either direction (e.g., cantilevered forward or cantilevered aftward).

Turning to FIGS. 55-59, another Picatinny rail mount 1000 embodiment is shown. The Picatinny rail mount 1000 defines a Picatinny rail 1002 configured to engage one or more accessories and/or accessory mounts in accordance with procedures known in the art. The Picatinny rail 1002 defines a t-shaped cross section with a plurality of cross-cut grooves 1004 configured to engage and secure accessories and accessory mounts to the rail. The depicted Picatinny rail mount 1000 further comprises a base plate 1006 configured to engage a mount. The depicted base plate 1006 is generally rectangular shaped with rounded corners. The base plate may further define one or more openings 1008 configured to engage corresponding protrusions of the mount. For example, the base plate 1006 may be configured to engage one of the angled platforms 304, 404 shown in the embodiment of FIGS. 15-30. The base plate 1006 may facilitate adding a Picatinny rail to the angled platforms or any other similarly configured mount surface. A similar base plate 1006 may be applied to any other accessory and/or accessory mount to facilitate similar compatibility with the angled platforms.

Example Firearm Assemblies

FIGS. 60-64 illustrate various configurations of accessories and accessory mounts coupled to a scope mount 100 in accordance with various non-limiting example embodiments of the present disclosure. FIG. 60 illustrates a solid-line version of the firearm 10 of FIG. 1 having a scope mount 100 engaged with an upper receiver 12 of the firearm (e.g., via the Picatinny rail atop the upper receiver). The scope mount 100 may support the scope 20 via the scope mount rings 110*a*, 110*b*. The scope mount 100 illustrated in FIG. 60 includes a plurality of accessory mounts, including a pair of scope mount cap accessory mounts 134*a*, 134*b* and a plurality of lateral accessory mount points 150*a, c*, with lateral accessory mount points (not shown) in matching locations on the opposite side of the scope mount 100.

Figure 61:
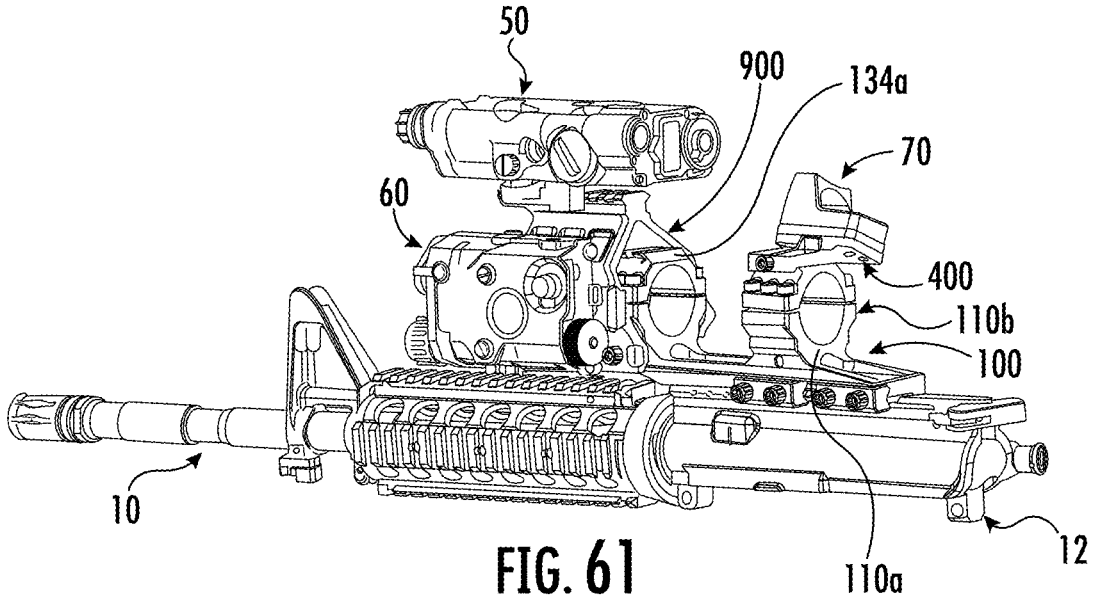
Figure 62:
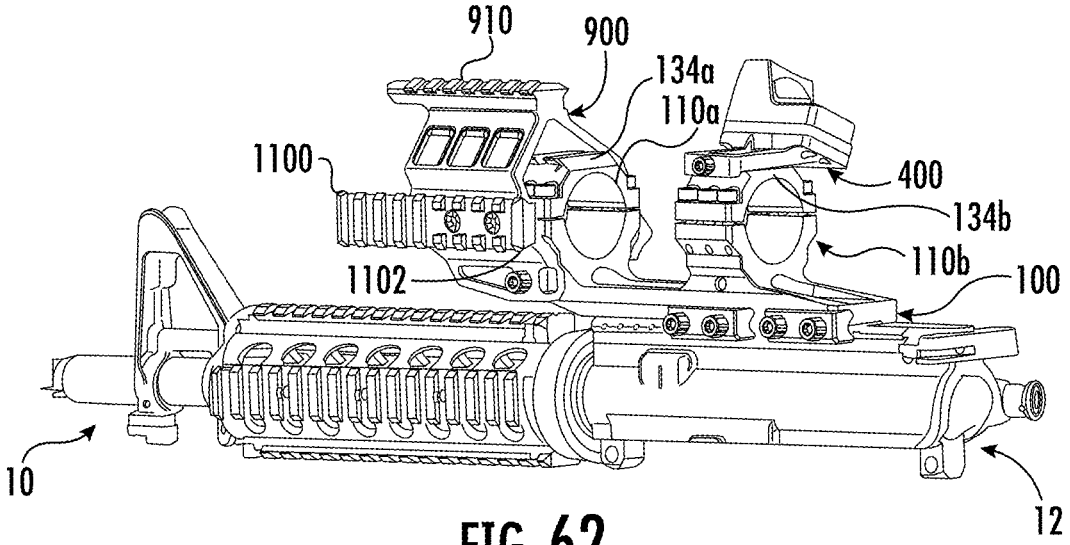
Figure 63:
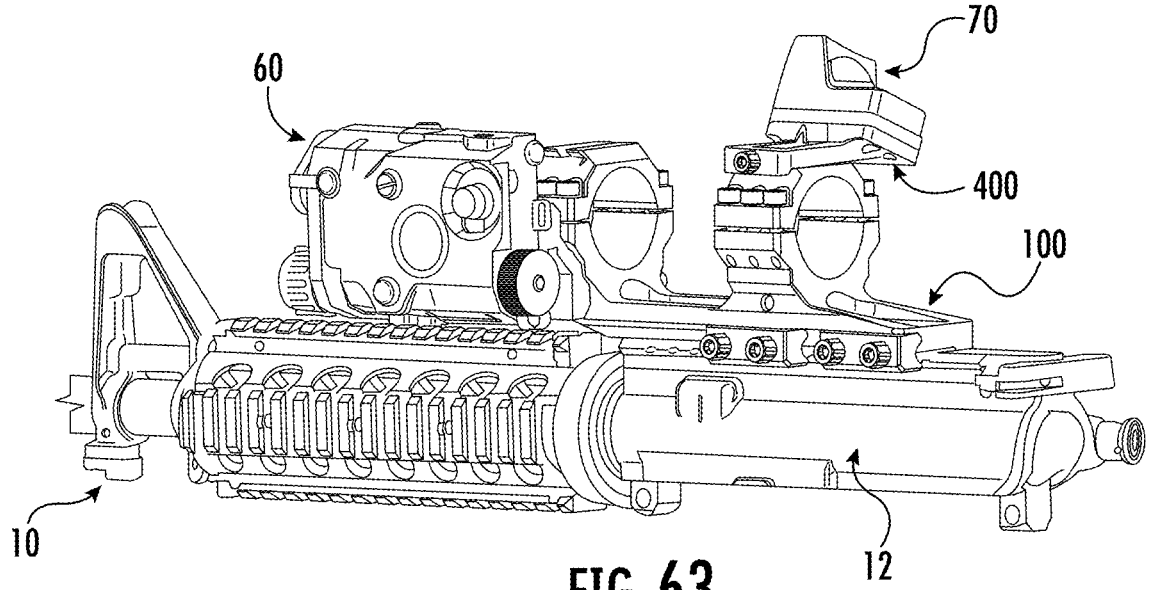
Figure 64:
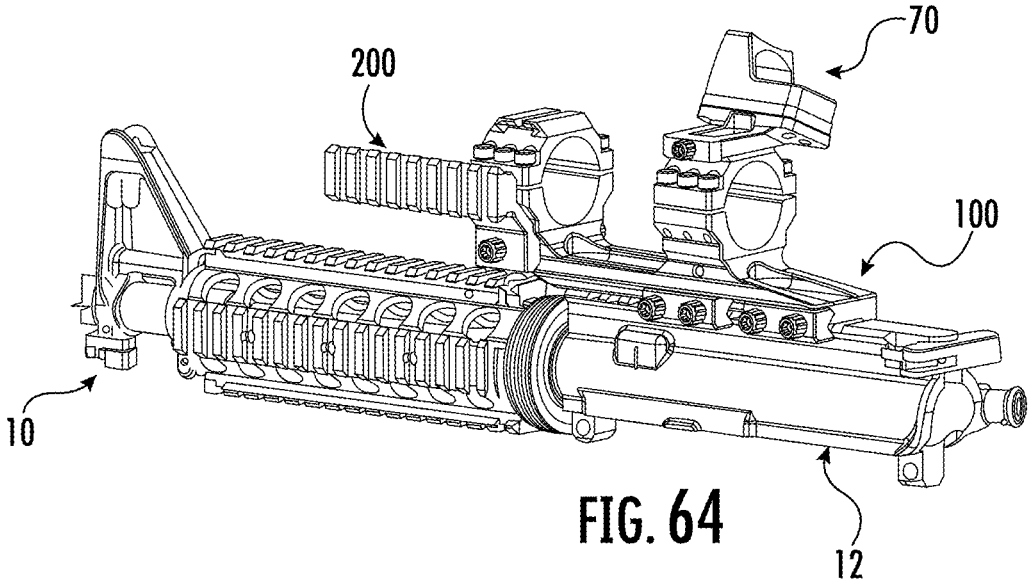

FIGS. 61-62 illustrate an embodiment of the firearm 10 of FIGS. 1 and 60 having three accessories 50, 60, 70 mounted thereto respectively using a Picatinny rail 910 of a bridge mount 900 (e.g., as shown in the embodiment of FIGS. 51-54), a Picatinny rail adapter 1100 engaged with an auxiliary lateral accessory mount point of the bridge mount 900, and an angled accessory mount 400 (e.g., as shown in the embodiment of FIGS. 24-30, or alternatively the embodiment of FIGS. 15-23). In the depicted embodiment, as a non-limiting example, the three accessories comprise a laser range finder 50, an aiming laser 60, and a red dot optic 70; however, any accessories and combinations of accessories may be used or omitted in various embodiments. For example, accessories 50 and 60 in the depicted embodiment show two different range finders that typically would not be used together, although they are not preluded from simultaneous use by the depicted mount structures. FIG. 62 illustrates the firearm 10 with the bridge mount 900 accessories 50, 60 removed for ease of viewing. In the depicted embodiment, the angled accessory mount 400 may be reversed to the other side of the scope clamp ring 110*b* and/or moved to the front scope clamp ring 110*a*. Similarly, the bridge mount 900 may be reversed and/or moved to the rear of the scope mount 100, and/or the Picatinny rail adapter 1100 may be moved to any other lateral accessory mount point or auxiliary lateral accessory mount point. In the depicted embodiment, the Picatinny rail adapter 1100 includes a mount base similar to the mount bases discussed herein configured to engage a recess of a lateral accessory mount point or auxiliary lateral accessory mount point. FIGS. 63-64 further illustrate an embodiment of the firearm of FIGS. 61-62 engaging two accessories 60, 70 with the bridge mount being replaced by a Picatinny rail mount 200 (e.g., as shown in FIGS. 10-14) to support the first accessory 60.

Embodiments of the present disclosure include a scope mount capable of being configured with one or more accessory mounts, which mounts may engage one or more accessories and/or accessory mounts to define a flexible, modular mount system. The scope mount may be configured to support the system, such that the entire scope and accessory system may be removed from the firearm by removing the scope mount from the firearm, which may allow a user to have discrete, optic-based accessory sets capable of quick swapping (e.g., one long-range accessory set for long range firing and one close quarters accessory set for close quarters firing). Other example sets may include a first set having a high-powered optic (e.g., 5-25× power) with a red dot and rangefinder, and a second set having a low power optic (e.g., 1-6 power, 1-10 power, etc.) and no red dot. These various sets can be deployed as mission-specific loadouts and/or sold as dedicated loadout accessory groups for customer use. Moreover, the flexible mount structures described herein enable a plurality of mounting options for every accessory and ensure that the modular system positions each of the accessories precisely and robustly where it is needed. Moreover, the mounting positions and structures shown and described herein facilitate a stable scope and accessory mounts to allow accurate, precise firing without requiring additional mounts, holes, or the like to be added to the firearm itself.

CONCLUSION

The above descriptions of various embodiments of the subject disclosure and corresponding figures and what is described in the Abstract, are described herein for illustrative purposes, and are not intended to be exhaustive or to limit the disclosed embodiments to the precise forms disclosed. It is to be understood that one of ordinary skill in the art may recognize that other embodiments having modifications, permutations, combinations, and additions can be implemented for performing the same, similar, alternative, or substitute functions of the disclosed subject matter, and are therefore considered within the scope of this disclosure. As a non-limiting example, various components herein may have their base features (e.g., mount bases) exchanged for other base features (e.g., clamp mount bases) to facilitate interoperability with other mounting locations on the scope mount. Similarly, accessory engagement features may be modified to accommodate any accessory and/or any base type. Therefore, the disclosed subject matter should not be limited to any single embodiment described herein, but rather should be construed in breadth and scope in accordance with the appended claims below. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A scope mount for a firearm, the scope mount comprising:

a body configured to attach to an upper receiver of the firearm, the body defining a lower scope mount portion; and a scope mount cap configured to engage the lower scope mount portion of the body, at least a portion of the scope mount cap and at least a portion of the lower scope mount portion of the body collectively defining a passage configured to receive a scope therethrough along a longitudinal direction of the body, wherein the body defines at least one lateral accessory mount point comprising an opening extending in a lateral direction perpendicular to the longitudinal direction, the opening defined at a height below a height of the passage, and wherein the at least one lateral accessory mount point comprises a first lateral accessory mount point, the first lateral accessory mount point comprising a recess formed in a lateral side of the body, the recess configured to receive an accessory mount therein.

2. A scope mount for a firearm, the scope mount comprising:

a body configured to attach to an upper receiver of the firearm, the body defining a lower scope mount portion; and a scope mount cap configured to engage the lower scope mount portion of the body, at least a portion of the scope mount cap and at least a portion of the lower scope mount portion of the body collectively defining a passage configured to receive a scope therethrough along a longitudinal direction of the body, wherein the body defines at least one lateral accessory mount point comprising an opening extending in a lateral direction perpendicular to the longitudinal direction, the opening defined at a height below a height of the passage, and wherein the body defines threading in the opening configured to receive a threaded fastener therein.

3. The scope mount of claim 1, wherein the opening is defined at a longitudinal position corresponding to the passage.

4. The scope mount of claim 1, wherein the at least one lateral accessory mount point comprises at least two lateral accessory mount points, including a first lateral accessory mount point and a second lateral accessory mount point laterally opposite the body relative to the first lateral accessory mount point.

5. The scope mount of claim 4, wherein the opening extends entirely through the body from the first lateral accessory mount point to the second lateral accessory mount point, such that each of the first lateral accessory mount point and the second lateral accessory mount point comprises the opening.

6. The scope mount of claim 1 wherein the recess of the first lateral accessory mount point defines inwardly tapered upper and lower walls, and wherein the recess of the first lateral accessory mount point defines a longitudinally extending groove in the lateral side of the body having open fore and aft ends.

7. A scope mount for a firearm, the scope mount comprising:

a body configured to attach to an upper receiver of the firearm, the body defining a lower scope mount portion; and a scope mount cap configured to engage the lower scope mount portion of the body, at least a portion of the scope mount cap and at least a portion of the lower scope mount portion of the body collectively defining a passage configured to receive a scope therethrough along a longitudinal direction of the body, wherein the body defines at least one lateral accessory mount point comprising an opening extending in a lateral direction perpendicular to the longitudinal direction, the opening defined at a height below a height of the passage, and wherein the scope mount cap defines:

a lower surface; and a lateral groove open on at least a top side opposite the lower surface and on lateral ends of the lateral groove.

8. The scope mount of claim 7, wherein the at least one lateral accessory mount point comprises a first lateral accessory mount point, the first lateral accessory mount point comprising a lateral mount point recess formed in a lateral side of the body, the lateral mount point recess configured to receive an accessory mount therein.

9. The scope mount of claim 7, wherein a bottom side of the lateral groove defines a shortest lateral portion of the lateral groove.

10. The scope mount of claim 7, wherein the scope mount cap defines a recess on each lateral side of the scope mount cap defined at each of the respective lateral ends of the lateral groove, and wherein the recesses on each lateral side of the scope mount each define longitudinal fore and aft ends each configured to constrain longitudinal motion of one or more accessories.

11. The scope mount of claim 10, wherein a lateral width of the scope mount cap spanning fore ends of the recesses and a second lateral width of the scope mount cap spanning aft ends of the recesses are each greater than a third lateral width of the scope mount cap at a bottom side of the lateral groove within the recesses.

12. The scope mount of claim 7, wherein each recess is defined by a plurality of inwardly angled surfaces.

13. The scope mount of claim 12, wherein the plurality of inwardly angled surfaces comprise a downwardly angled surface, an upwardly angled surface, at least one at least partially aftwardly angled surface, and at least one at least partially forwardly angled surface.

14. The scope mount of claim 13, wherein each of the downwardly angled surface, the upwardly angled surface, the at least one at least partially aftwardly angled surface, and the at least one at least partially forwardly angled surface is angled towards a center of each respective recess.

15. The scope mount of claim 7, wherein each recess defines a midline extending longitudinally and intersecting a bottom side of the lateral groove, wherein the recess on either side of the midline slopes toward the midline.

16. The scope mount of claim 7, wherein a cross-sectional area of each recess decreases towards a lateral center of the scope mount cap.

17. The scope mount of claim 7, further defining a leading surface and a trailing surface at opposite longitudinal sides of the lateral groove, wherein the leading surface and trailing surface are each angled relative to a vertical direction, such that a first distance between an upper edge of the leading surface and an upper edge of the trailing surface is less than a second distance between a lower edge of the leading surface and a lower edge of the trailing surface.

18. The scope mount of claim 7, wherein the lateral groove is laterally shorter at a bottom of the lateral groove opposite the top side than at the top side.

19. The scope mount of claim 7, wherein the scope mount cap defines a recess on each lateral side of the scope mount cap defined at each of the respective lateral ends of the lateral groove.

20. A firearm comprising:

an upper receiver; and the scope mount of claim 7, wherein the body of the scope mount is attached to the upper receiver.

* * * * *